US006225882B1

(12) United States Patent
Hood et al.

(10) Patent No.: US 6,225,882 B1
(45) Date of Patent: May 1, 2001

(54) CIRCUIT INTERRUPTER WITH AN IMPROVED MAGNETICALLY-INDUCED AUTOMATIC TRIP ASSEMBLY

(75) Inventors: Teresa I. Hood; Jonathan M. Peifer, both of Pittsburgh; Raymond P. Gundy, Indiana; Joseph B. Humbert, Monaca; Michael McNeil, White Oak; Mark O. Zindler, Pittsburgh, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/384,146

(22) Filed: Aug. 27, 1999

(51) Int. Cl.[7] ..... H01H 9/00
(52) U.S. Cl. ..... 335/172; 335/35
(58) Field of Search ..... 335/23–25, 167–176, 335/202

(56) References Cited

U.S. PATENT DOCUMENTS 2,776,349 * 1/1957 Thomas ..... 335/35
5,250,918 * 10/1993 Edds et al. ..... 335/35
5,432,491 * 7/1995 Peter et al. ..... 335/35

* cited by examiner

*Primary Examiner*—Lincoln Donovan
*Assistant Examiner*—Tuyên T. Nguyên
(74) *Attorney, Agent, or Firm*—Charles E. Kosinski

(57) ABSTRACT

A circuit interrupter including a housing, separable main contacts disposed in the housing, and an operating mechanism disposed in the housing and interconnected with the contacts. A trip mechanism is disposed in the housing and includes a rotatable trip bar assembly that, when selectively rotated, generates a tripping operation that causes the contacts to open. The trip mechanism further includes an automatic trip assembly for selectively rotating the trip bar assembly upon a predetermined current threshold. The automatic trip assembly includes a magnetic yoke having two arms with a pivot support on the top of each. Each of the pivot supports includes a pivot surface, and one of the pivot supports includes a rear retaining protrusion adjacent its pivot surface. The other of the pivot supports includes a front retaining member adjacent its pivot surface. The automatic trip assembly further includes an armature having pivot portions positioned on the pivot surfaces which provides for rotation of the armature between a first position away from the arms and a second position closer to the arms. A magnetic field is generated upon the predetermined current threshold which causes the armature to rotate from the first position to the second position and to rotate the trip bar assembly. One of the pivot supports also includes a downwardly facing stop. The downwardly facing stop is positioned to abut the armature when the armature is rotated away from the arms, thereby defining the first position.

4 Claims, 69 Drawing Sheets

OFF POSITION

ON POSITION

TRIPPED POSITION

RESETTING POSITON

CIRCUIT INTERRUPTER WITH AN IMPROVED MAGNETICALLY-INDUCED AUTOMATIC TRIP ASSEMBLY

CROSS REFERENCE TO RELATED APPLICATIONS

The subject matter of this invention is related to concurrently filed, co-pending applications: U.S. patent application Ser. No. 09/384,780, filed Aug. 27, 1999, entitled "Insulator For A Lug Assembly Accessory Of A Circuit Interrupter"; U.S. patent application Ser. No. 09/384,450, filed Aug. 27, 1999, entitled "Circuit Interrupter With Improved Welded Contact Interlock"; U.S. patent application Ser. No. 09/385,643, filed Aug. 27, 1999, entitled "Circuit Interrupter With Space-Conserving Handle Mechanism"; U.S. Patent application Ser. No. 09/384,449, filed Aug. 27, 1999, entitled "Circuit Interrupter With Housing Support"; U.S. patent application Ser. No. 09/384,943, filed Aug. 27, 1999, entitled "Circuit Interrupter With Space-Conserving Base/Cover Attachment"; U.S. patent application Ser. No. 09/384,447, filed Aug. 27, 1999, entitled "Circuit Interrupter With Base/Cover Attachment Enabling Venting"; U.S. patent application Ser. No. 09/384,445, filed Aug. 27, 1999, entitled "Circuit Interrupter With Improved Push-To-Trip Actuator"; U.S. patent application Ser. No. 09/384,914, filed Aug. 27, 1999, entitled "Circuit Interrupter With An Improved Electrical Terminal For Attachment To A Connecting Device"; U.S. patent application Ser. No. 09/384,146, filed Aug. 27, 1999, entitled "Circuit Interrupter With An Improved Magnetically-Induced Automatic Trip Assembly"; U.S. patent application Ser. No. 09/384,654, filed Aug. 27, 1999, entitled "Circuit Interrupter With An Improved Magnetically-Induced Trip Mechanism"; U.S. patent application Ser. No. 09/384,140, filed Aug. 27, 1999, entitled "Circuit Interrupter With An Improved Magnetically-Induced Automatic Trip Assembly"; U.S. patent application Ser. No. 09/385,585, filed Aug. 27, 1999, entitled "Circuit Interrupter With An Operating Mechanism Having Improved Support"; U.S. patent application Ser. No. 09/384,330, filed Aug. 27, 1999, entitled "Circuit Interrupter Including An Insulation Barrier For A Connecting Device"; U.S. patent application Ser. No. 09/385,658, filed Aug. 27, 1999, entitled "Circuit Interrupter With Improved Handle Interconnection"; U.S. patent application Ser. No. 09/384,148, filed Aug. 27, 1999, entitled "Circuit Interrupter With Cradle Having An Improved Pivot Pin Connection"; U.S. patent application Ser. No. 09/384,915, filed Aug. 27, 1999, entitled "Circuit Interrupter With A Trip Mechanism Having An Improved Latch Connection"; U.S. patent application Ser. No. 09/384,958, filed Aug. 27, 1999, entitled "Circuit Interrupter With A Trip Mechanism Having A Biased Latch"; U.S. patent application Ser. No. 09/384,139, filed Aug. 27, 1999, entitled "Circuit Interrupter With A Trip Mechanism Having Improved Spring Biasing"; U.S. patent application Ser. No. 09/385,587, filed Aug. 27, 1999, entitled "Circuit Interrupter Providing Improved Securement Of An Electrical Terminal Within The Housing"; U.S. patent application Ser. No. 09/384,653, filed Aug. 27, 1999, entitled "Circuit Interrupter With A Magnetically-Induced Automatic Trip Assembly Having Improved Interconnection"; U.S. patent application Ser. No. 09/385,111, filed Aug. 27, 1999, entitled "Circuit Interrupter With An Automatic Trip Assembly Having An Improved BiMetal Configuration"; and U.S. patent application Ser. No. 09/384,138, filed Aug. 27, 1999, entitled "Circuit Interrupter With An Automatic Trip Assembly Configured For Reducing Blowoff Force".

BACKGROUND OF THE INVENTION

1. Field of the Invention

The present invention relates to circuit interrupters generally and, more specifically, to those kinds of circuit interrupter having a trip mechanism including an automatic trip assembly for generating a magnetically-induced tripping operation.

2. Description of the Prior Art

Molded case circuit breakers and interrupters are well known in the art as exemplified by U.S. Pat. No. 4,503,408 issued Mar. 5, 1985, to Mrenna et al., and U.S. Pat. No. 5,910,760 *issued Jun.* 8, 1999 to Malingowski et al., each of which is assigned to the assignee of the present application and incorporated herein by reference.

A continuing industry objective with respect to many types of circuit interrupters is to be able to reduce the size and/or footprint of the interrupter housing while at the same time providing the same or improved performance capabilities. A major advantage of creating such a "smaller package" is that it provides increased flexibility in installation. However, a consequence of this objective is that the internal space constraints of such interrupters have become much more limiting, posing certain design obstacles that need to be overcome.

Circuit interrupters advantageously provide for automatic circuit interruption (opening of the contacts) when an overcurrent condition is determined to exist. One way of determining whether or not an overcurrent condition exists is to provide a trip mechanism with an automatic trip assembly that reacts to a magnetic field generated by the overcurrent condition. In such circuit interrupters, the reaction to the magnetic field is often in the form of a movement of an armature that, in turn, sets in motion a tripping operation.

In order to enable such movement of the armature, the prior art provides complicated structures which, unfortunately, occupy a relatively significant amount of internal space within the interrupter. It would be advantageous if a less complicated, more direct way existed by which to provide for movement of the armature and that could be effectively employed within circuit interrupters having the aforementioned space constraints. It would also be advantageous if such a way would enable the armature to easily be installed during the assembly process of the interrupter.

SUMMARY OF THE INVENTION

The present invention provides a circuit interrupter that meets all of the above-identified needs.

In accordance with the present invention, a circuit interrupter is provided which includes a housing, separable main contacts disposed in the housing, and an operating mechanism disposed in the housing and interconnected with the contacts. Also provided is a trip mechanism disposed in the housing and including a rotatable trip bar assembly that, when selectively rotated, generates a tripping operation that causes the operating mechanism to open the contacts. The trip mechanism further includes an automatic trip assembly for selectively rotating the trip bar assembly upon a predetermined current threshold. The automatic trip assembly includes a magnetic yoke having two arms with a pivot support on the top of each. Each of the pivot supports includes a pivot surface, and one of the pivot supports includes a rear retaining protrusion adjacent its pivot surface. The other of the pivot supports includes a front retaining member adjacent its pivot surface. The automatic trip assembly further includes an armature having pivot portions positioned on the pivot surfaces which provides for rotation of the armature between a first position away from the arms and a second position closer to the arms. A magnetic field is generated upon the predetermined current threshold which causes the armature to rotate from the first position to the second position and to rotate the trip bar assembly and generate the tripping operation.

A circuit interrupter is also provided which includes a housing, separable main contacts disposed in the housing, and an operating mechanism disposed in the housing and interconnected with the contacts. Also provided is a trip mechanism disposed in the housing and including a rotatable trip bar assembly that, when selectively rotated, generates a tripping operation that causes the operating mechanism to open the contacts. The trip mechanism further includes an automatic trip assembly for selectively rotating the trip bar assembly upon a predetermined current threshold. The automatic trip assembly includes a magnetic yoke having two arms with a pivot support on the top of each. One of the pivot supports includes a downwardly facing stop. The automatic trip assembly further includes an armature having pivot portions positioned on the pivot supports which provides for rotation of the armature between a first position away from the arms and a second position closer to the arms. The downwardly facing stop is positioned to abut the armature when the armature is rotated away from the arms, thereby defining the first position. A magnetic field is generated upon the predetermined current threshold which causes the armature to rotate from the first position to the second position and to rotate the trip bar assembly and generate the tripping operation.

This and other objects and advantages of the present invention will become apparent from a reading of the following description of the preferred embodiment taken in connection with the attached drawings.

DESCRIPTION OF THE PREFERRED EMBODIMENT

Figure 1:
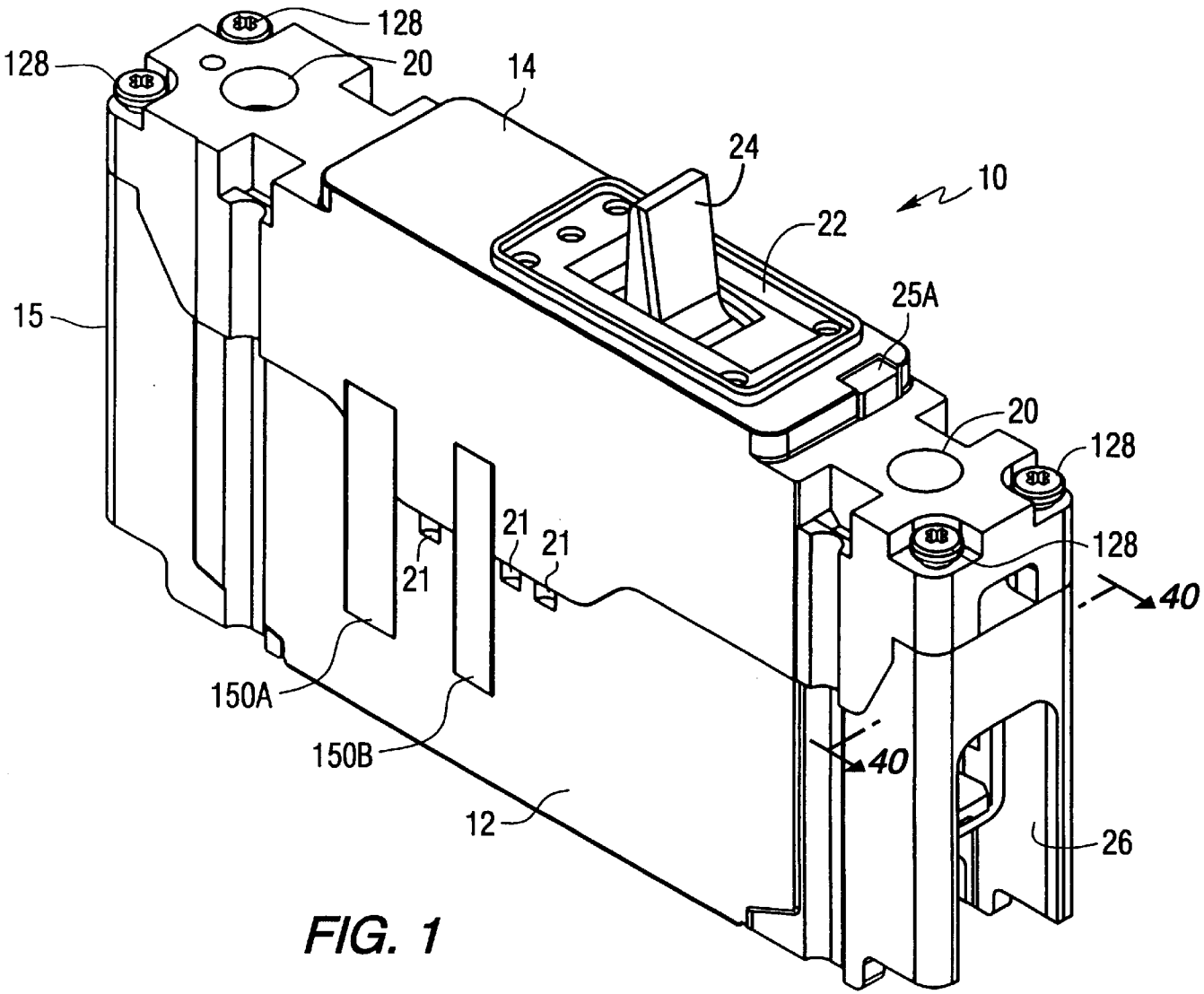
FIG. 1 is an orthogonal view of a molded case circuit breaker embodying the present invention.
Figure 2:
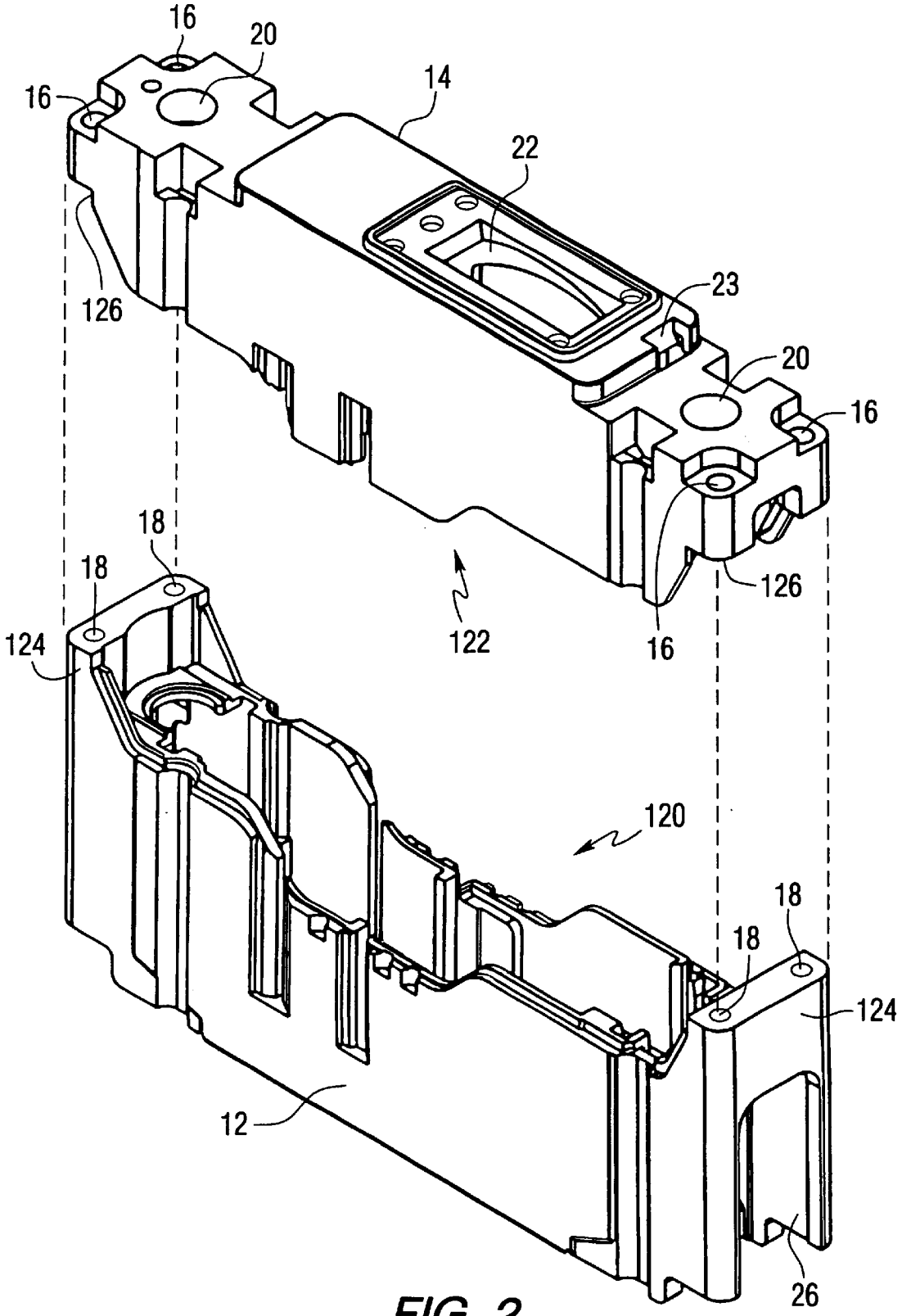
FIG. 2 is an exploded view of the base and cover of the circuit interrupter of FIG. 1.

Referring now to the drawings and FIGS. 1 and 2 in particular, shown is a molded case circuit breaker 10. Circuit breaker 10 includes a base 12 mechanically interconnected with a cover 14 to form a circuit breaker housing 15. Holes or openings 16 (FIG. 2) are provided in cover 14 for accepting screws or other attaching devices 128 that enter corresponding holes or openings 18 in base 12 for fastening cover 14 to base 12. Holes 20, which feed through cover 14, are provided for internal access to circuit breaker 10, as described in greater detail below. At the interface between base 12 and cover 14 are small openings 21 for venting purposes, as described in greater detail below. Cover 14 includes a handle opening 22 through which protrudes a handle 24 (FIG. 1) that is used in a conventional manner to manually open and close the contacts of circuit breaker 10 and to reset circuit breaker 10 when it is in a tripped state. Handle 24 may also provide an indication of the status of circuit breaker 10 whereby the position of handle 24 corresponds with a legend (not shown) on cover 14 near handle opening 22 which clearly indicates whether circuit breaker 10 is ON (contacts closed), OFF (contacts open), or TRIPPED (contacts open due to, for example, an overcurrent condition). Cover 14 also includes a rectangular opening 23 (FIG. 2) through which protrudes a top portion 25A of a button for a push-to-trip actuator, the details of which are described below. Also shown is a load conductor opening 26 in base 12 that shields and protects a load terminal (not shown). Although circuit breaker 10 is depicted as a single-phase circuit breaker, the present invention is not limited to single-phase operation.

Figure 3:
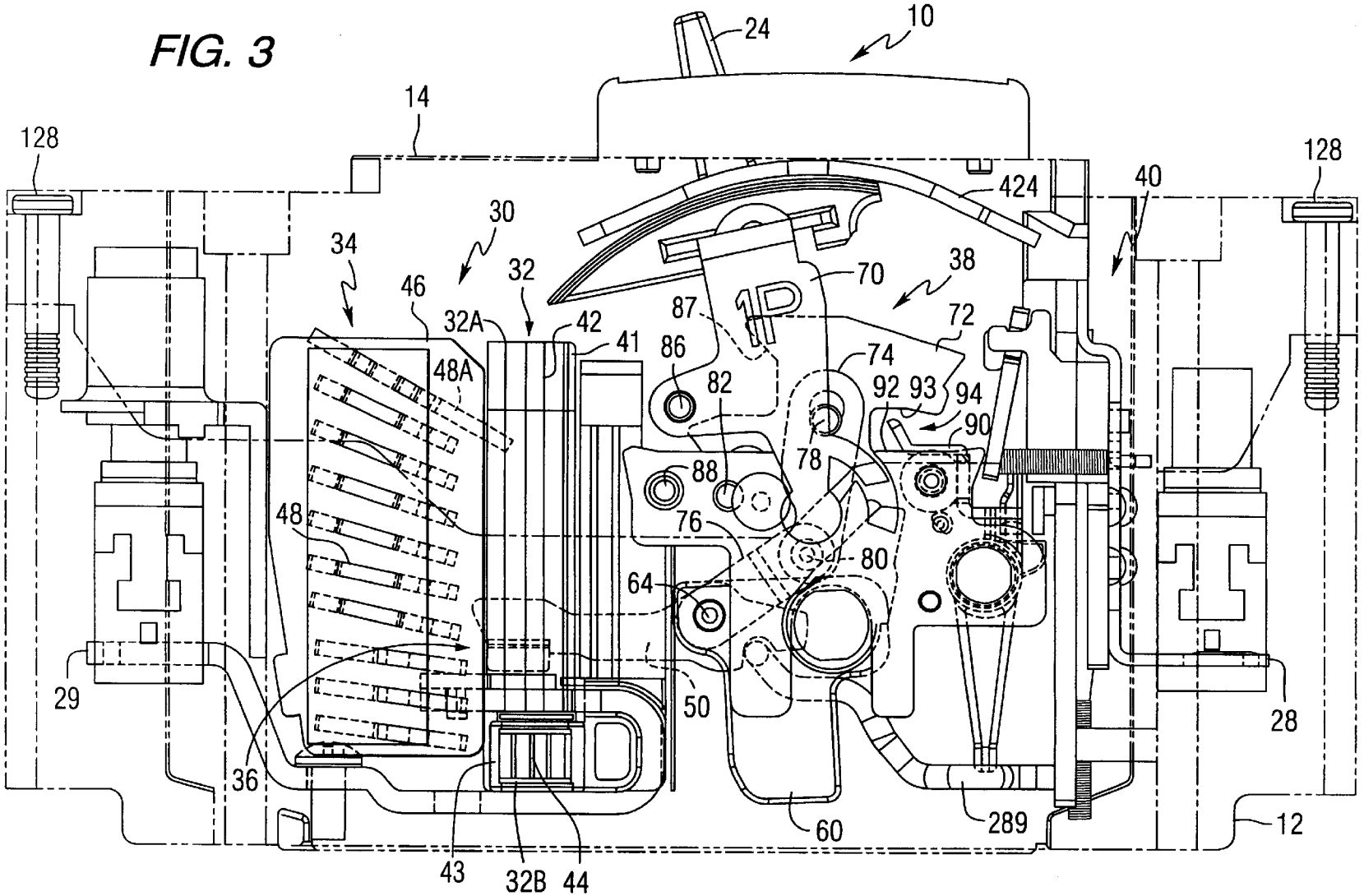
FIG. 3 is side elevational view of an internal portion of the circuit interrupter of FIG. 1.

Referring now to FIG. 3, a longitudinal section of a side elevation, partially broken away and partially in phantom, of circuit breaker 10 is shown having a load terminal 28 and a line terminal 29. There is shown a plasma arc acceleration chamber 30 comprising a slot motor assembly 32 and an arc extinguisher assembly 34. Also shown is a contact assembly 36, an operating mechanism 38, and a trip mechanism 40.

Figure 4:
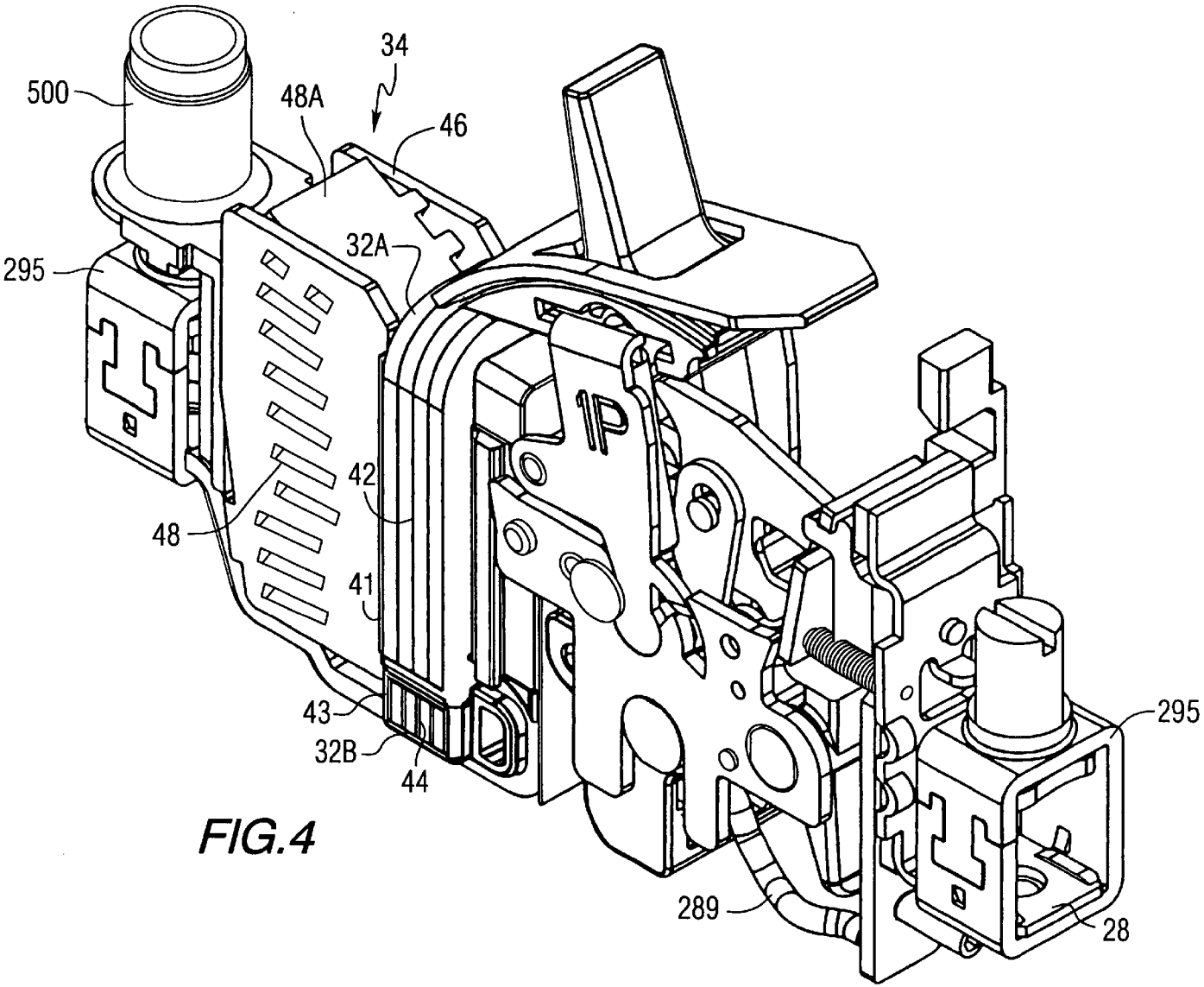
FIG. 4 is an orthogonal view of the internal portions of the circuit interrupter of FIG. 1 without the base and cover.

Referring again to FIG. 3, and now also to FIG. 4 which shows a side elevational view of the internal workings of circuit breaker 10 without base 12 and cover 14, slot motor assembly 32 is shown as including a separate upper slot motor assembly 32A and a separate lower slot motor assembly 32B. Upper slot motor assembly 32A includes an upper slot motor assembly housing 41 within which are stacked side-by-side U-shaped upper slot motor assembly plates 42. Similarly, lower slot motor assembly 32B includes a lower slot motor assembly housing 43 within which are stacked side-by-side lower slot motor assembly plates 44. Plates 42 and 44 are both composed of magnetic material.

Arc extinguisher assembly 34 includes an arc chute 46 within which are positioned spaced-apart generally parallel angularly offset arc chute plates 48 and an upper arc runner 48A. As known to one of ordinary skill in the art, the function of arc extinguisher assembly 34 is to receive and dissipate electrical arcs that are created upon separation of the contacts of the circuit breaker.

Figure 5:
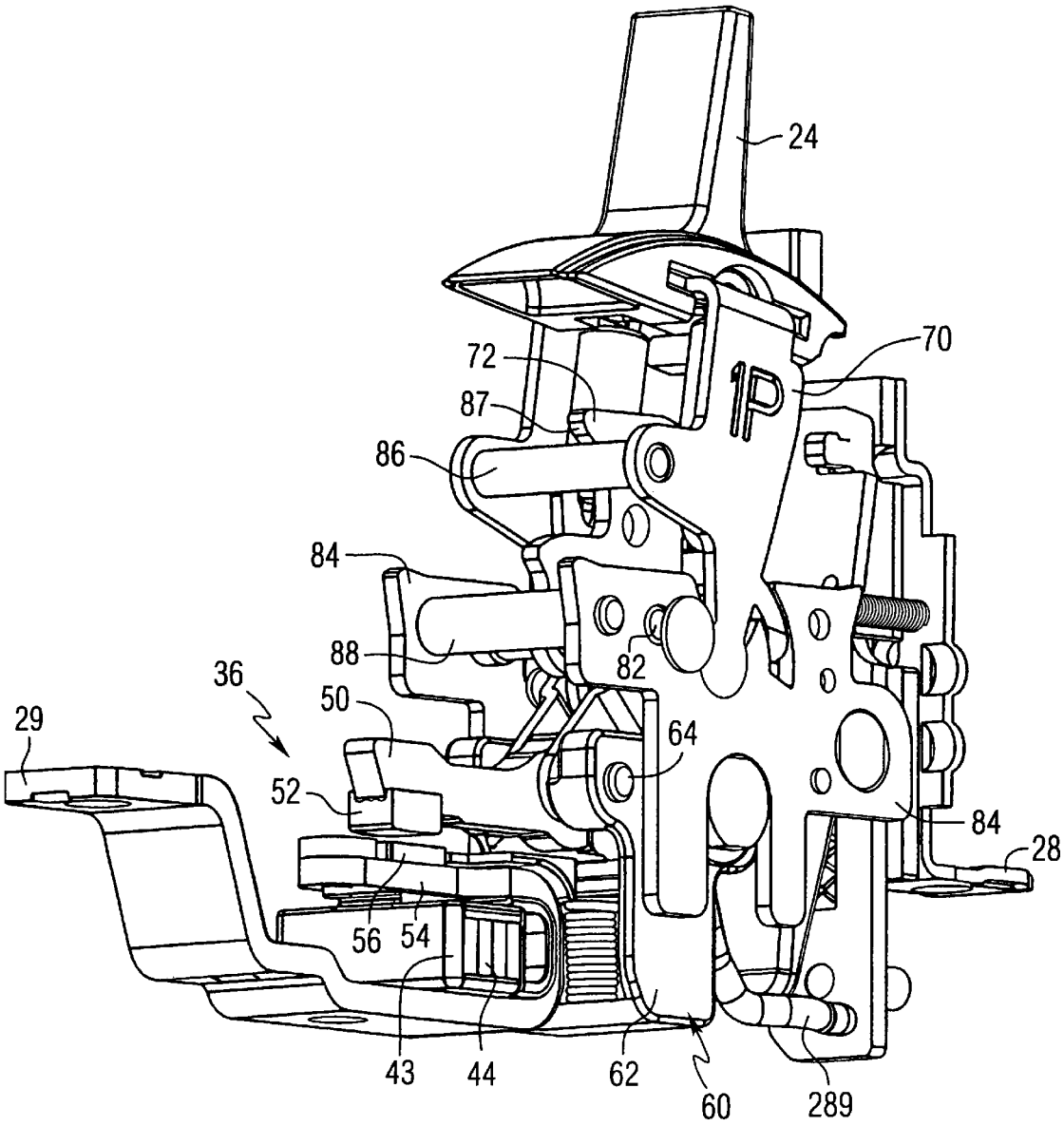
FIG. 5 is an orthogonal view of an internal portion of the circuit interrupter of FIG. 1 including the operating mechanism.

Referring now to FIG. 5, shown is an orthogonal view of an internal portion of circuit breaker 10. There is shown contact assembly 36 comprising a movable contact arm 50 supporting thereon a movable contact 52, and a stationary contact arm 54 supporting thereon a stationary contact 56. Stationary contact arm 54 is electrically connected to line terminal 29 and, as discussed below, movable contact arm 50 is electrically connected to load terminal 28. Also shown is a crossbar assembly 60 which traverses the width of circuit breaker 10 and is rotatably disposed on an internal portion of base 12 (not shown). Actuation of operating mechanism 38, in a manner described in detail below, causes crossbar assembly 60 and movable contact arm 50 to rotate into or out of a disposition which places movable contact 52 into or out of a disposition of electrical continuity with fixed contact 56. Crossbar assembly 60 includes a movable contact cam housing 62 in which is disposed a pivot pin 64 upon which movable contact arm 50 is rotatably disposed. Under normal circumstances, movable contact arm 50 rotates in unison with the rotation of housing 62 as housing 62 is rotated clockwise or counterclockwise by action of operating mechanism 38. However, it is to be noted that movable contact arm 50 is free to rotate (within limits) independently of the rotation of crossbar assembly 60. In particular, in certain dynamic, electromagnetic situations, movable contact arm 50 can rotate upwardly about pivot pin 64 under the influence of high magnetic forces. This is referred to as "blow-open" operation, and is described in greater detail below.

Continuing to refer to FIG. 5 and again to FIG. 3, operating mechanism 38 is shown. Operating mechanism 38 is structurally and functionally similar to that shown and described in U.S. Pat. No. 4,503,408 issued Mar. 5, 1985 to Mrenna et al, and U.S. Pat. No. 5,910,760 issued Jun. 8, 1999, both disclosures of which are incorporated herein by reference. Operating mechanism 38 comprises a handle arm or handle assembly 70 (connected to handle 24), a configured plate or cradle 72, an upper toggle link 74, an interlinked lower toggle link 76, and an upper toggle link pivot pin 78 which interlinks upper toggle link 74 with cradle 72.

Lower toggle link 76 is pivotally interconnected with upper toggle link 74 by way of an intermediate toggle link pivot pin 80, and with crossbar assembly 60 at pivot pin 64. Provided is a cradle pivot pin 82 which is laterally and rotatably disposed between parallel, spaced apart operating mechanism support members or sideplates 84. Cradle 72 is free to rotate (within limits) via cradle pivot pin 82. Also provided is a handle assembly roller 86 which is disposed in and supported by handle assembly 70 in such a manner as to make mechanical contact with (roll against) arcuate portions of a back region 87 of cradle 72 during a "resetting" operation of circuit breaker 10 as is described below. A main stop bar 88 is laterally disposed between sideplates 84, and provides a limit to the counter-clockwise movement of cradle 72.

Figure 6:
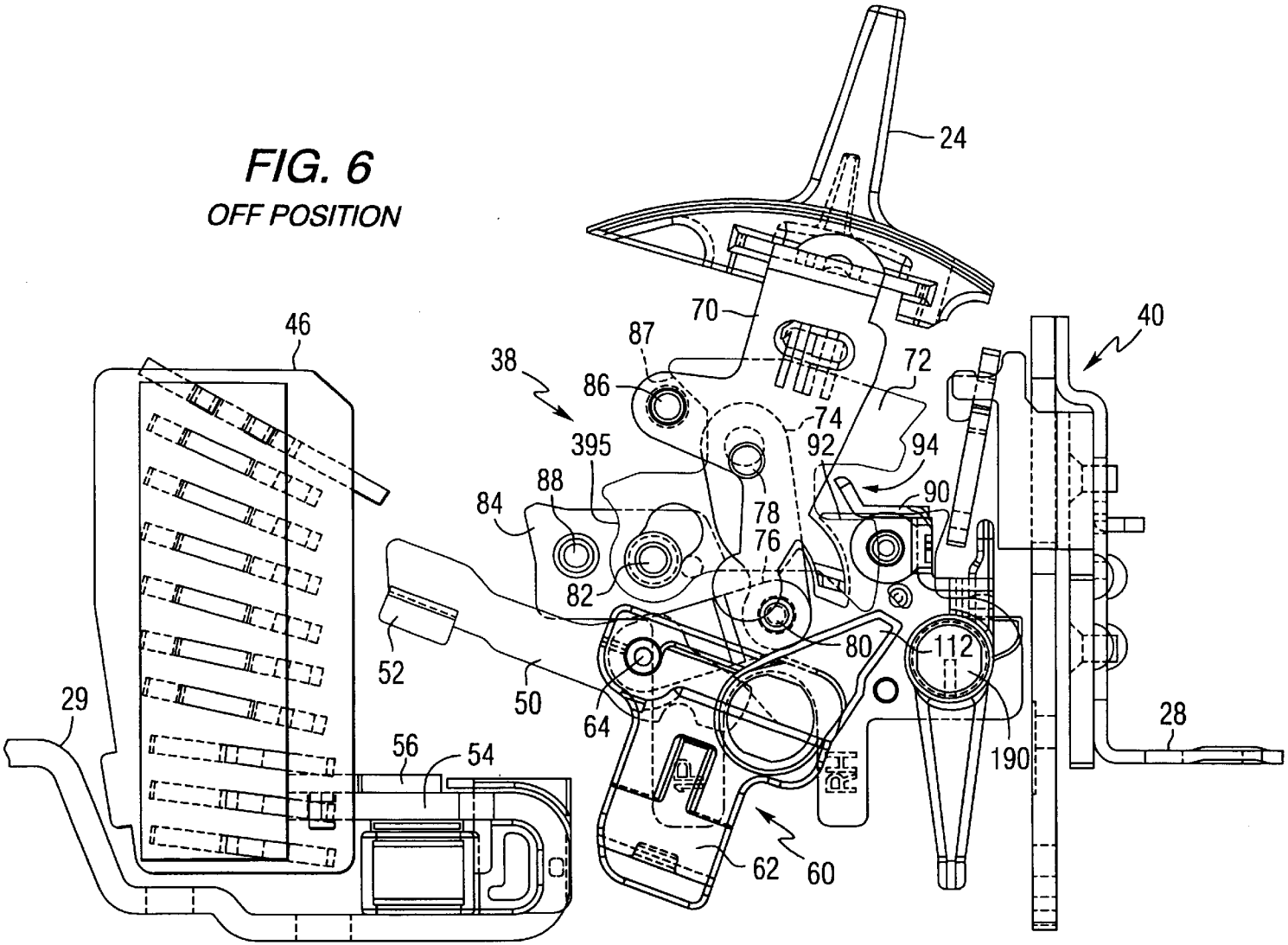
FIG. 6 is a side elevational, partially broken away view of the operating mechanism of the circuit interrupter of FIG. 1 with the contacts and the handle in the OFF disposition.

Referring now to FIG. 6, an elevation of that part of circuit breaker 10 particular associated with operating mechanism 38 is shown for the OFF disposition of circuit breaker 10. Contacts 52 and 56 are shown in the disconnected or open disposition. An intermediate latch 90 is shown in its latched position wherein it abuts hard against a lower portion 92 of a latch cutout region 94 of cradle 72. A pair of side-by-side aligned compression springs (not shown) such as shown in U.S. Pat. No. 4,503,408 is disposed between the top portion of handle assembly 70 and the intermediate toggle link pivot pin 80. The tension in these springs has a tendency to load lower portion 92 of cradle 72 against the intermediate latch 90. In the OPEN disposition shown in FIG. 6, latch 90 is prevented from unlatching cradle 72, notwithstanding the spring tension, because the other end thereof is fixed in place by a rotatable trip bar assembly 190 of trip mechanism 40. As is described in more detail below, trip bar assembly 190 is spring-biased in the counter-clockwise rotational direction against the intermediate latch 90. This is the standard latch arrangement found in all dispositions of circuit breaker 10 except the TRIPPED disposition which is described below.

Figure 7:
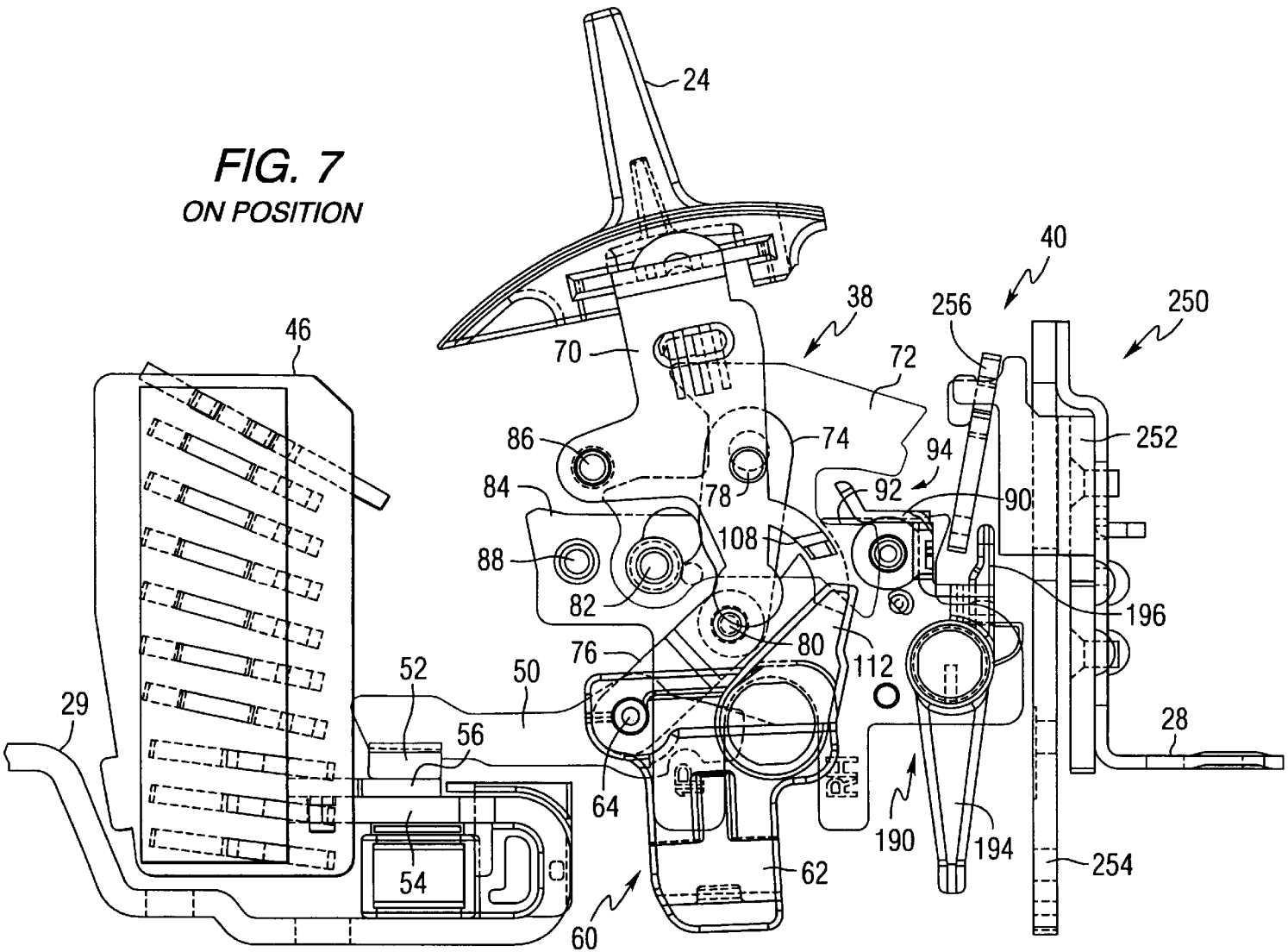
FIG. 7 is a side elevational, partially broken away view of the operating mechanism with the contacts and the handle in the ON disposition.

Referring now to FIG. 7, operating mechanism 38 is shown for the ON disposition of circuit breaker 10. In this disposition, contacts 52 and 56 are closed (in contact with each other) whereby electrical current may flow from load terminal 28 to line terminal 29. In order to achieve the ON disposition, handle 24, and thus fixedly attached handle assembly 70, are rotated in a counter-clockwise direction (to the left) thus causing the intermediate toggle link pivot pin 80 to be influenced by the tension springs (not shown) attached thereto and to the top of handle assembly 70. The influence of the tension springs causes upper toggle link 74 and lower toggle link 76 to assume the position shown in FIG. 7 which causes the pivotal interconnection with crossbar assembly 60 at pivot point 64 to rotate crossbar assembly 60 in the counter-clockwise direction. This rotation of crossbar assembly 60 causes movable contact arm 50 to rotate in the counter-clockwise direction and ultimately force movable contact 52 into a pressurized abutted disposition with stationary contact 56. It is to be noted that cradle 72 remains latched by intermediate latch 90 as influenced by trip mechanism 40.

Figure 8:
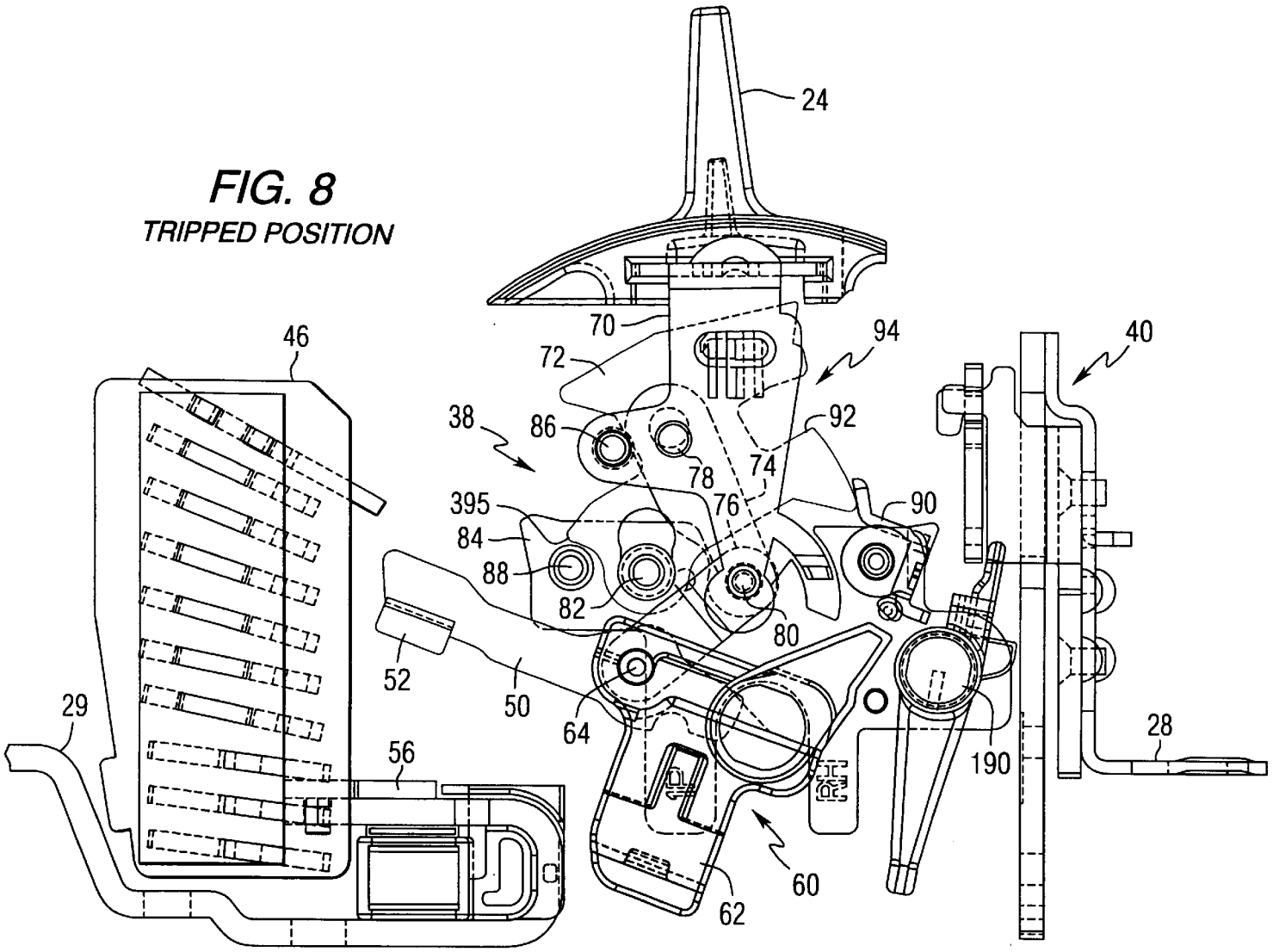
FIG. 8 is a side elevational, partially broken away view of the operating mechanism with the contacts and the handle in the TRIPPED disposition.

Referring now to FIG. 8, operating mechanism 38 is shown for the TRIPPED disposition of circuit breaker 10. The TRIPPED disposition is related (except when a manual tripping operation is performed, as described below) to an automatic opening of circuit breaker 10 caused by the thermally or magnetically induced reaction of trip mechanism 40 to the magnitude of the current flowing between load conductor 28 and line conductor 29. The operation of trip mechanism 40 is described in detail below. For purposes here, circumstances such as a load current with a magnitude exceeding a predetermined threshold will cause trip mechanism 40 to rotate trip bar assembly 190 clockwise (overcoming the spring force biasing assembly 190 in the opposite direction) and away from intermediate latch 90. This unlocking of latch 90 releases cradle 72 (which had been held in place at lower portion 92 of latch cutout region 94) and enables it to be rotated counter-clockwise under the influence of the tension springs (not shown) interacting between the top of handle assembly 70 and the intermediate toggle link pivot pin 80. The resulting collapse of the toggle arrangement causes pivot pin 64 to be rotated clockwise and upwardly to thus cause crossbar assembly 60 to similarly rotate. This rotation of crossbar assembly 60 causes a clockwise motion of movable contact arm 50, resulting in a separation of contacts 52 and 56. The above sequence of events results in handle 24 being placed into an intermediate disposition between its OFF disposition (as shown in FIG. 6) and its ON disposition (as shown in FIG. 7). Once in this TRIPPED disposition, circuit breaker 10 can not again achieve the ON disposition (contacts 52 and 56 closed) until it is first "reset" via a resetting operation which is described in detail below.

Figure 9:
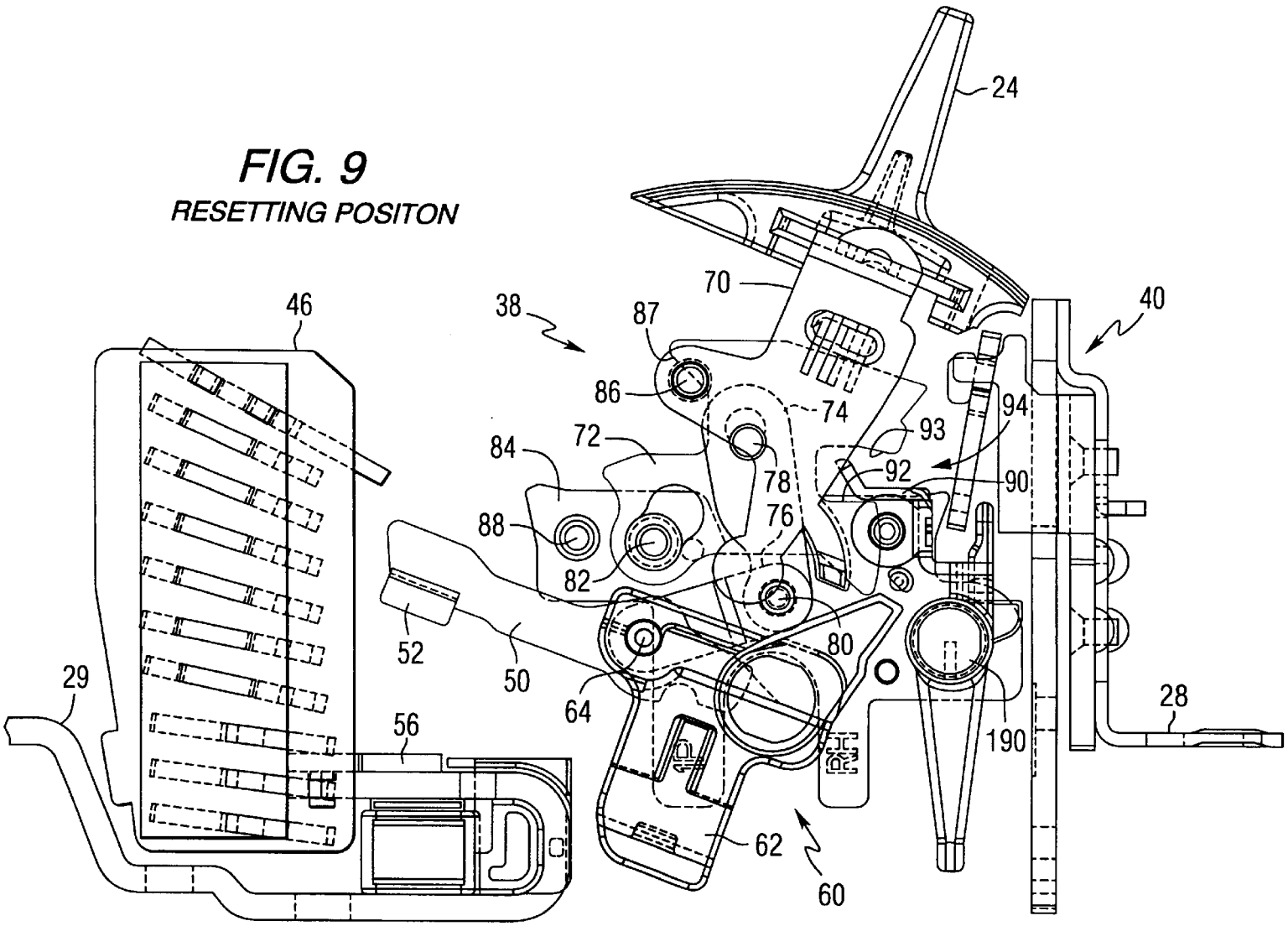
FIG. 9 is a side elevational, partially broken away view of the operating mechanism during a resetting operation.

Referring now to FIG. 9, operating mechanism 38 is shown during the resetting operation of circuit breaker 10. This occurs while contacts 52 and 56 remain open, and is exemplified by a forceful movement of handle 24 to the right (or in a clockwise direction) after a tripping operation has occurred as described above with respect to FIG. 8. As handle 24 is thus moved, handle assembly 70 moves correspondingly, causing handle assembly roller 86 to make contact with back region 87 of cradle 72. This contact forces cradle 72 to rotate clockwise about cradle pivot pin 82 and against the tension of the springs (not shown) that are located between the top of handle assembly 70 and the intermediate toggle link pivot pin 80, until an upper portion 93 of latch cutout region 94 abuts against the upper arm or end of intermediate latch 90. This abutment forces intermediate latch 90 to rotate to the left (or in a counter-clockwise direction) so that the bottom portion thereof rotates to a disposition of interlatching with trip bar assembly 190, in a manner described in more detail below. Then, when the force against handle 24 is released, handle 24 rotates to the left over a small angular increment, causing lower portion 92 of latch cutout region 94 to forcefully abut against intermediate latch 90 which is now abutted at its lower end against trip bar assembly 190. Circuit breaker 10 is then in the OFF disposition shown in FIG. 6, and handle 24 may then be moved counter-clockwise (to the left) towards the ON disposition depicted in FIG. 7 (without the latching arrangement being disturbed) until contacts 52 and 56 are in a disposition of forceful electrical contact with each other. However, if an overcurrent condition still exists, a tripping operation such as depicted and described above with respect to FIG. 8 may again take place causing contacts 52 and 56 to again open.

Referring again to FIGS. 3, 4, and 5, upper slot motor assembly 32A and lower slot motor assembly 32B are structurally and functionally similar to that described in U.S. Pat. No. 5,910,760 and plates 42 and 44 thereof form an essentially closed electromagnetic path in the viscinity of contacts 52 and 56. At the beginning of a contact opening operation, electrical current continues to flow in movable contact arm 50 and through an electrical arc created between contacts 52 and 56. This current induces a magnetic field into the closed magnetic loop provided by upper plates 42 and lower plates 44 of upper slot motor assembly 32A and lower slot motor assembly 32B, respectively. This magnetic field electromagnetically interacts with the current in such a manner as to accelerate the movement of movable contact arm 50 in the opening direction whereby contacts 52 and 56 are more rapidly separated. The higher the magnitude of the electrical current flowing in the arc, the stronger the magnetic interaction and the more quickly contacts 52 and 56 separate. For very high current (an overcurrent condition), the above process provides the blow-open operation described above in which movable contact arm 50 forcefully rotates upwardly about pivot pin 64 and separates contacts 52 and 56, this rotation being independent of crossbar assembly 60. This blow-open operation is shown and described in U.S. Pat. No. 3,815,059 issued Jun. 4, 1974, to Spoelman and incorporated herein by reference, and provides a faster separation of contacts 52 and 56 than can normally occur as the result of a tripping operation generated by trip mechanism 40 as described above in connection with FIG. 8.

In connection with the above-described blow-open operation, crossbar assembly 60 and, in particular, cam housing 62 are structurally and functionally similar to that described in U.S. Pat. No. 5,910,760. In particular, cam housing 62 includes a spring-loaded cam follower (not shown) which, when a blow-open operation has occurred, latches movable contact arm 50 in its blown-open disposition.

Figure 10A:
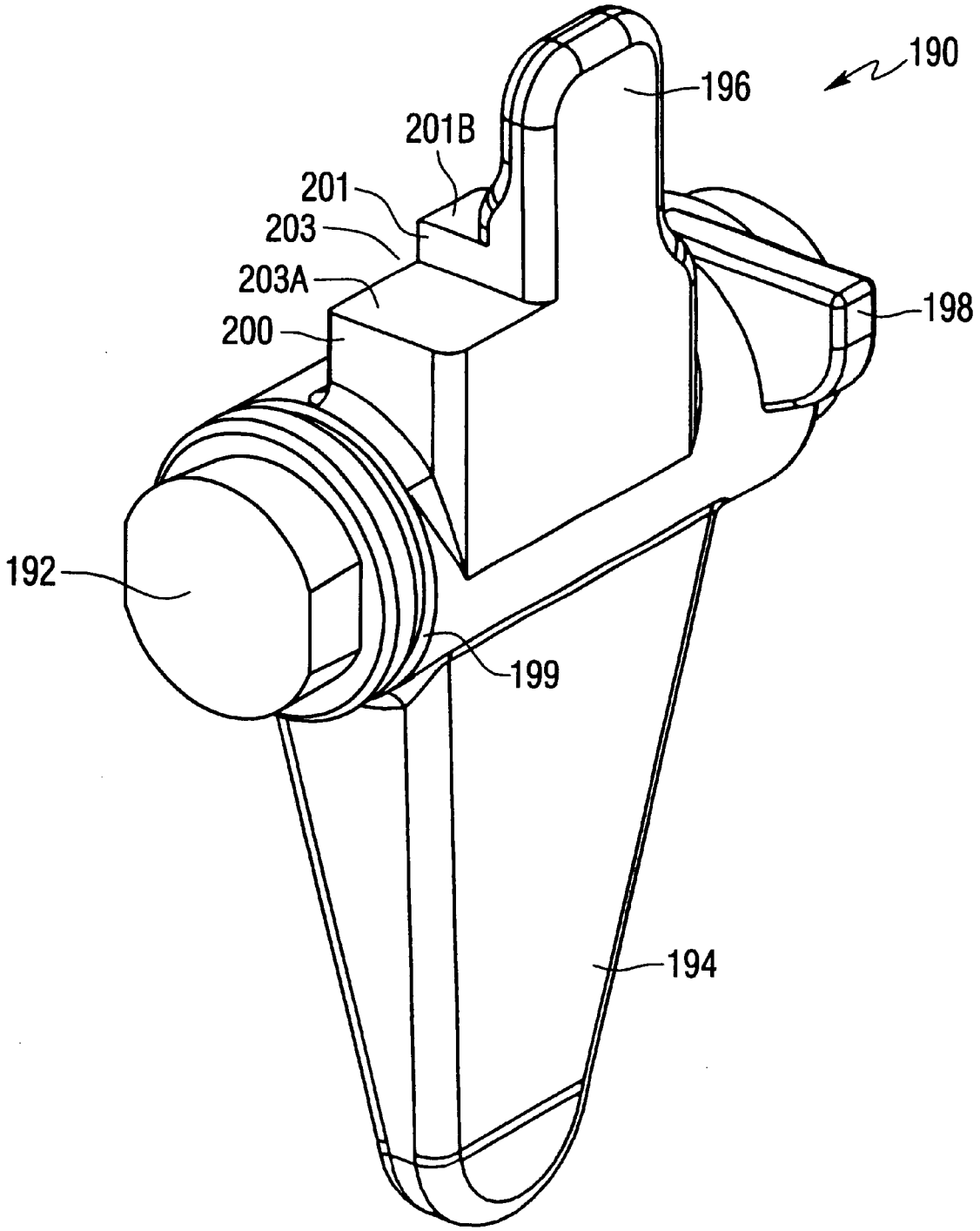
FIG. 10A is an orthogonal view of the trip bar assembly of the trip mechanism of the circuit interrupter of FIG. 1.
Figure 10B:
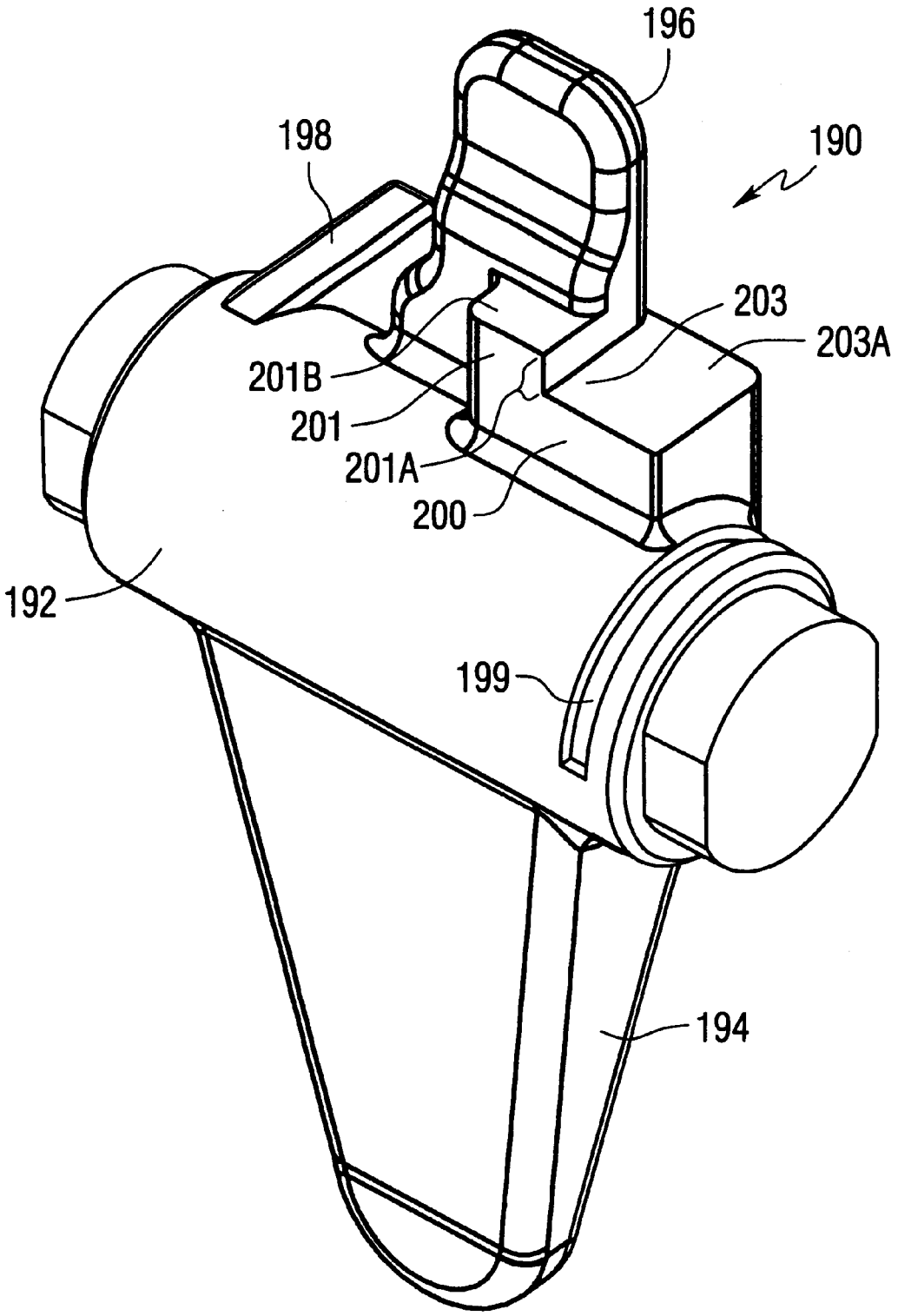
FIG. 10B is another orthogonal view of the trip bar assembly of FIG. 10A.
Figure 10C:
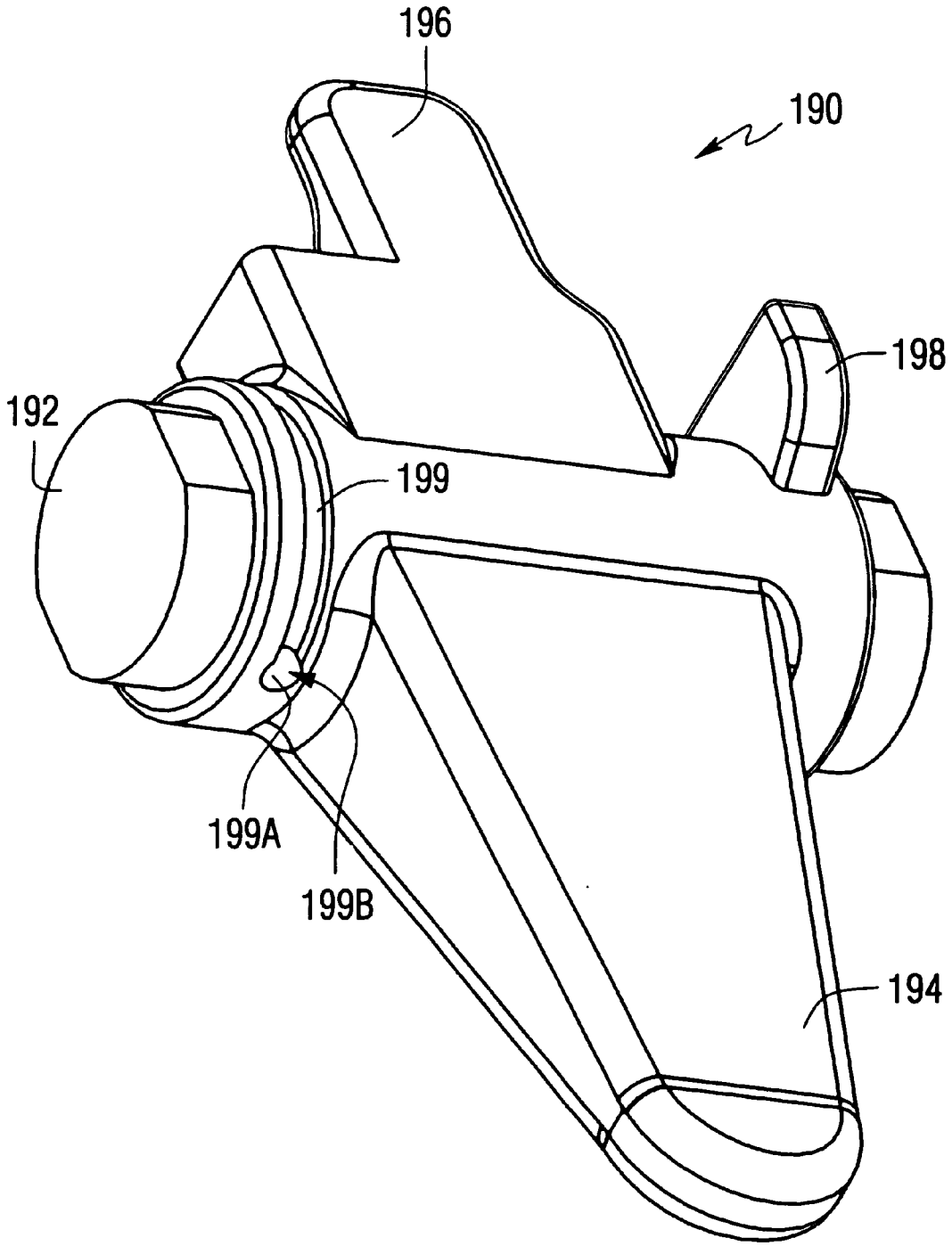
FIG. 10C is another orthogonal view of the trip bar assembly of FIG. 10A showing the groove therein.
Figure 10D:
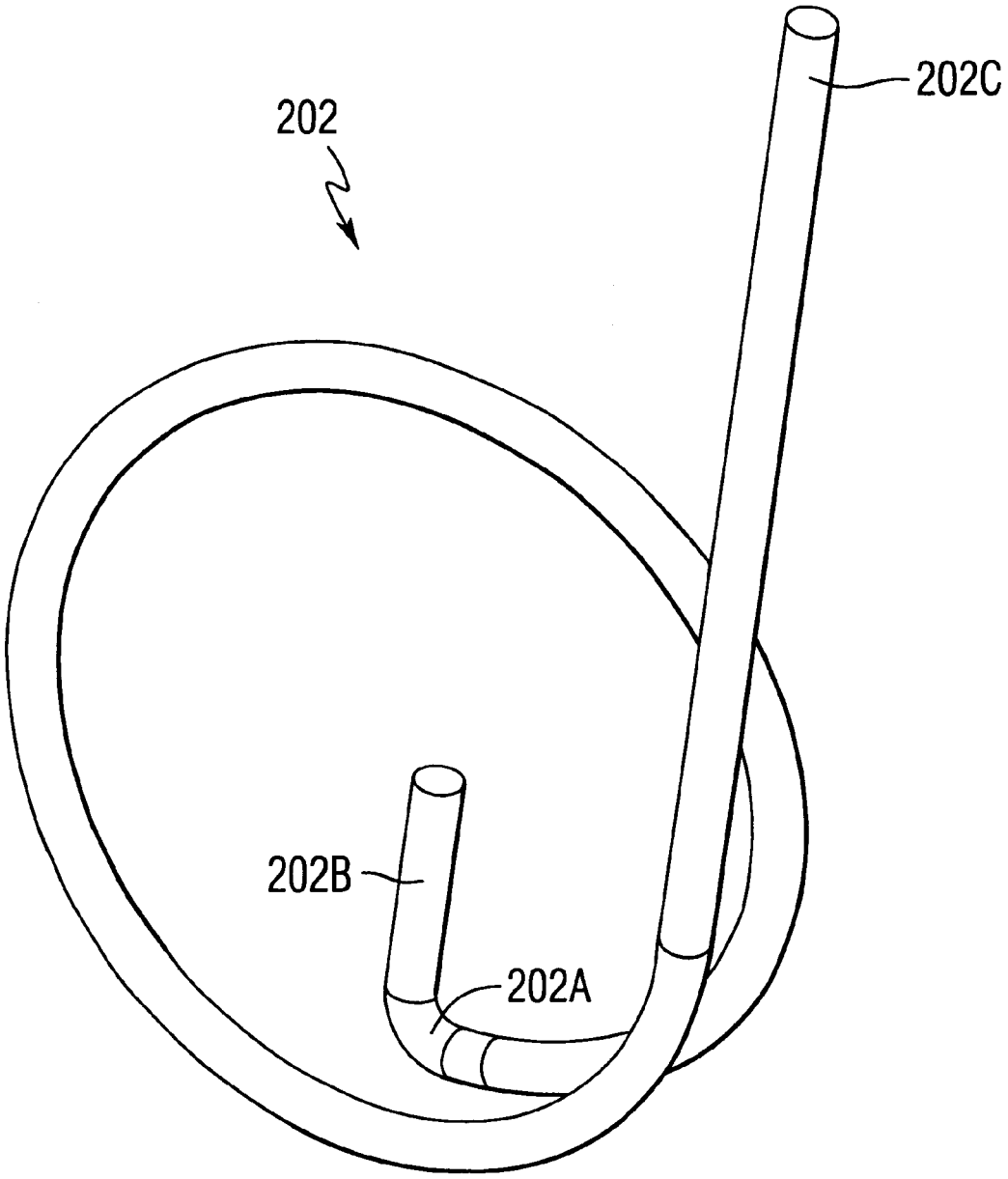
FIG. 10D is an orthogonal view of the torsion spring of the trip bar assembly shown in FIG. 10A.
Figure 10E:
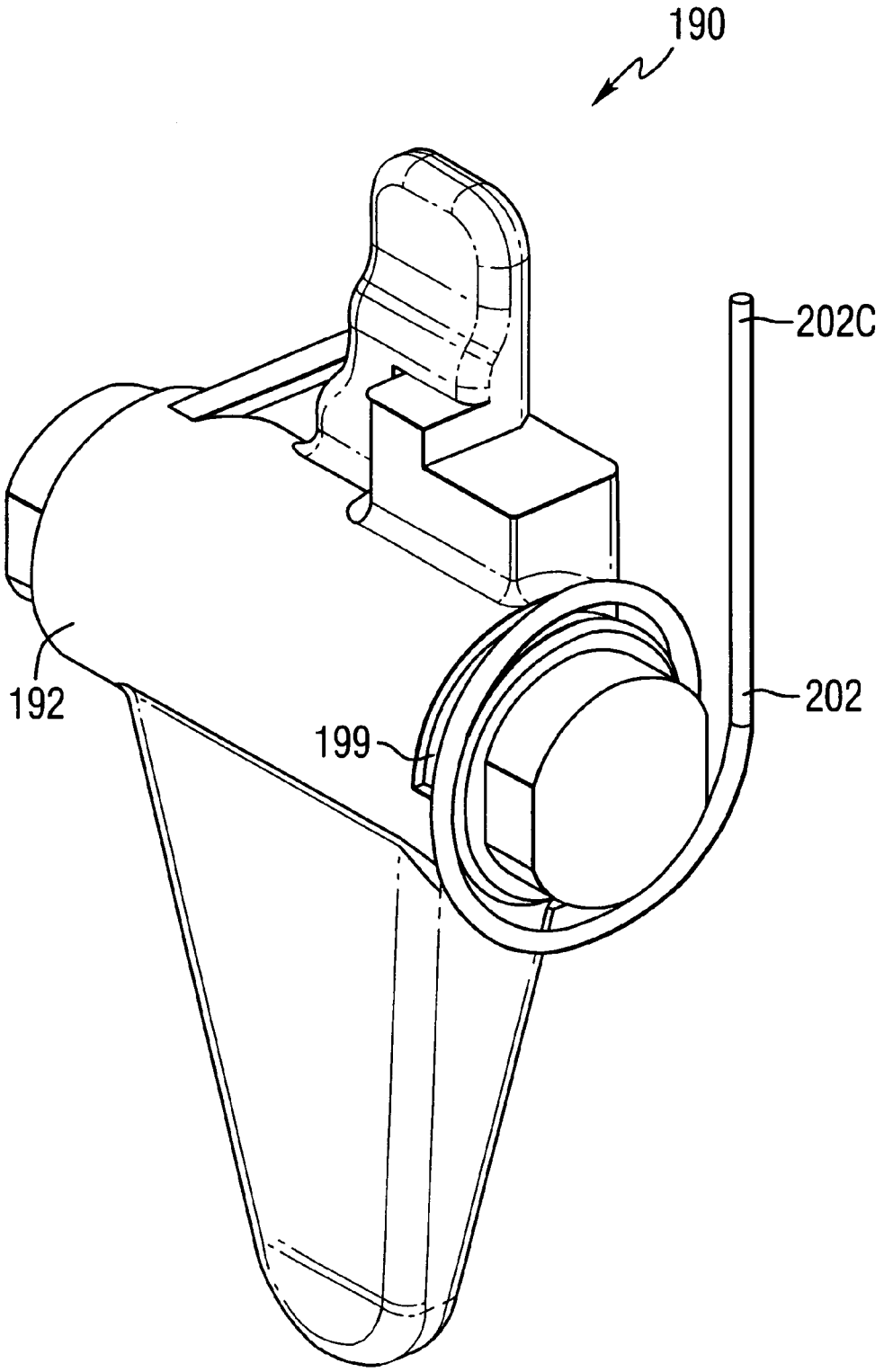
FIG. 10E is an orthogonal view the trip bar assembly of FIG. 10A with the spring of FIG. 10D attached.
Figure 10F:
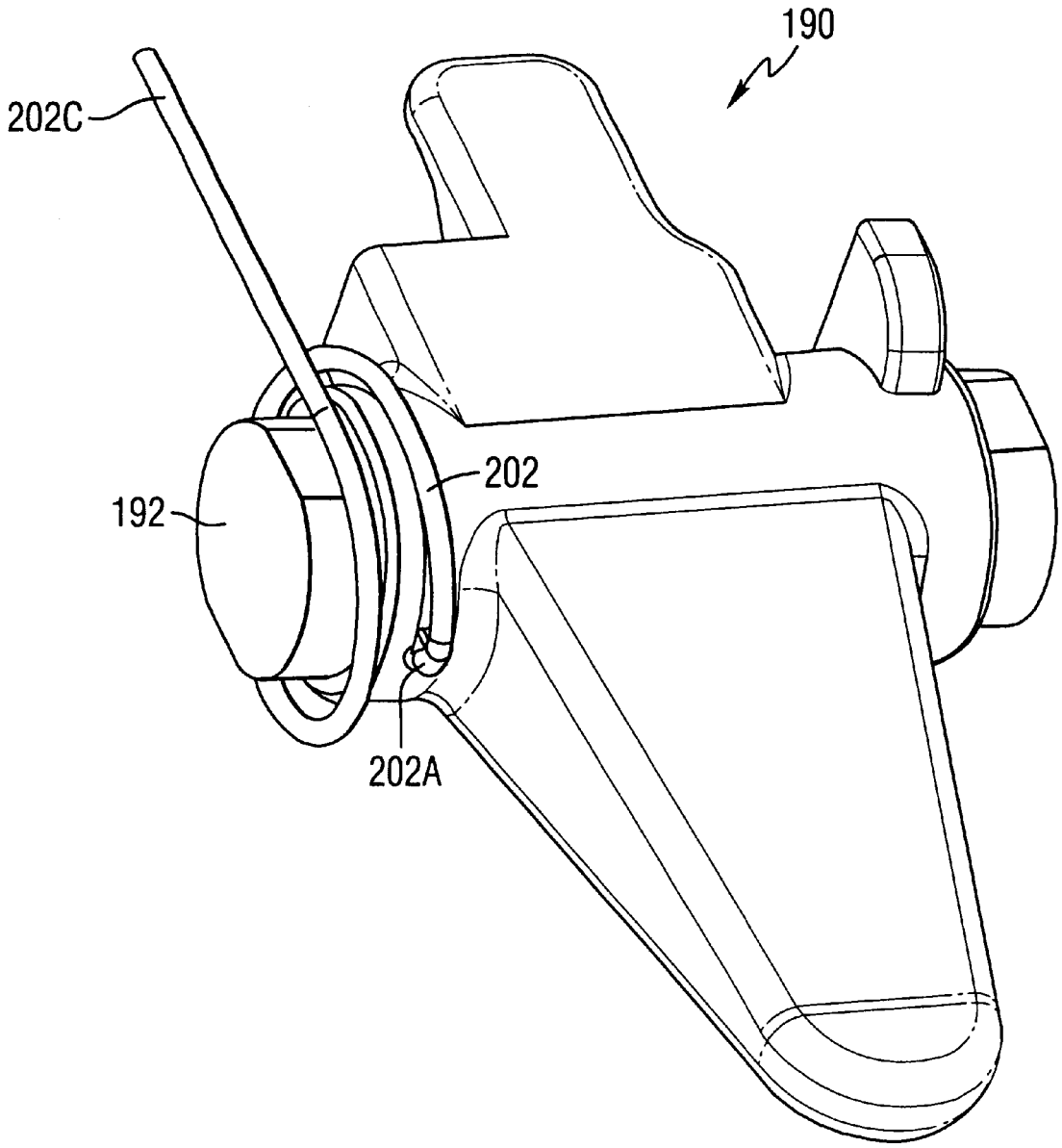
FIG. 10F is another orthogonal view of the trip bar assembly and spring of FIG. 10E.

Referring now to FIGS. 10A, 10B, 10C, 10D, 10E, and 10F, shown is integrally molded trip bar assembly 190 of trip mechanism 40. Assembly 190 includes a trip shaft 192 to which is connected a thermal trip bar or paddle 194, a magnetic trip bar or paddle 196, and a manual trip bar 198, the function of each of which is described in detail below. Assembly 190 also includes an intermediate latch interface 200 having a protrusion or stepped-up region 201 and a cutout region or stepped-down region 203 with a surface 203A. Near one end of trip shaft 192 is a channel or groove 199 that partially extends around the circumference thereof. As shown in FIG. 10C, groove 199 has an end 199A on the underside of trip shaft 192 that defines a cavity extending into shaft 192. Assembly 190 also includes a torsion spring 202, as shown in FIG. 10D, having an elbow 202A defining an end 202B, and an end 202C. As shown in FIGS. 10E and 10F, spring 202 is wound around the end of trip shaft 192, and is partially seated within groove 199. Elbow 202A of spring 202 is shown positioned at end 199A of groove 199, with end 202B of spring 202 inserted into the cavity. Groove 199 serves to properly position spring 202 and prevent dislodgment thereof from shaft 192. In a preferred embodiment wherein spring 202 is approximately 0.018 inches in diameter, groove 199 is approximately 0.030 inches in width and approximately 0.015 inches deep.

Figure 11:
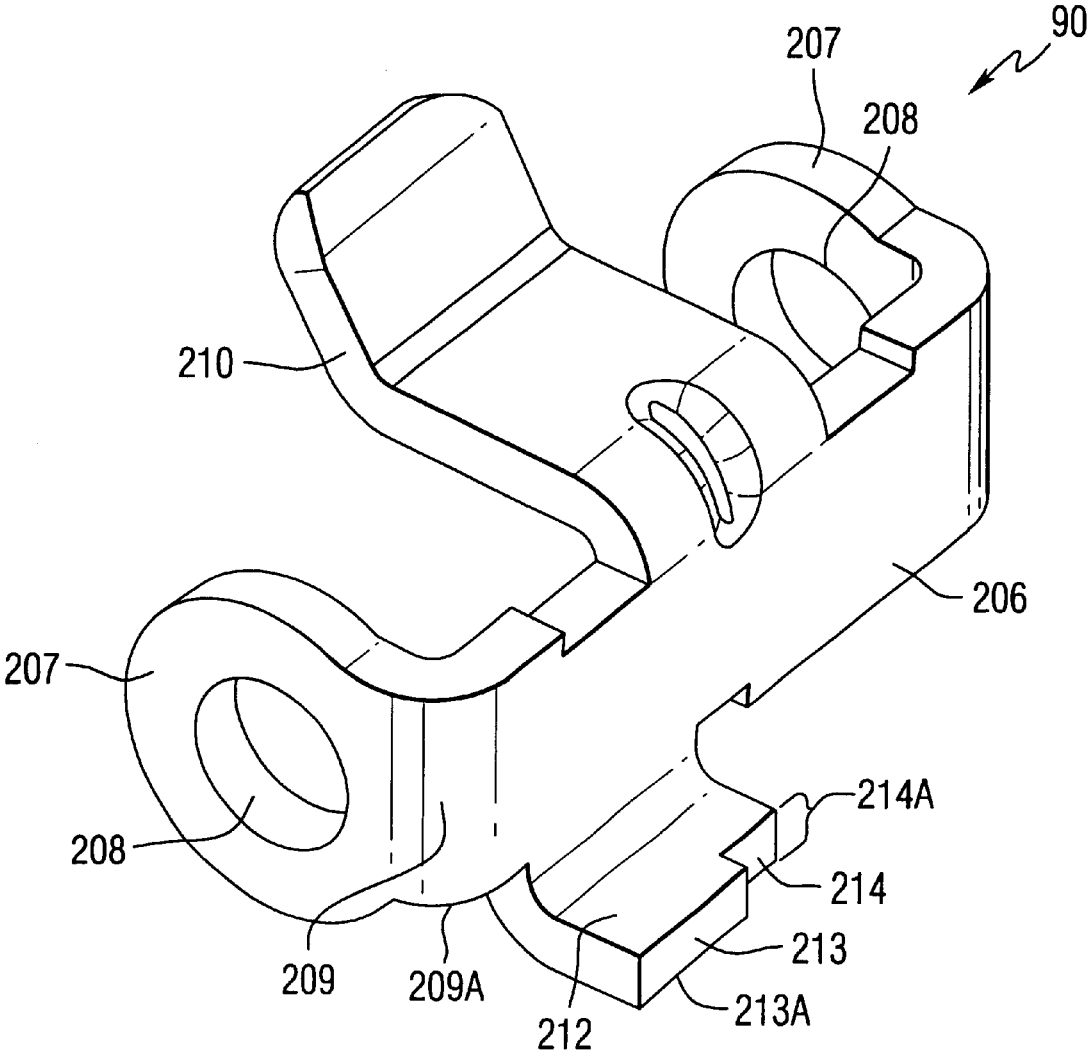
FIG. 11 is an orthogonal view of a latch used in connection with the trip mechanism of the circuit interrupter of FIG. 1.

Referring now to FIG. 11, shown is intermediate latch 90. Latch 90 includes a main member 206 having ends 207 which are bent towards each other and in which are formed holes or openings 208. Extending from main member 206 is an upper latch portion 210 and a lower latch portion 212, the latch portions being linearly offset from each other in the exemplary embodiment. Lower latch portion 212 includes a protruding region 213 with a bottom surface 213A, and a cutout region 214.

Figure 12:
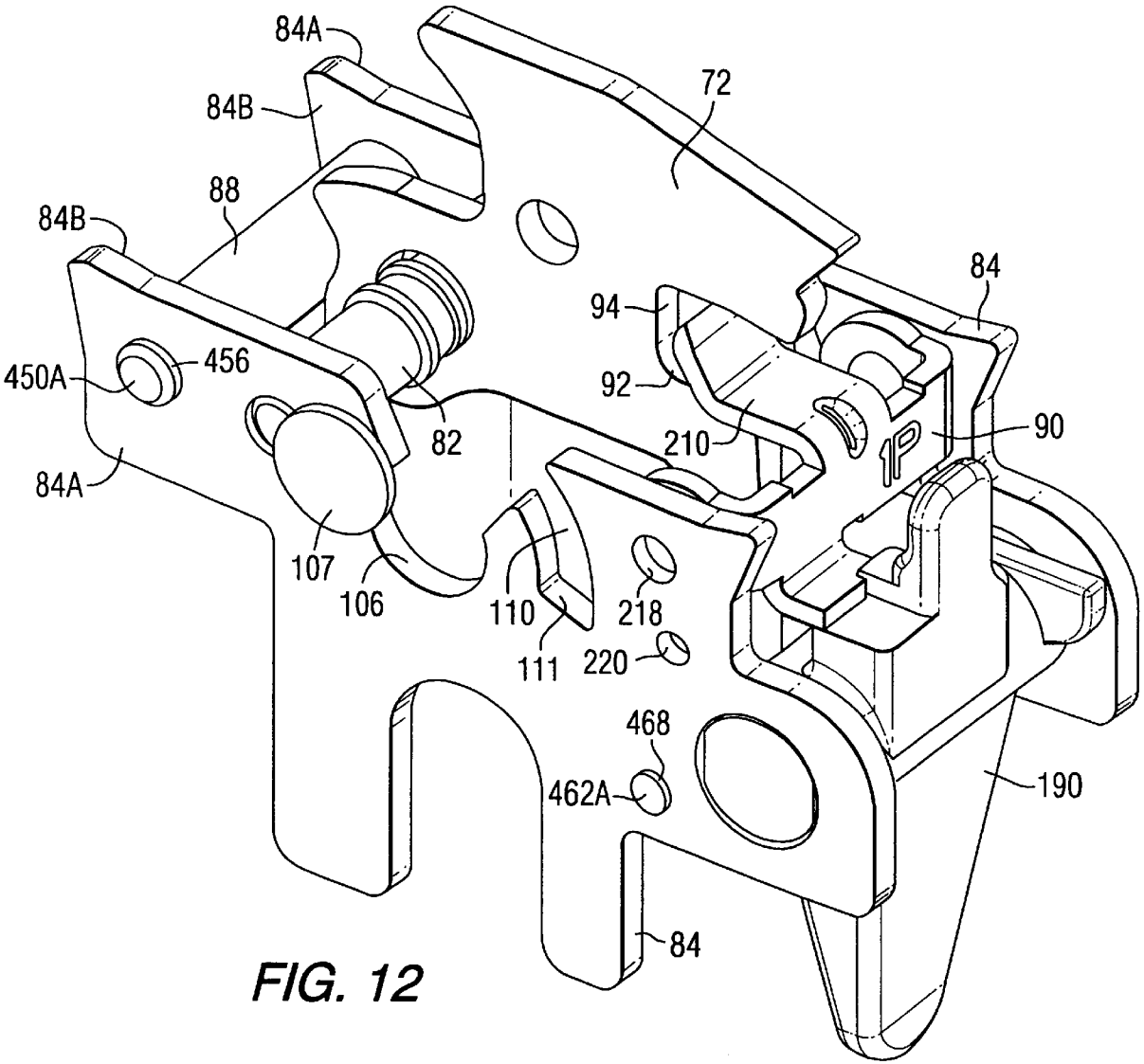
FIG. 12 is an orthogonal view of the sideplate assembly, cradle, latch, and trip bar assembly of an internal portion of the circuit interrupter of FIG. 1.
Figure 13:
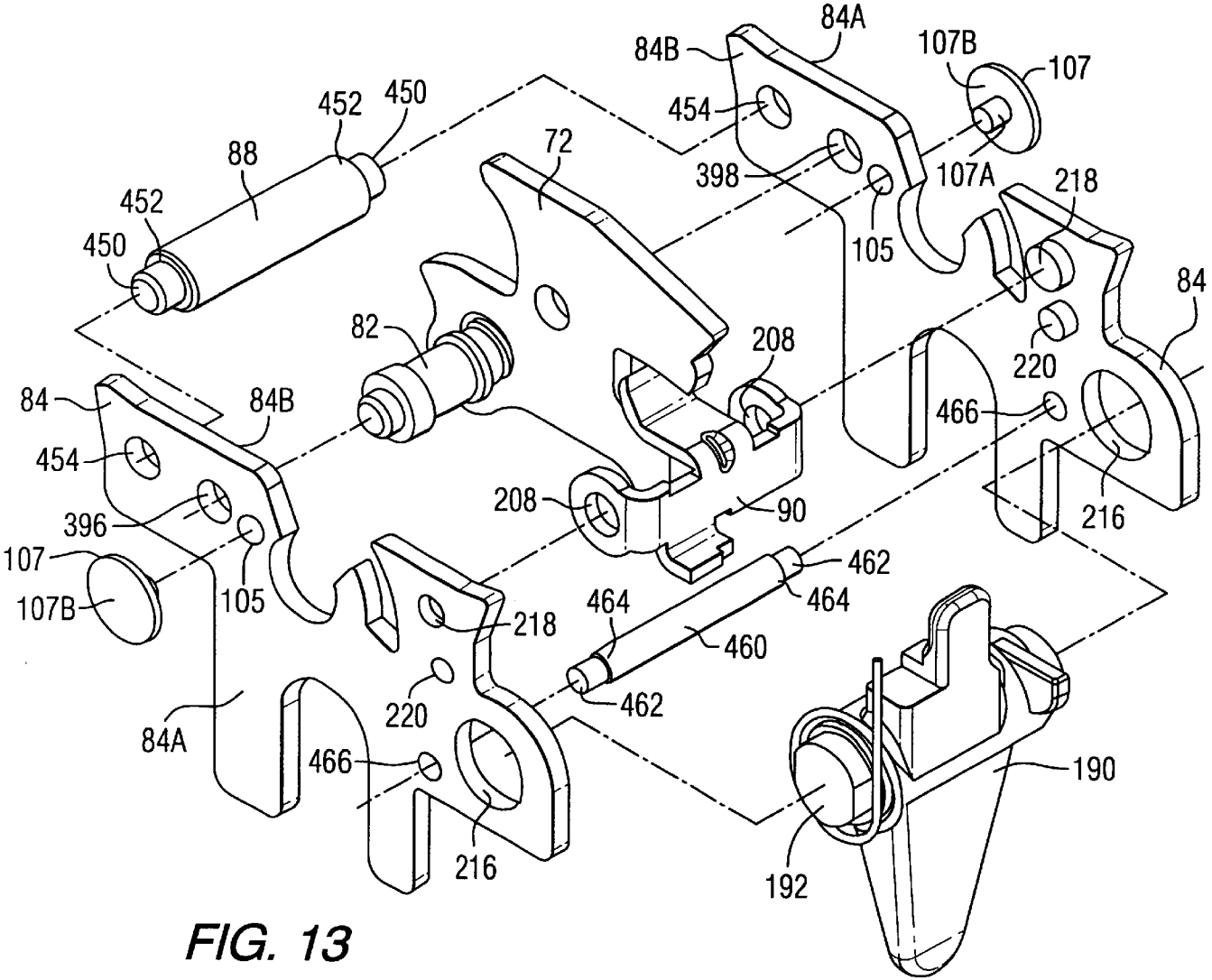
FIG. 13 is an exploded view of the internal portion of the circuit interrupter shown in FIG. 12.
Figure 14:
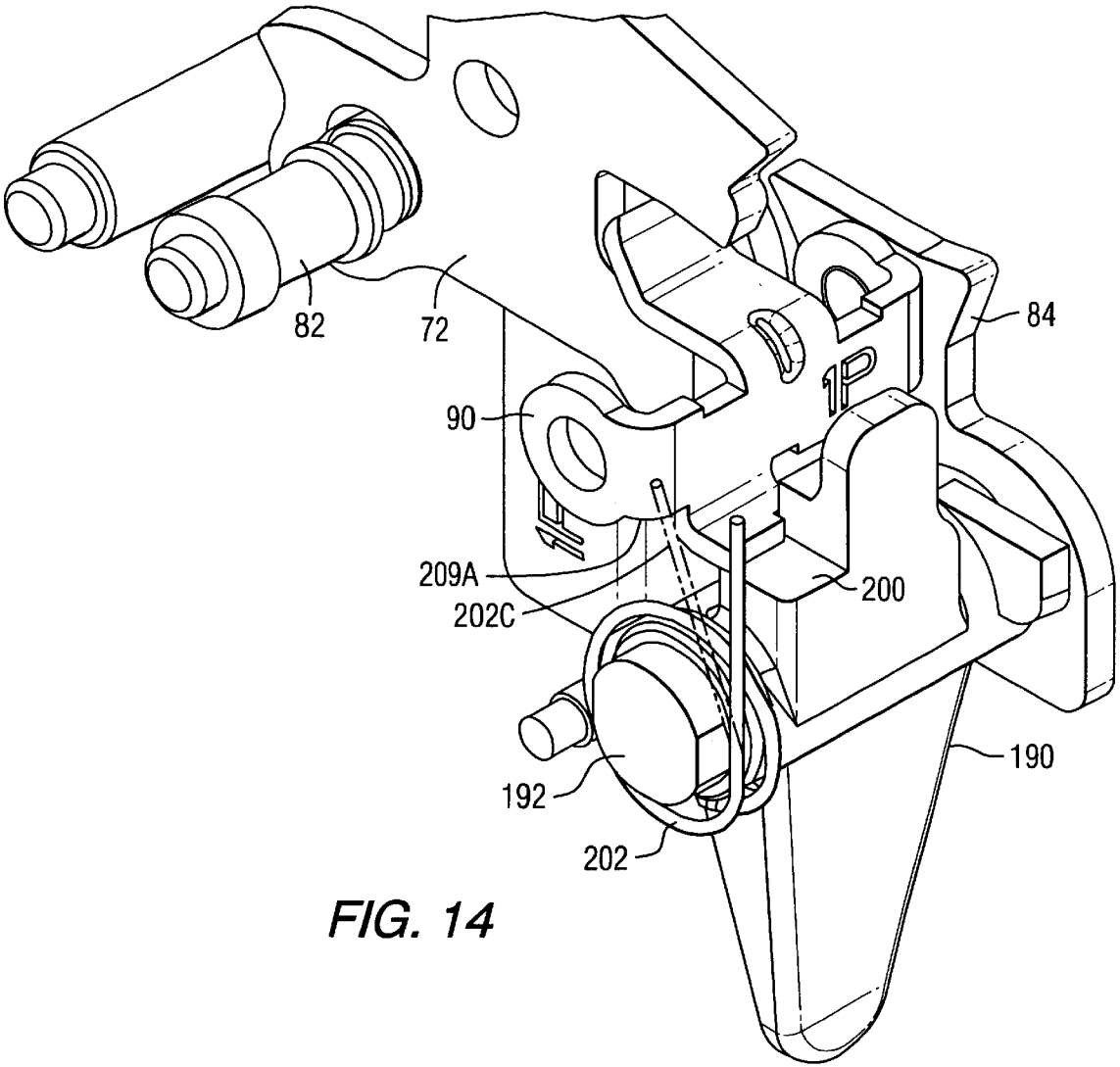
FIG. 14 is an orthogonal, partially broken away view of the engagement between the latch and the trip bar assembly of the circuit interrupter of FIG. 1.

Referring now also to FIGS. 12, 13, and 14, shown is trip bar assembly 190 in conjunction with a portion of the internal workings of circuit breaker 10. Trip shaft 192 is shown laterally disposed between parallel sideplates 84 of the sideplate assembly, with its ends positioned within holes or openings 216. This disposition provides a pivot area about which trip bar assembly 190 can rotate. This rotation is influenced by spring 202 that rotationally biases assembly 190 in the counter-clockwise direction. Also shown is intermediate latch 90 which, like trip shaft 192, is laterally disposed between sideplates 84. Holes or openings 208 of latch 90 are mated with corresponding circular protrusions or indents 218 in sideplates 84, providing a pivot area for rotation of latch 90. Protrusions or indents 220 in sideplates 84 provide a stop for limiting the rotation of latch 90 in the clockwise direction which occurs during a tripping operation as described below.

FIG. 12 shows the latching arrangement found in all dispositions of circuit breaker 10 except the TRIPPED disposition. Lower latch portion 212 of latch 90 is shown fixed in place by intermediate latch interface 200 of trip bar assembly 190. In particular, as also seen in FIG. 14, cutout region 214 of latch 90 is shown mated with protrusion 201 of interface 200, with bottom surface 213A of protruding region 213 of latch 90 in an abutted, engaged relationship with surface 203A of interface 200. Upper latch portion 210 of latch 90 is shown abutted hard against lower portion 92 of latch cutout region 94 of cradle 72. Because latch 90 is prevented from clockwise rotation due to the engagement of lower latch portion 212 with intermediate latch interface 200, the abutment of upper latch portion 210 with cradle 72 prevents the counter-clockwise rotation of cradle 72, notwithstanding the spring tension (described above) experienced by the cradle in that direction. However, during a tripping operation as described below, trip bar assembly 190 is rotated clockwise (overcoming the spring tension provided by spring 202), causing surface 203A of intermediate latch interface 200 to rotate away from its abutted, engaged relationship with protruding region 213 of intermediate latch 90. This disengagement enables the spring forces experienced by cradle 72 to rotate latch 90 in a clockwise direction, thereby terminating the hard abutment between upper latch portion 210 and cradle 72, and releasing the cradle to be rotated counter-clockwise by the aforementioned springs until operating mechanism 38 is in the TRIPPED disposition described above in connection with FIG. 8.

In the preferred exemplary embodiment, protrusion 201 of interface 200 has a height 201A (FIG. 10B) that exceeds height 214A (FIG. 11) of cutout regions 214. In one embodiment, height 201A is approximately twice that of height 214A. This preferred configuration prevents improper engagement of latch portion 212 with interface 200 due to any over-rotation of latch 90 in the counter-clockwise direction during the resetting operation described above with respect to FIG. 9. In particular, it prevents the bottom surface of latch portion 212 near cutout region 214 from improperly contacting and abutting top surface 201B (FIG. 10B) of protrusion 201 which would keep bottom surface 213A (FIG. 11) of protruding region 213 floating (disengaged) and undesirably alter the latch load relationship of trip mechanism 40.

As shown in FIG. 14, spring 202 is positioned in channel 199 of trip shaft 192 with end 202C of spring 202 rotated counter-clockwise (shown with dashed lines) from its vertical position (shown with solid lines) and positioned under and in pressurized contact with intermediate latch 90. In particular, end 202C is positioned under and in pressurized contact with an undersurface 209A of an elbow area 209 (FIG. 11) of latch 90. Positioned as such, end 202C of spring 202 applies a bias force to latch 90 in the counter-clockwise rotational direction, for reasons discussed below. The configuration, size, and positioning of spring 202 is chosen so that the bias force provided by end 202C is, at all times, smaller in magnitude than the spring forces experienced by cradle 72, thereby always enabling the cradle spring forces to rotate latch 90 in a clockwise direction (as described above) when latch 90 and latch interface 200 are disengaged due to a tripping operation. When latch 90 has been rotated clockwise due to a tripping operation as such, the cradle spring forces are no longer felt by latch 90 after cradle 72 has rotated counter-clockwise and lower portion 92 of latch cutout region 94 no longer contacts latch 90. The bias force provided by end 202C of spring 202 then takes over and rotates latch 90 in the counter-clockwise direction. The configuration, size, and positioning of spring 202 is chosen so that the bias force rotates latch 90 in the counter-clockwise direction only to a point where upper latch portion 210 is properly positioned to make contact with upper portion 93 of latch cutout region 94 during the resetting operation described above with respect to FIG. 9. The counter-clockwise rotation of latch 90 due to end 202C of spring 202 advantageously prevents upper latch portion 210 from being left in a clockwise over-rotated position (due to the cradle spring forces) where latch portion 210 is in too vertical of a position such that, during the resetting operation, it could undesirably contact upper portion 93 of latch cutout region 94 at an angle that would prevent or make it difficult for latch 90 to be rotated counter-clockwise (this rotation being necessary for lower latch portion 212 to become latched with latch interface 200, as described above).

As described above, protrusions or stops 220 are provided in sideplates 84 in order to limit the clockwise rotation of latch 90. Although these protrusions ideally prevent clockwise over-rotation of latch 90 into too vertical of a position, variability in parts may limit their ability to accomplish this goal. By supplying a constant bias force on latch 90 in the counter-clockwise direction, end 202C of spring 202 cooperates with stops 220 to ensure that the desired over-rotation protection exists.

Figure 15:
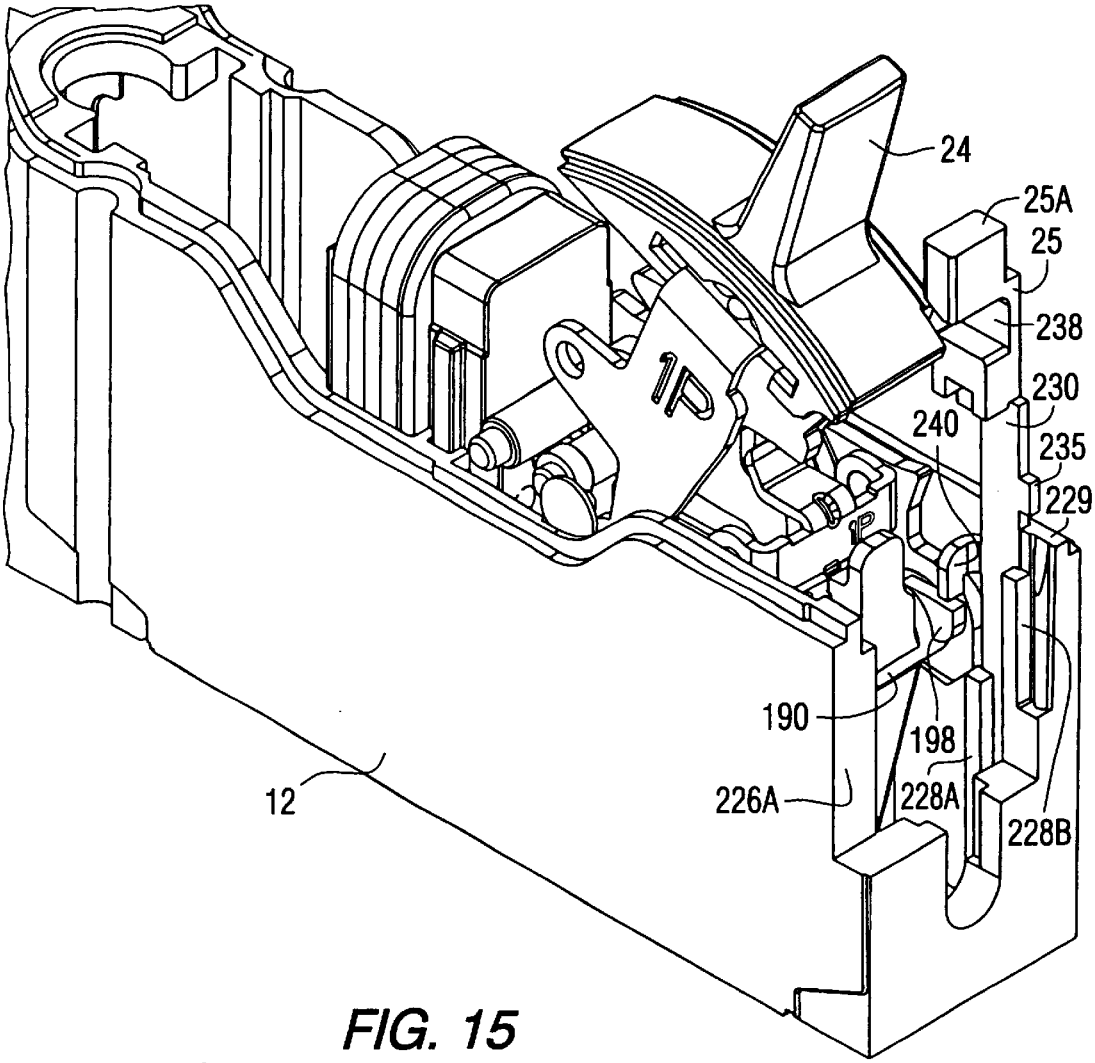
FIG. 15 is an orthogonal, partially broken away view of the base and an internal portion of the circuit interrupter including the push-to-trip actuator of the trip mechanism.

There are several types of tripping operations that can cause trip bar assembly 190 to rotate in the clockwise direction and thereby release cradle 72. One type is a manual tripping operation, and the structure associated therewith is shown in FIG. 15. FIG. 15 shows a portion of the internal workings of circuit breaker 10 within base 12, with base 12 having been cut away at 226A and 226B to provide a better view thereof. Shown is trip bar assembly 190 and manual trip bar 198 thereof. Along the outer sidewall of base 12 is a push-to-trip actuator 230 of trip mechanism 40 that is positioned such that it can be moved upwardly or downwardly. Actuator 230 includes a button 25 with a top portion 25A that protrudes through rectangular opening 23 of cover 14 (FIGS. 1–2).

Figure 16A:
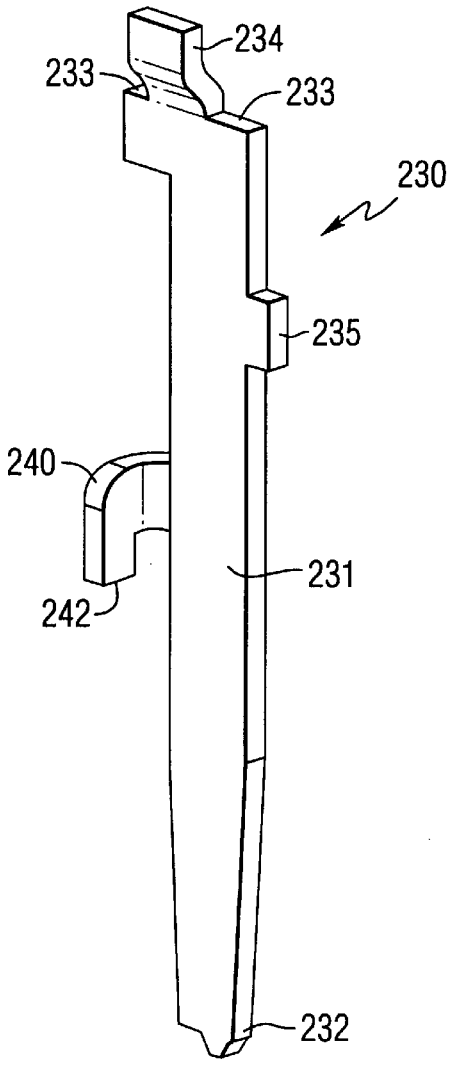
FIG. 16A is an orthogonal view of the push-to-trip actuator shown in FIG. 15.
Figure 16B:
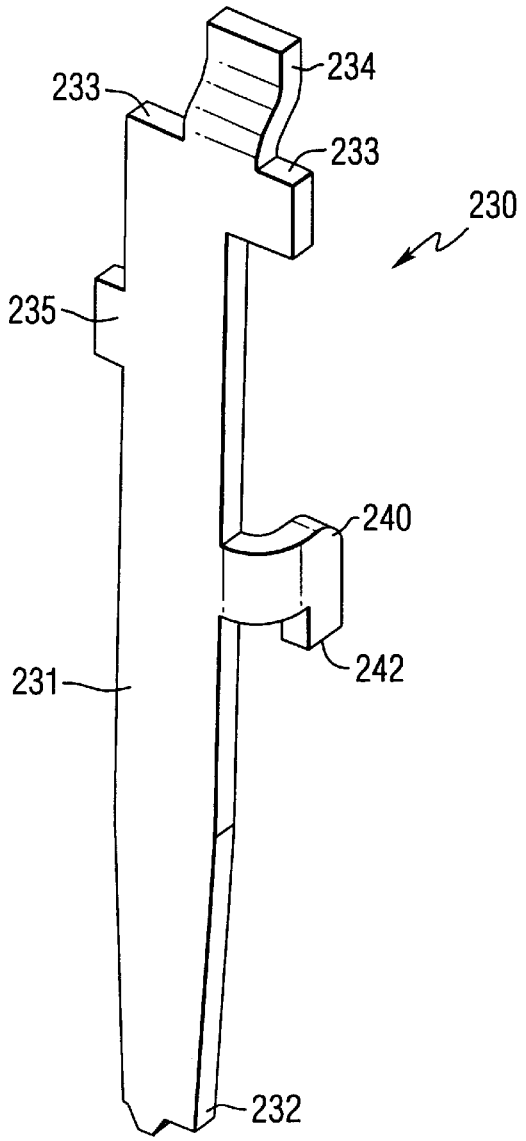
FIG. 16B is another orthogonal view of the push-to-trip actuator shown in FIG. 15.
Figure 17:
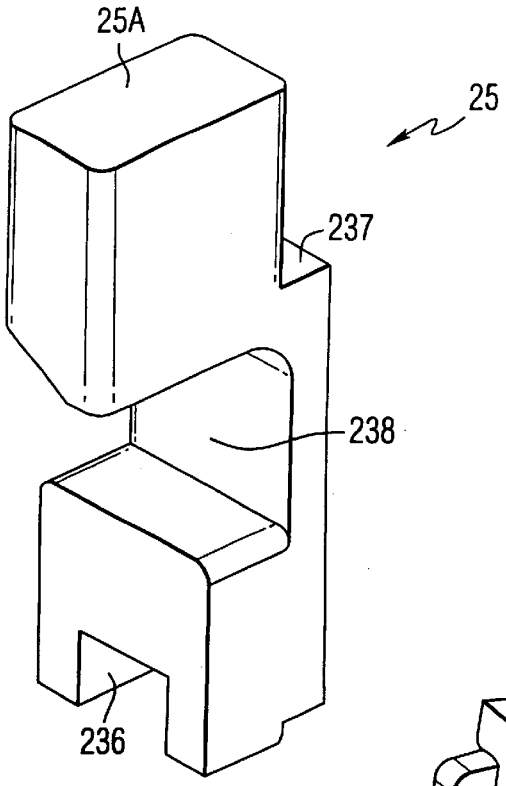
FIG. 17 is an orthogonal view of the button of the push-to-trip actuator shown in FIG. 15.

Referring now also to FIGS. 16A and 16B, push-to-trip actuator 230 is comprised of a main bar-like member 231 that slightly tapers near its bottom 232 where it slideably fits into a groove formed between housing structures 228A, 228B and 229 and the outer sidewall of base 12 (FIG. 15). This groove provides a guide for the vertical motion of push-to-trip actuator 230. Actuator 230 includes a stop member 235 that is positioned to abut housing structure 229 in order to limit the downward movement of actuator 230 within this groove. For reasons discussed below, a spring (not shown) is seated between bottom 232 of actuator 230 and the bottom of base 12. Near its top, actuator 230 includes shoulders 233 from which upwardly protrudes a curved flange 234. Button 25 sits upon shoulders 233 and, as shown in FIG. 17, includes an appropriately configured opening 236 into which curved flange 234 is inserted. Button 25 also includes a shoulder 237 which abuts upwardly against a bottom surface of cover 14 so as to limit the upward vertical movement of push-to-trip actuator 230, and a cut-out section 238 for providing clearance for handle 24 and its associated handle slider, as described in greater detail below. Protruding outwardly from approximately the middle of main member 231 of push-to-trip actuator 230 is a downwardly curved arm 240 with a bottom portion 242. As shown in FIG. 15, bottom portion 242 of arm 240 is positioned just above manual trip bar 198 of trip bar assembly 190.

When top portion 25A of button 25 is depressed, the resulting downward movement of push-to-trip actuator 230 causes bottom portion 242 of arm 240 to contact manual trip bar or member 198, thereby causing trip bar assembly 190 to rotate in the clockwise direction. As described above, this rotation of assembly 190 releases cradle 72 and results in the TRIPPED disposition shown in FIG. 8. The spring (not shown) positioned below bottom 232 of push-to-trip actuator 230 causes the actuator to return to its initial position when force upon top portion 25A of button 25 is no longer exerted.

In a preferred embodiment, push-to-trip actuator 230 (except button 25) is comprised of a metal such as carbon steel, and is integrally formed via a stamping process. As such, the strength of the main portion of actuator 230 is enhanced, enabling it to have thinner dimensions which are highly desirable in view of the space constraints of modern circuit breakers such as circuit breaker 10. In the exemplary embodiment, the carbon steel of actuator 230 is 0.045 inches thick. Button 25 is preferably comprised of a suitable polymer (plastic) with electrical insulating properties.

In addition to the manual tripping operation described above, circuit breaker 10 includes automatic thermal and magnetic tripping operations which likewise can cause trip bar assembly 190 to rotate in the clockwise direction and thereby release cradle 72. The structure for providing these additional tripping operations can be seen in FIG. 7 which shows circuit breaker 10 in its ON (non-TRIPPED) disposition, with latch 90 abutted hard against lower portion 92 of latch cutout region 94 of cradle 72, and latch 90 held in place by intermediate latch interface 200 (FIG. 10B) of trip bar assembly 190. Also shown is an automatic trip assembly 250 of trip mechanism 40 that is positioned in close proximity to trip bar assembly 190.

Referring now also to FIGS. 18A, 18B, 18C, 19A, 19B, 20, 21, 22A, and 22B, shown in isolation is automatic trip assembly 250 and its various components. Assembly 250 includes a magnetic yoke 252, a bimetal 254, a magnetic clapper or armature 256, and load terminal 28. Magnetic yoke 252 (FIGS. 19A and 19B) includes a substantially planar portion 258 with a bottom portion 258A. Protruding from portion 258 are curved arms or wings 260 and 262 having front faces 260A and 262A. At the tops of arms 260 and 262 are pivot supports 264 and 266, with respective pivot surfaces 268 and 270 on which pivot magnetic clapper 256, as described below. Pivot support 264 includes a front retaining ridge or raised surface 263 that helps define pivot surface 268, and pivot support 266 includes a downwardly facing stop or protrusion 265. Pivot supports 264 and 266 each include a rear retaining protrusion 267 which helps define pivot surfaces 268 and 270. Yoke 252 also includes a shoulder portion 272 above which is positioned a portion of load terminal 28, as described below. In addition, holes or openings 274 are formed through substantially planar portion 258 for purposes described below. Yoke 252 of the exemplary embodiment is made of carbon steel material of approximately 0.078 inch thickness.

Bimetal 254 (FIG. 20) is planar and substantially rectangular in form and includes two cutout regions 280 and 282 forming a neck 284 upon which sits a head portion 286. Through a bottom portion 287 of bimetal 254 is a hole or opening 288 for purposes described below. Bimetal 254 is structured as is known to one of skill in the art such that bottom portion 287 deflects (bends) in a conventional manner above certain temperatures.

Figure 19A:
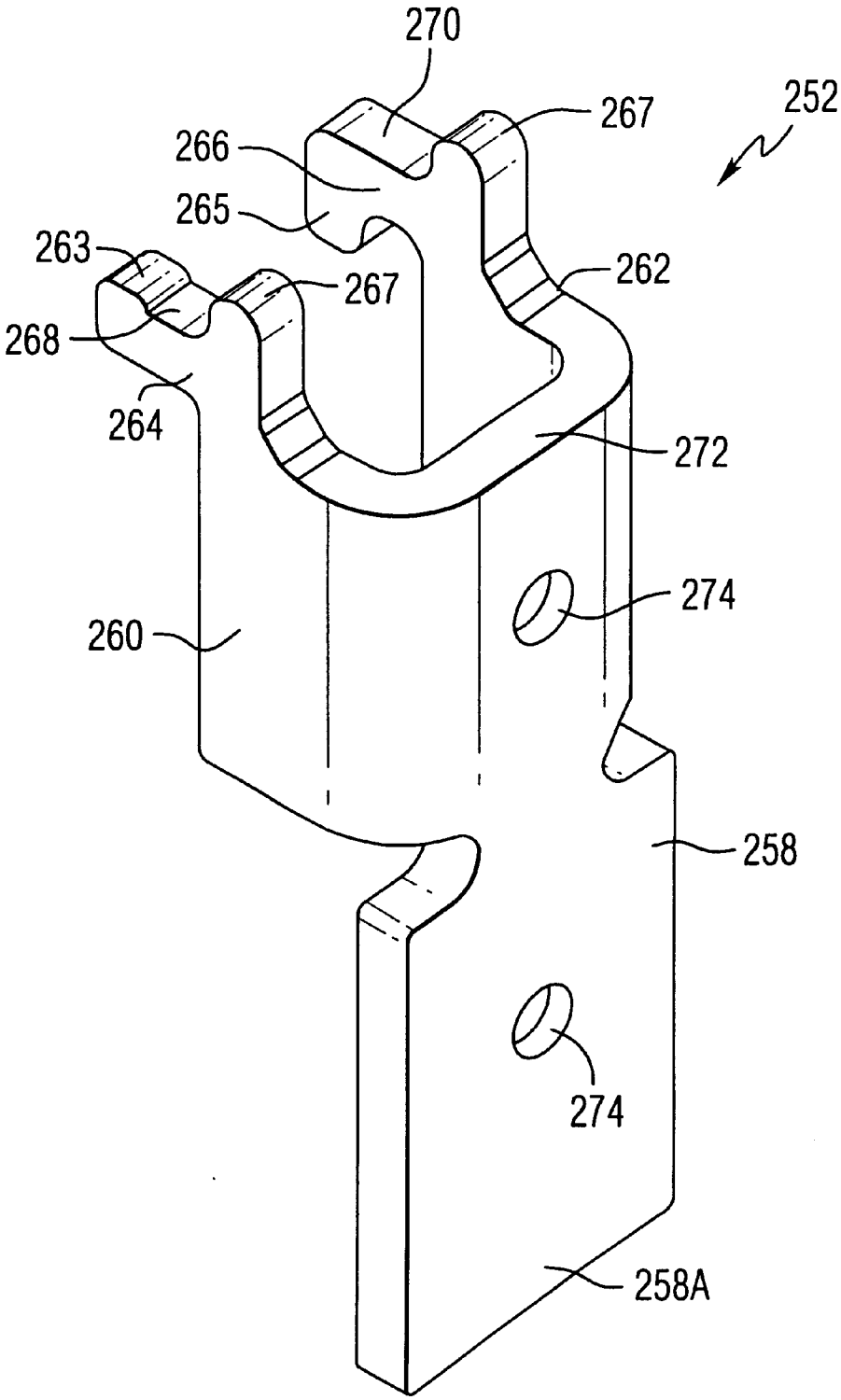
FIG. 19A is an orthogonal view of the magnetic yoke of the automatic trip assembly shown in FIG. 18A.
Figure 19B:
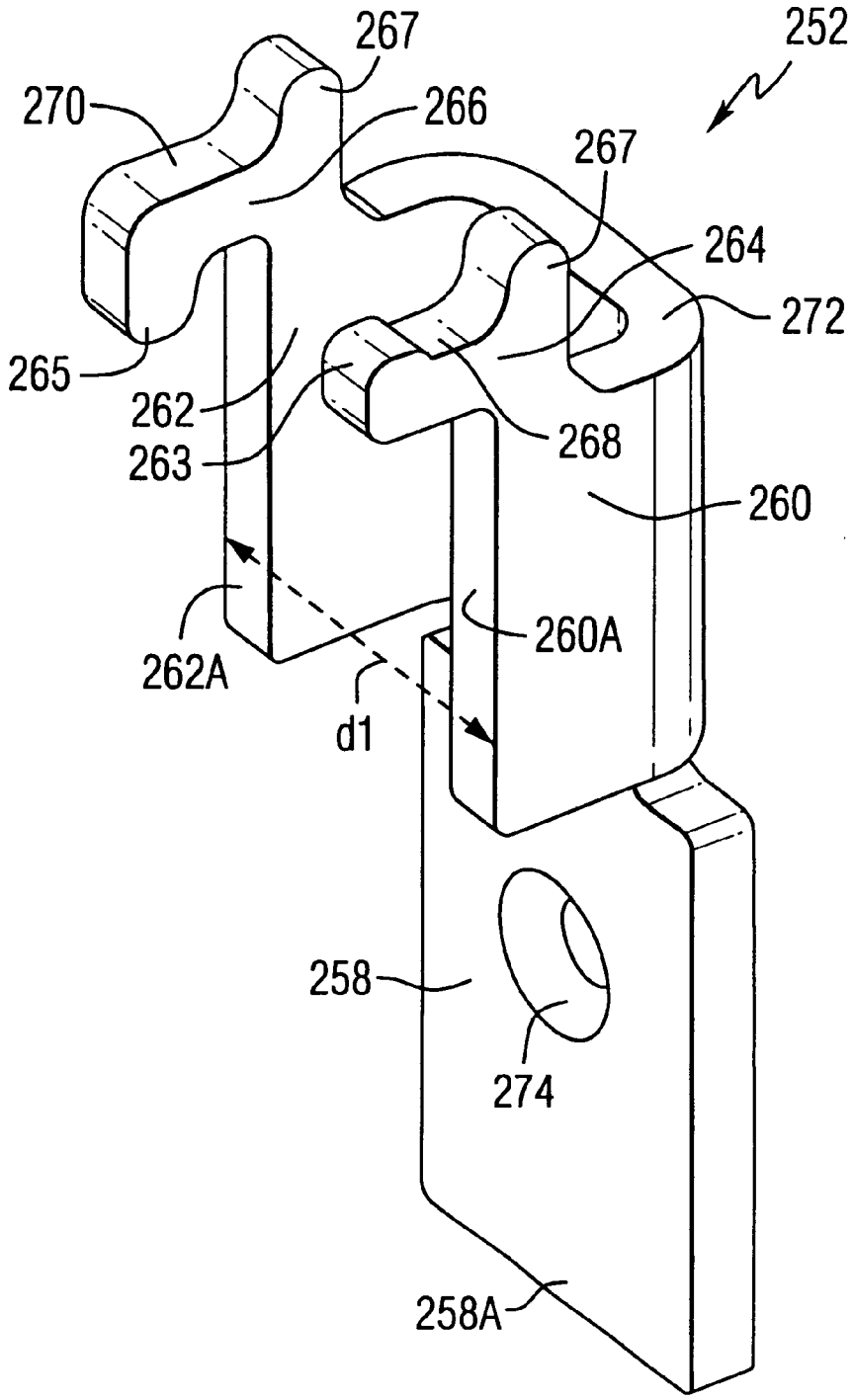
FIG. 19B is another orthogonal view of the magnetic yoke of the automatic trip assembly shown in FIG. 18A.
Figure 20:
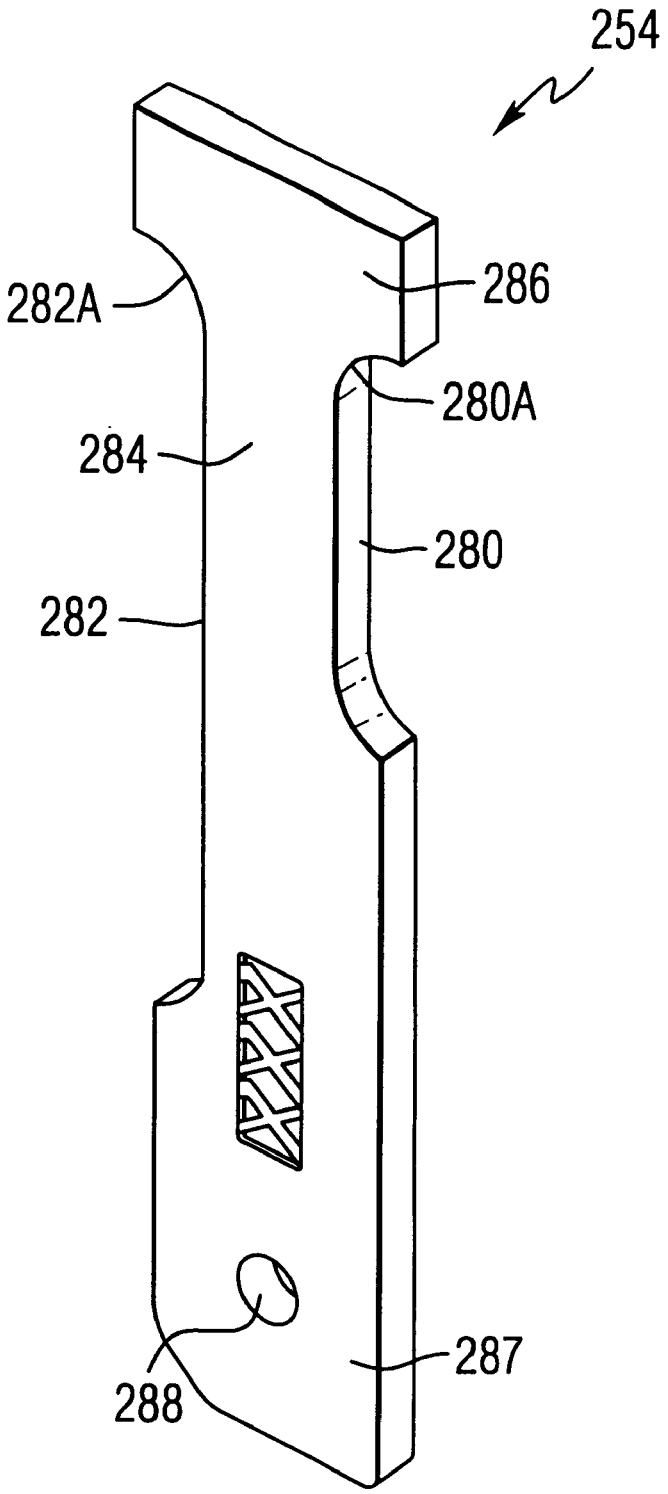
FIG. 20 is an orthogonal view of the bimetal of the automatic trip assembly shown in FIG. 18A.
Figure 21:
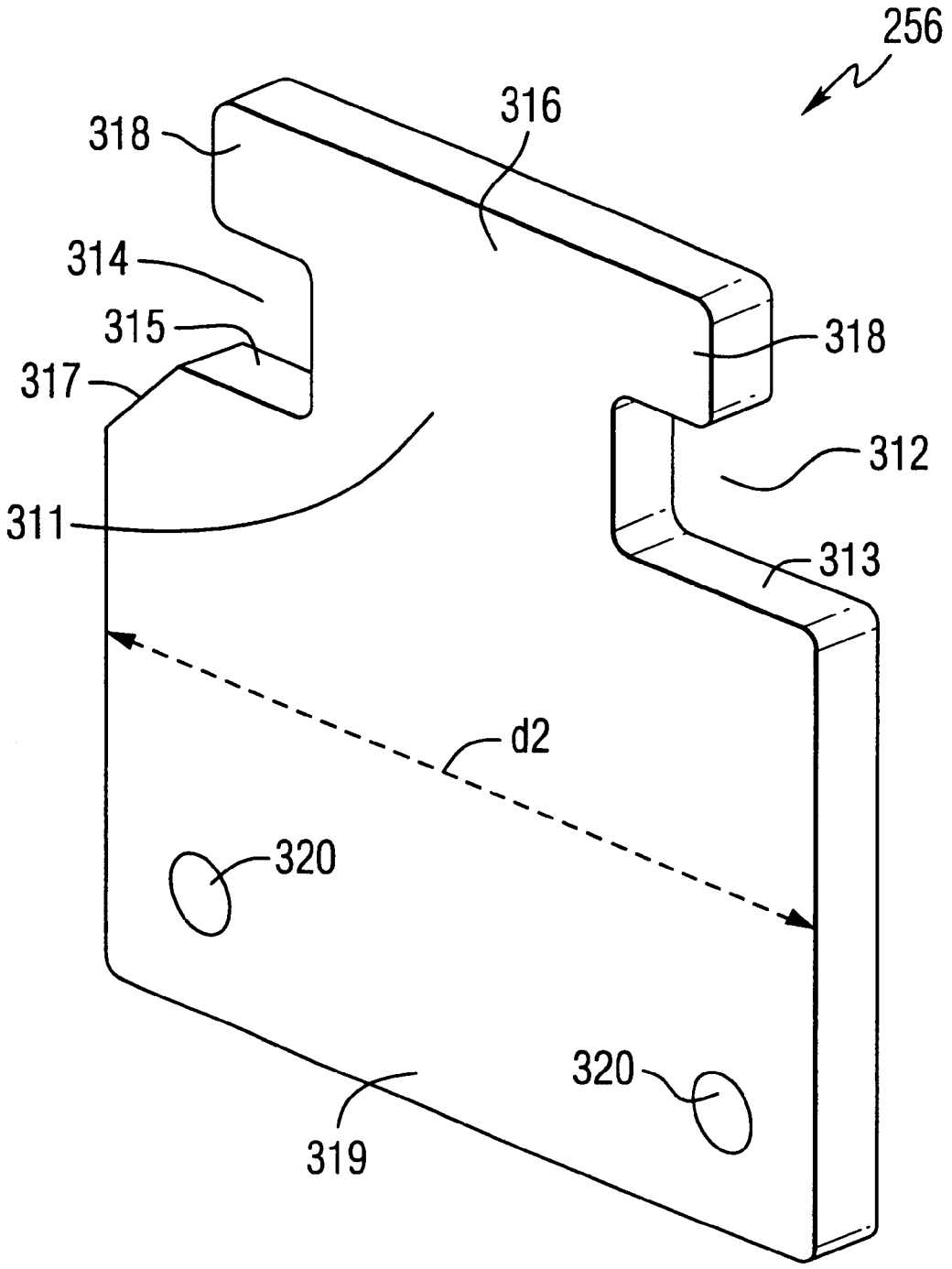
FIG. 21 is an orthogonal view of the armature of the automatic trip assembly shown in FIG. 18A.

Magnetic clapper 256 (FIG. 21) is planar in form and includes cutout regions 312 and 314 which form shoulders 313 and 315, a neck portion 311, and a head portion 316. Head portion 316 includes horizontal pivot portions or arms 318, and the outside corner of shoulder 315 includes a chamfered region or cutout 317. The body of clapper 256 is wider than the body of magnetic yoke 252, with distance d2 greater than distance d1 (FIG. 19B). Clapper 256 includes holes or openings 320 formed within a bottom portion 319 for purposes described below, and is formed of carbon steel material in the exemplary embodiment.

Figure 22A:
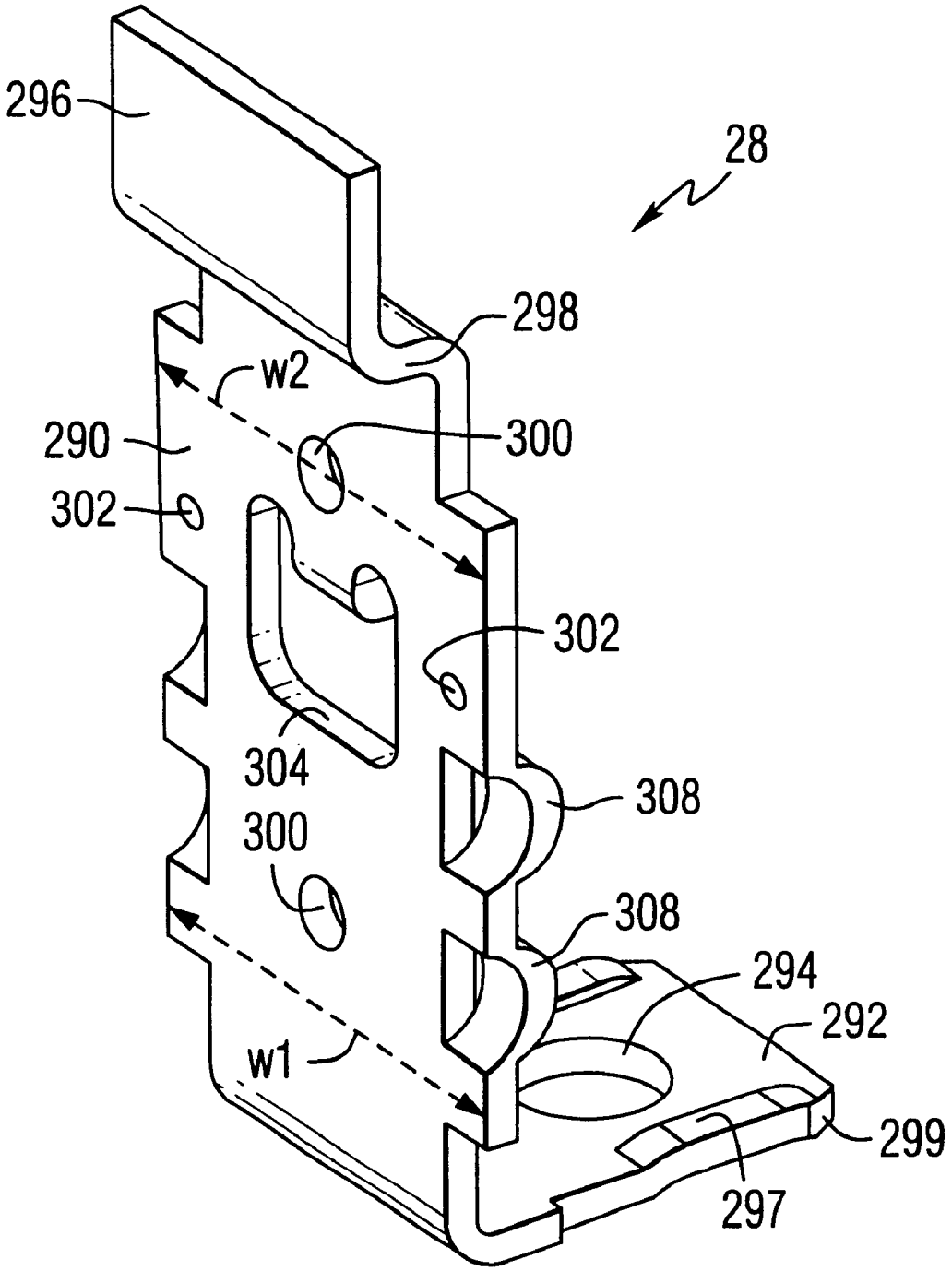
FIG. 22A is an orthogonal view of the load terminal of the automatic trip assembly shown in FIG. 18A.

Load terminal 28 (FIGS. 22A and 22B) includes a substantially planar portion 290 from which protrudes, in approximately perpendicular fashion, a bottom connector portion 292 that connects with an external input of electrical current by means of a connecting device such as a self-retaining collar. Such a collar provides both a physical and electrical connection, and an example collar 295 is shown in FIG. 4 (connected to connector portion 292 as well as to a similar portion of line terminal 29) and is described in greater detail below in connection with FIG. 29. For purposes described below with respect to FIG. 29, connector portion 292 has a hole or opening 294, raised portions or surfaces 297 on the top thereof, and cut-outs 299 that cause front face 301 to have a smaller width than the rest of connector 292. Located at the other end of terminal 28 is a top substantially planar region 296 which is offset from portion 290 via a curved region 298. Formed through portion 290 are holes or openings 300, 302, and 304. A tab or protrusion 306 protrudes from one side of portion 290 near hole 304. Planar portion 290 includes offsets or ribbed portions 308 formed along the sides thereof. As best seen in FIG. 22A, planar portion 290 slightly tapers along its length in a gradual manner, with width w2 wider than width w1.

Figure 22B:
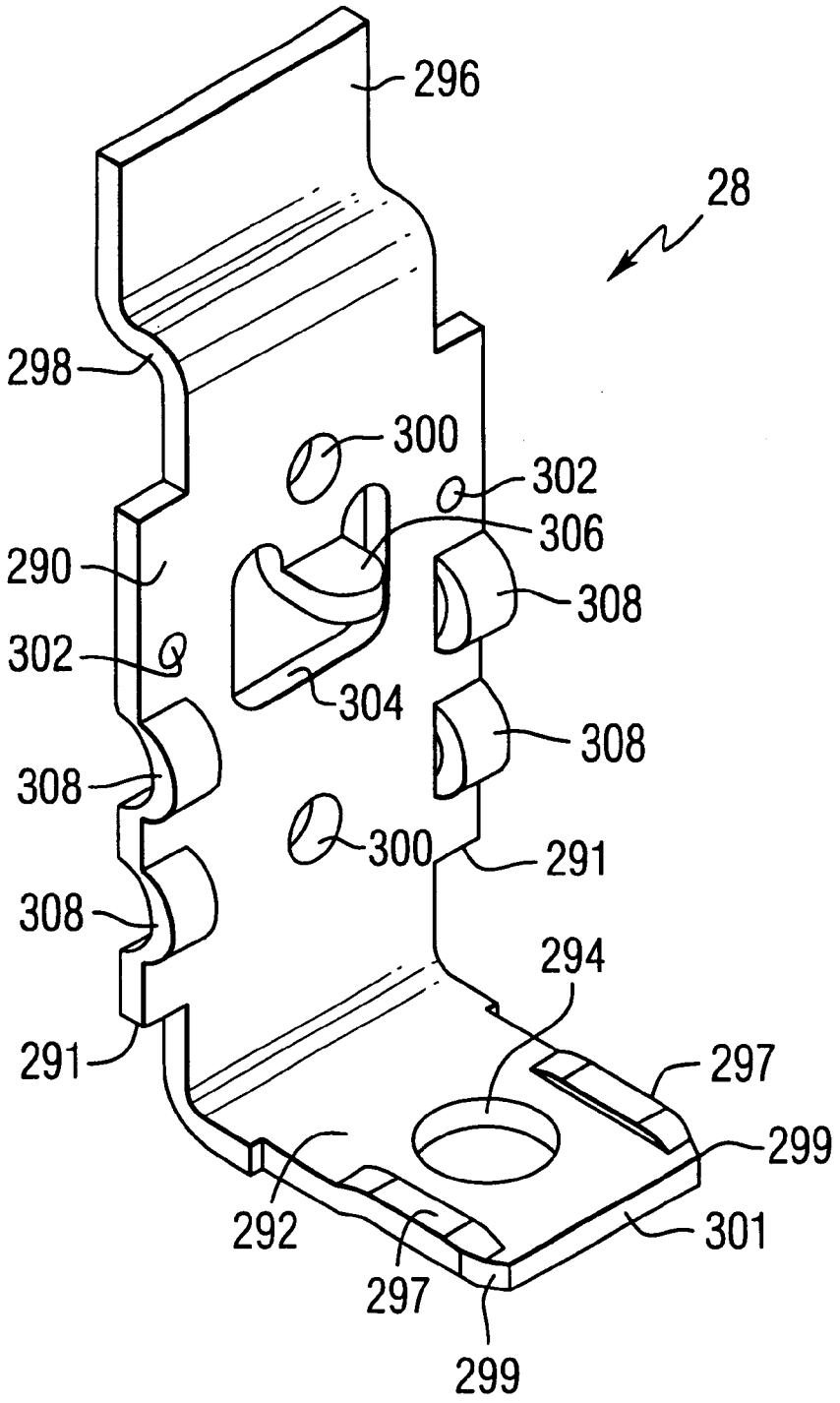
FIG. 22B is another orthogonal view of the load terminal of the automatic trip assembly shown in FIG. 18A.
Figure 23:
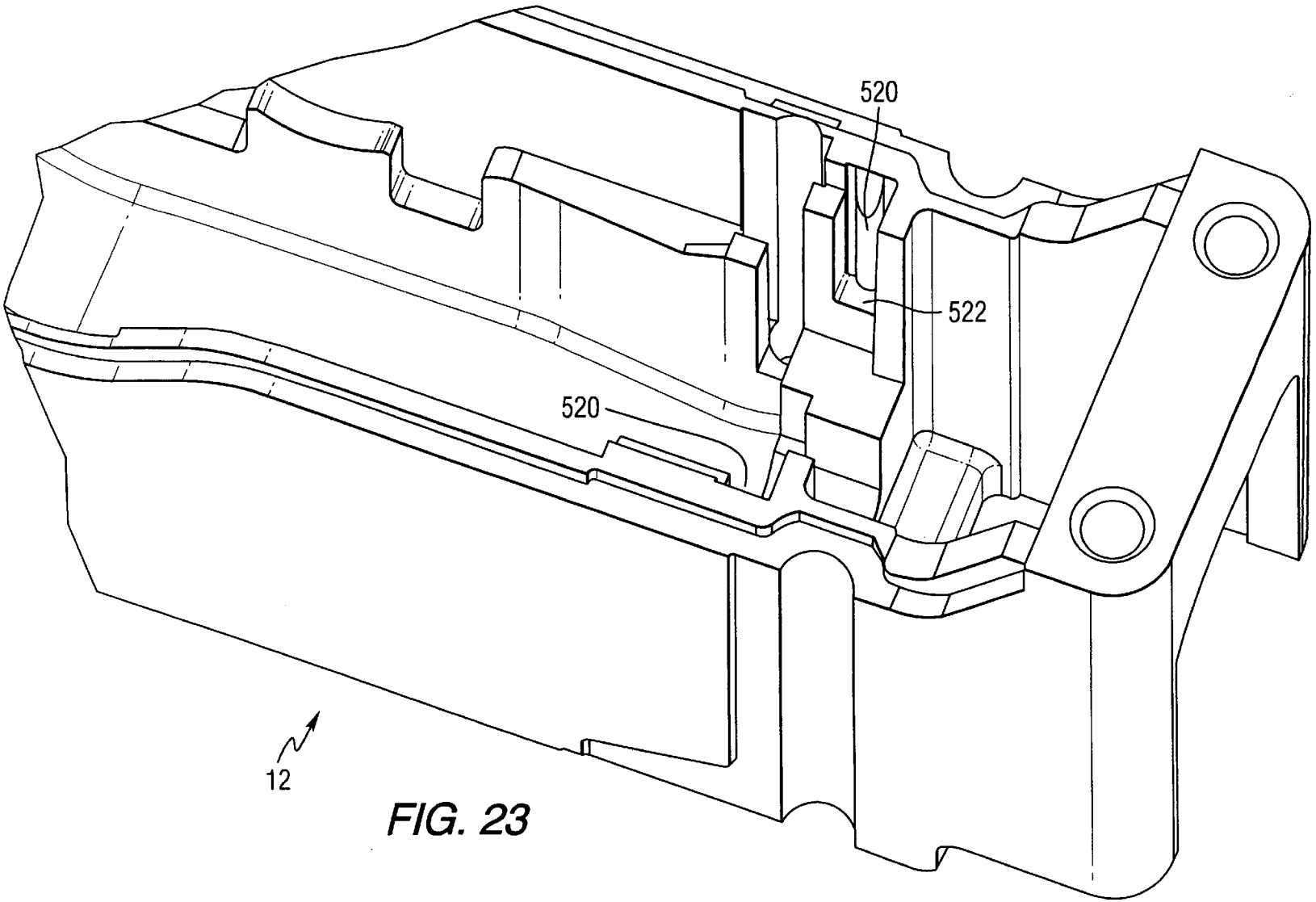
FIG. 23 is an orthogonal, partially broken away view of the base of the circuit interrupter of FIG. 1 showing the grooves in which the load terminal of the automatic trip assembly is inserted.
Figure 24:
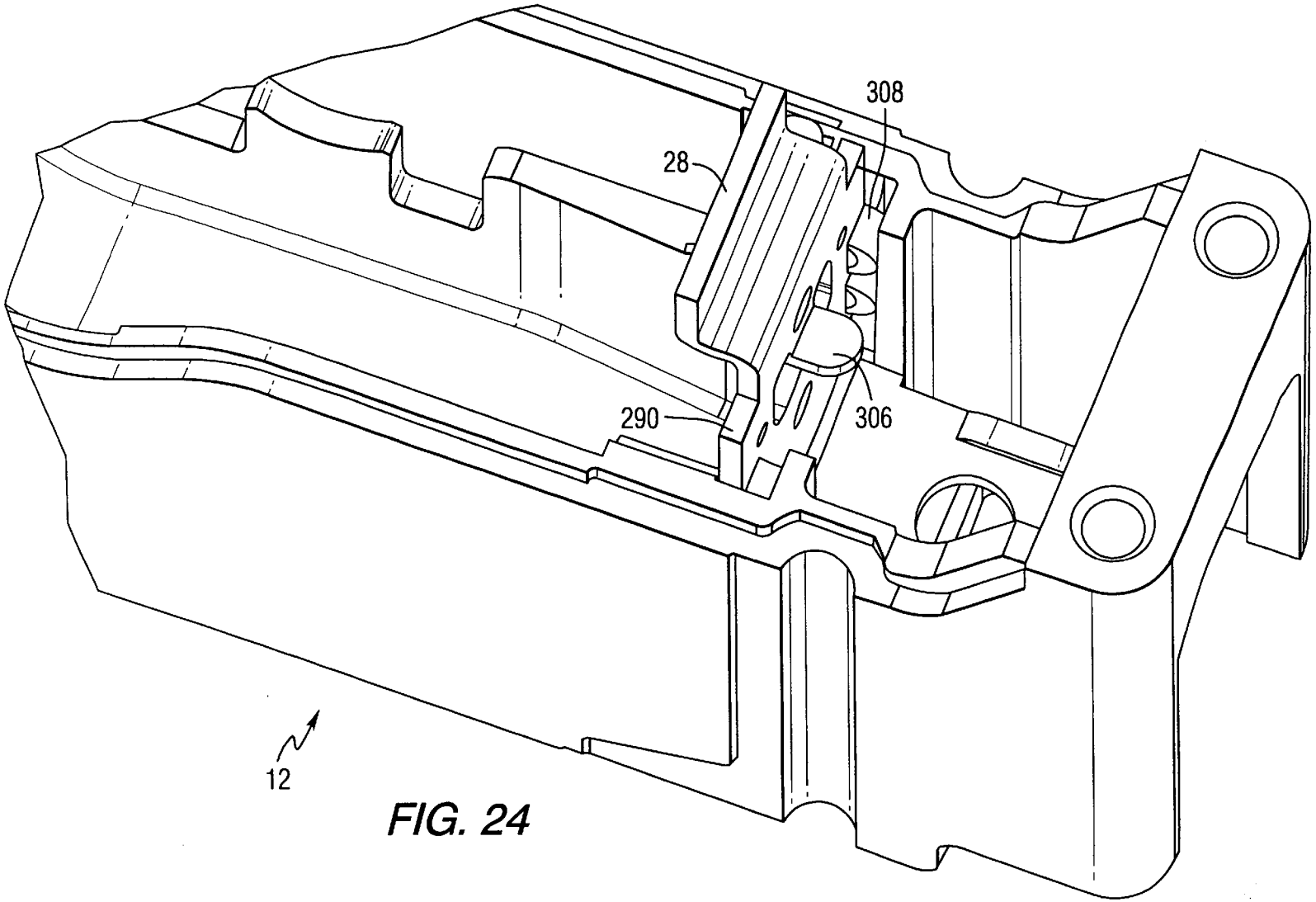
FIG. 24 is an orthogonal, partially broken away view similar to FIG. 23 showing the base with the load terminal inserted.
Figure 25:
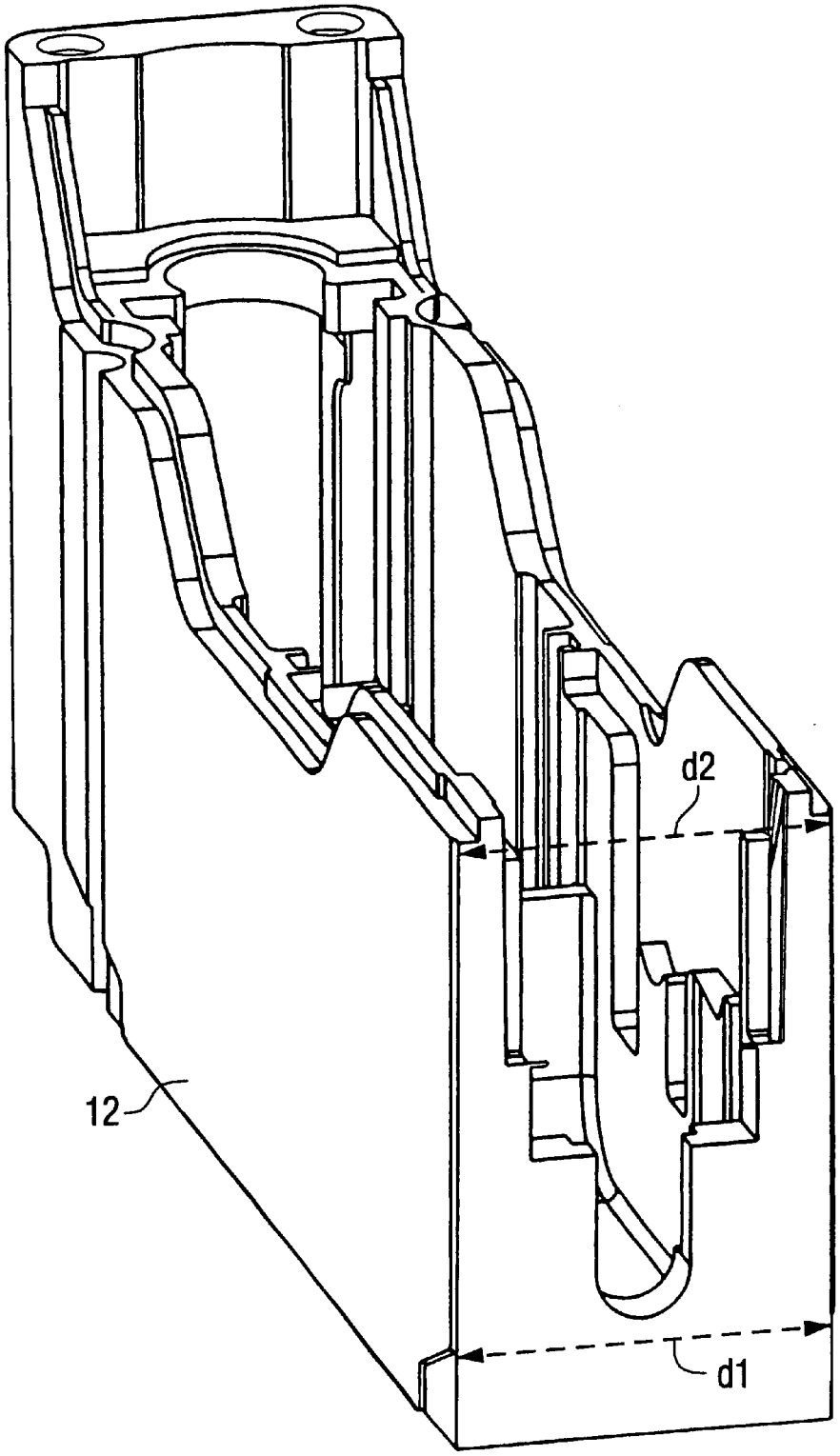
FIG. 25 is a side elevational view of the base of the circuit interrupter of FIG. 1 showing the tapered sides thereof.
Figure 26:
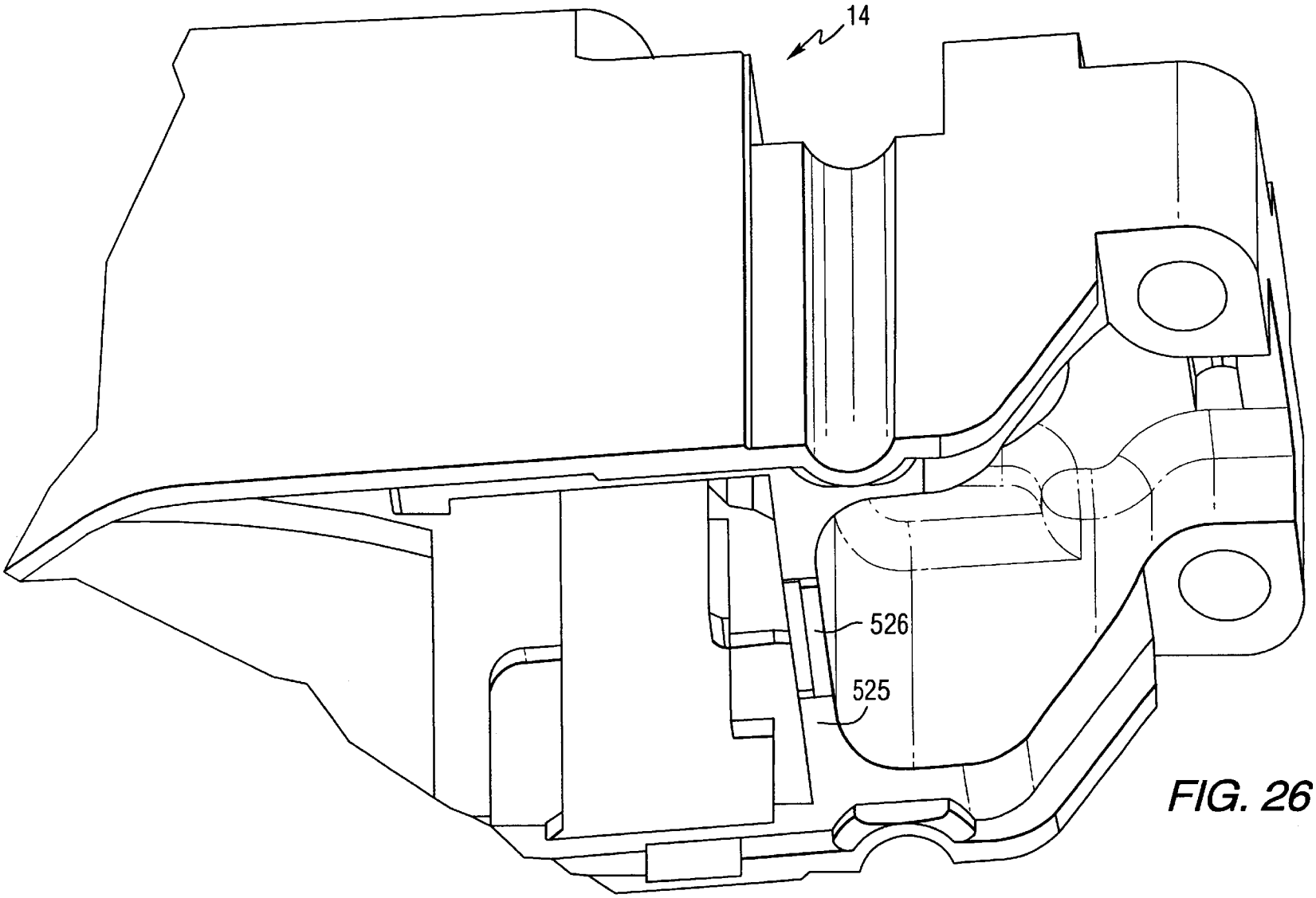
FIG. 26 is an orthogonal, partially broken away view of the cover of the circuit interrupter of FIG. 1 showing an abutment wall that contacts the inserted load terminal of FIG. 24.
Figure 27:
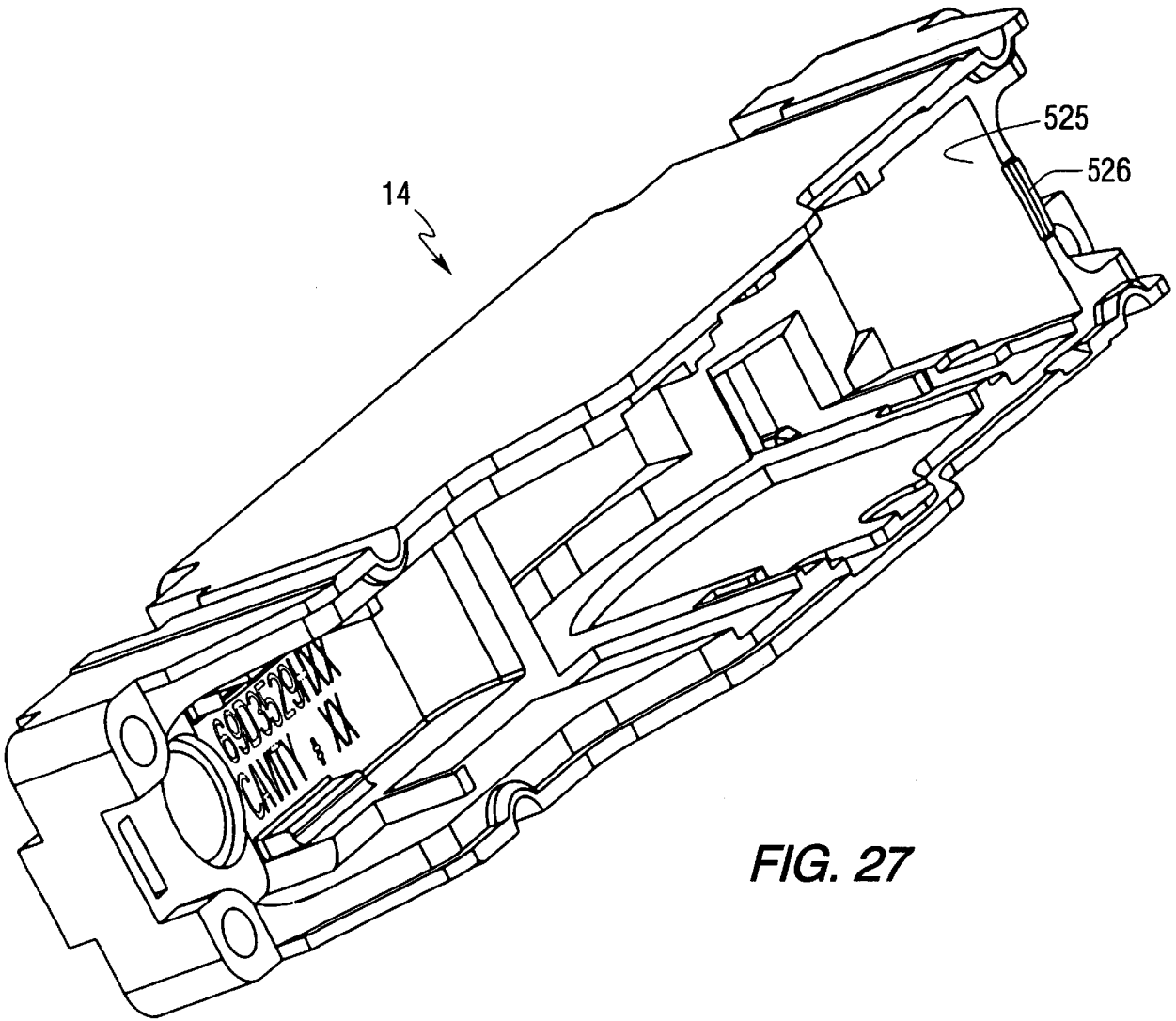
FIG. 27 is another orthogonal view of the cover and abutment wall shown in FIG. 26.

Referring briefly now also to FIGS. 23–27, shown in FIG. 23 is a portion of base 12 into which load terminal 28 mounts when assembled into circuit breaker 10. Base 12 includes channels 520 formed in both sides thereof, each with a bottom 522. As shown in FIG. 24, the sides of planar portion 290 of load terminal 28, and in particular ribbed portions 308, insert into channels 520 until bottom shoulders 291 (see FIG. 22B) of terminal 28 abut the bottoms 522 of channels 520. Inserted as such, with an interference fit provided by ribs 308, lateral movement of terminal 28 relative to base 12 is prevented. The sides of base 12, and therefore channels 520 formed therein, are slightly tapered from top to bottom, as best shown in FIG. 25, with distance d2 greater than distance d1. This tapering aids in the molded production of base 12. The tapering of planar portion 290 of terminal 28 follows this tapering of base 12 so as to provide a snug fit therewith upon insertion. Ribbed portions 308 enhance the frictional engagement between terminal 28 and channels 520, thereby also resisting vertical movement of terminal 28 relative to base 12. In order to further prevent vertical movement of terminal 28 relative to base 12, cover 14 includes an abutment portion or wall 525, as shown in FIGS. 26 and 27, having a bottom that is appropriately positioned and dimensioned to abut protrusion 306 of terminal 28 when cover 14 is in a position of securement with base 12. This abutment holds protrusion 306 down, thus keeping terminal 28 fully seated in channels 520. In the exemplary embodiment, the bottom of abutment wall 525 includes a contact member or crush rib 526 that is positioned to directly contact protrusion 306 when cover 14 is secured to base 12. Rib 526 is formed of compressible material, thereby providing a little "give" to the abutment of wall 525 with protrusion 306 and ensuring proper fit notwithstanding slight variability in the circuit breaker components in issue. In one embodiment, crush rib 526 is formed of a thermoset glass polyester material like the rest of cover 14 but with a reduced amount of fiberglass in order to provide enhanced compressibility.

Figure 18A:
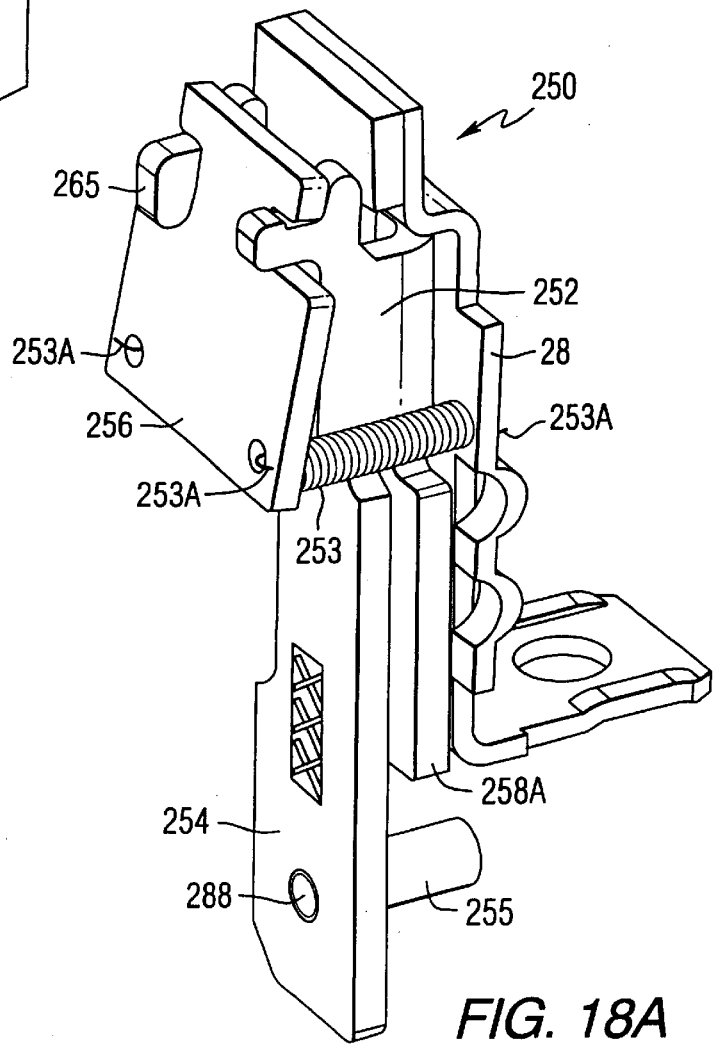
FIG. 18A is an orthogonal view of the automatic trip assembly of the trip mechanism of the circuit interrupter of FIG. 1.
Figure 18B:
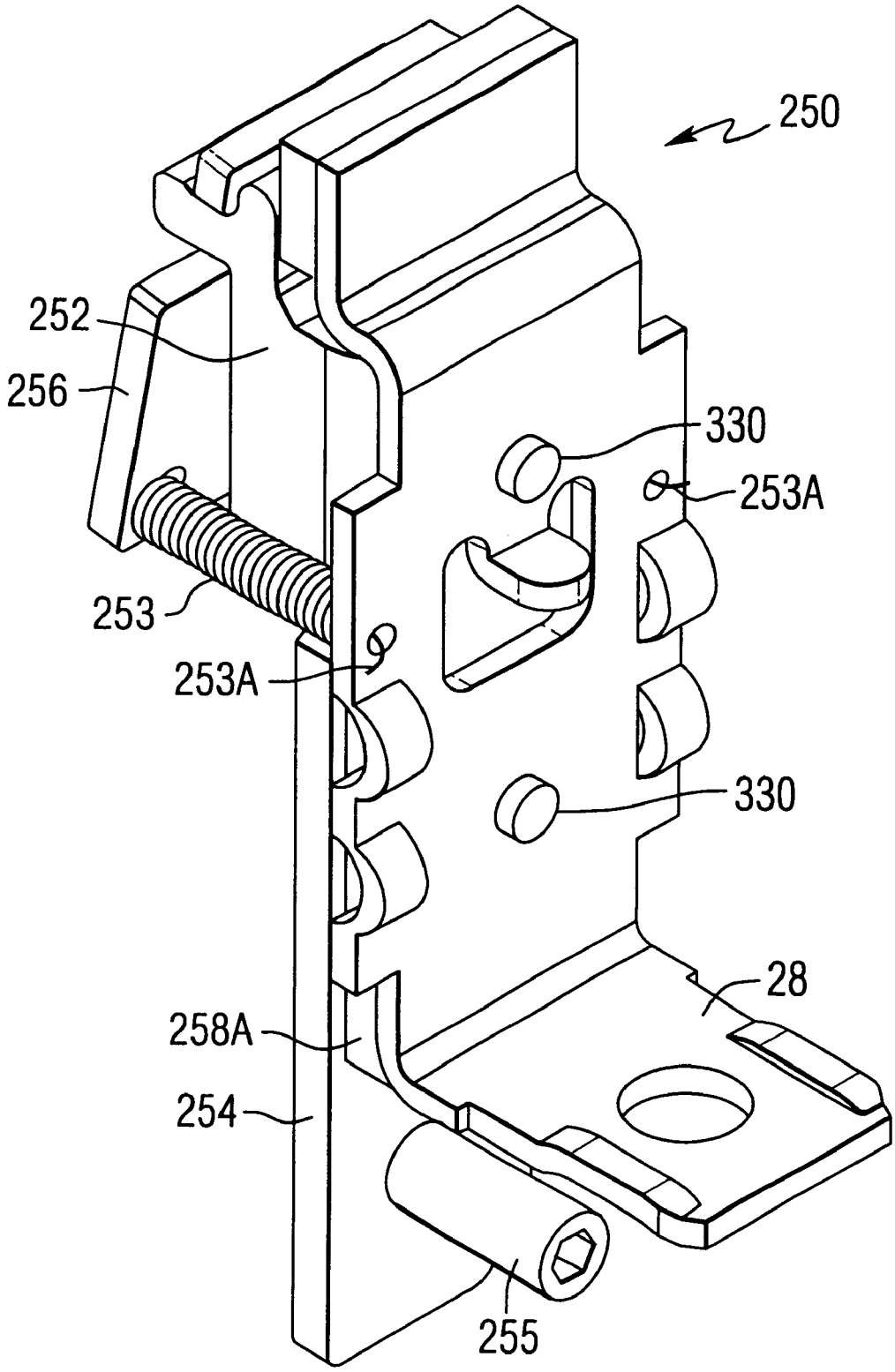
FIG. 18B is another orthogonal view of the automatic trip assembly shown in FIG. 18A.
Figure 18C:
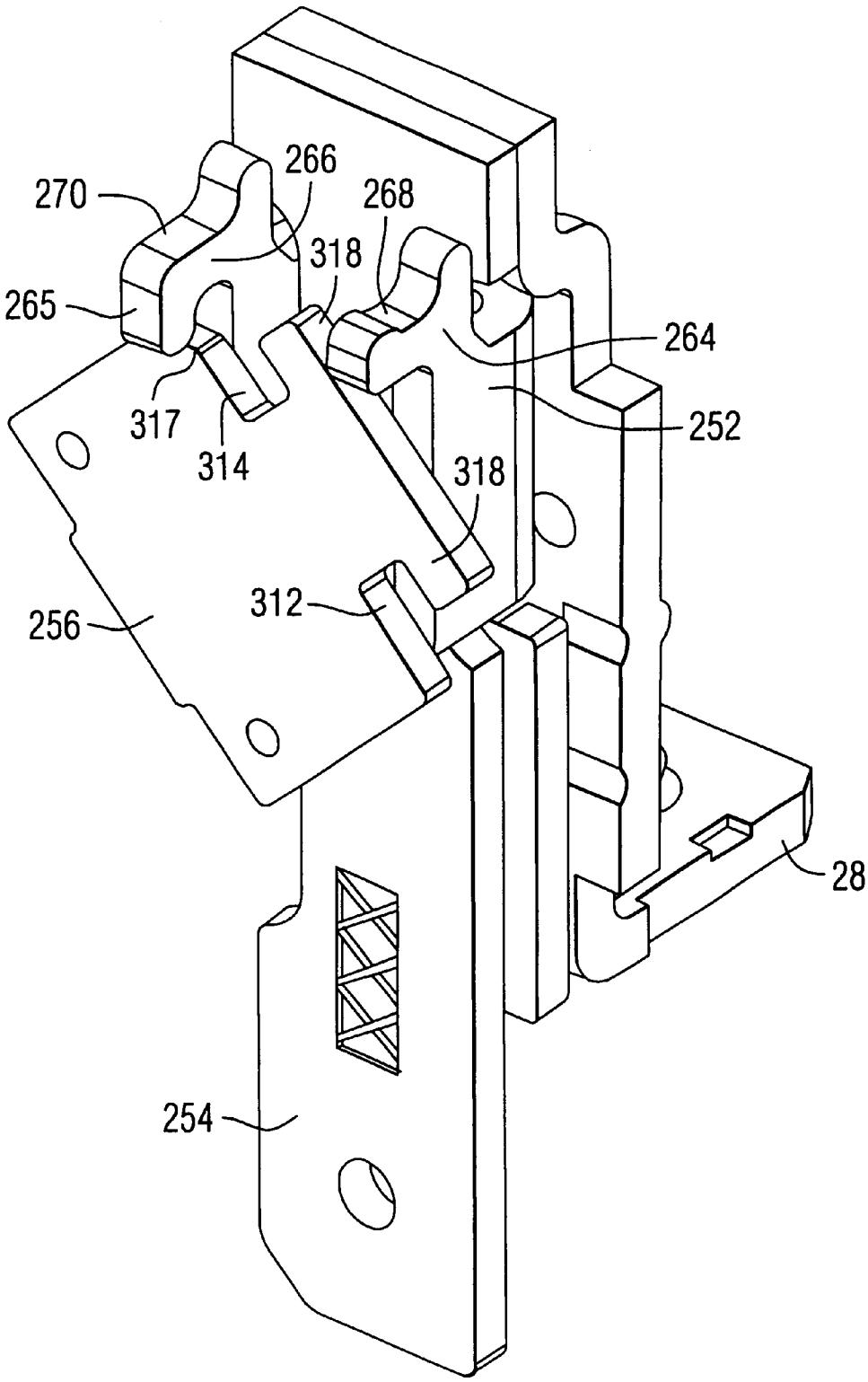
FIG. 18C is an orthogonal view of the automatic trip assembly shown in FIG. 18A showing the initial positioning step of its armature.

FIGS. 18A and 18B show automatic trip assembly 250 in assembled form. Neck 284 of bimetal 254 is positioned between arms 260 and 262 of yoke 252 whereby bimetal 254 is substantially parallel (but not in contact) with portion 258 of yoke 252. A screw 255 is shown partially screwed into one side of opening 288 in bottom portion 287 of bimetal 254, for reasons discussed below. Head portion 286 of bimetal 254 is connected to top region 296 of load terminal 28 by way of a conventional heat welding or brazing process. Curved region 298 of load terminal 28 is positioned above shoulder 272 of yoke 252, with planar portion 290 of terminal 28 parallel and in contact with planar portion 258 of yoke 252. Securing terminal 28 to yoke 252 are securing devices such as rivets 330 which are inserted into holes 274 of yoke 252 and corresponding holes 300 of terminal 28. Secured in this manner, terminal 28 advantageously has only one heat-affected zone which is in the area of top region 296. Positioned in contact with (seated in) pivot surfaces 268 and 270 of yoke 252 are pivot arms 318 of magnetic armature 256 for providing a limited range of motion of clapper 256, as discussed in more detail below. As seen in FIG. 18C, chamfered region or cutout 317 of armature 256 facilitates this positioning of the armature during the assembly process. Armature 256 is first tilted (as shown) with cutout 317 positioned below pivot support 266 and stop 265 thereof. Cutout 317 provides clearance that enables arm 318 above cutout region 314 to then be rotated into contact with pivot surface 270. Arm 318 above cutout region 312 can then be easily swung over the end of pivot support 264 and into contact with pivot surface 268. During operation of circuit breaker 10, pivot arms 318 are maintained in contact with pivot surfaces 268 and 270 by way of retaining member 263 and retaining protrusions 267 of yoke 252. Two springs 253 (only one is clearly shown) are attached to and disposed between holes 320 of clapper 256 and holes 302 of terminal 28, with curved ends or hooks 253A of springs 253 protruding through the holes and providing the attachment. Springs 253 have a tendency to maintain a predetermined distance between bottom portion 319 of magnetic clapper 256 and front faces 260A and 262A of magnetic yoke 252, and to maintain clapper 256 in a position that is rotationally displaced in a clockwise manner from vertical (away from yoke 252). As seen in FIG. 18A, stop or protrusion 265 of pivot support 266 is positioned to make contact with a clockwise rotated clapper 256 (near shoulder 315), defining a maximum angle of rotational displacement of clapper 256.

When implemented in circuit breaker 10 as shown in FIG. 7, automatic trip assembly 250 operates to cause a clockwise rotation of trip bar assembly 190, thereby releasing cradle 72 which leads to the TRIPPED disposition described above in connection with FIG. 8, whenever overcurrent conditions exist in the ON disposition. In the ON disposition as shown in FIG. 7, electrical current flows (in the following or opposite direction) from load terminal 28, through magnetic yoke 252 and bimetal 254, from bottom portion 287 of bimetal 254 to movable contact arm 50 through a conductive cord 289 (shown in FIG. 3) that is welded therebetween, through closed contacts 52 and 56, and from stationary contact arm 54 to line terminal 29. Automatic trip assembly 250 reacts to an undesirably high amount of electrical current flowing through it, providing both a thermal and a magnetic tripping operation.

The thermal tripping operation of automatic trip assembly 250 is attributable to the reaction of bimetal 254 to current flowing therethrough. The temperature of bimetal 254 is proportional to the magnitude of the electrical current. As current magnitude increases, the heat buildup in bimetal 254 has a tendency to cause bottom portion 287 to deflect (bend) to the left (as viewed in FIG. 7). When non-overcurrent conditions exist, this deflection is minimal. However, above a predetermined current level, the temperature of bimetal 254 will exceed a threshold temperature whereby the deflection of bimetal 254 causes bottom portion 287 to make contact with thermal trip bar or member 194 of trip bar assembly 190. This contact forces assembly 190 to rotate in the clockwise direction, thereby releasing cradle 72 which leads to the TRIPPED disposition. The predetermined current level (overcurrent) that causes this thermal tripping operation can be adjusted in a conventional manner by changing the size and/or shape of bimetal 254. Furthermore, adjustment can be made by selectively screwing screw 255 (FIG. 18A—not shown in FIG. 7) farther into opening 288 such that it protrudes to a certain extent through the other side of bimetal 254 (towards thermal trip member 194). Protruding as such, screw 255 is positioned to more readily contact thermal trip member 194 (and thus rotate assembly 190) when bimetal 254 deflects, thus selectively reducing the amount of deflection that is necessary to cause the thermal tripping operation.

Cutout regions 280 and 282 of bimetal 254 have rounded corners 280A and 282A (FIG. 20), respectively, which ease and facilitate the higher density downward current flow in those regions (during the ON disposition of circuit breaker 10) caused by the narrowing of the flow path of current between head portion 286 and neck 284. In an assembled automatic trip assembly 250, cutout region 282 extends down the length of bimetal 254 substantially past the bottom of arms 260 and 262 of magnetic yoke 252 (see FIG. 18A) in order to prevent interference with other internal and/or housing components positioned in close proximity thereto. In contrast, cutout region 280 extends to a point approximately just below the bottom of arms 260 and 262. This provides for a wider bimetal 254 below arms 260 and 262 of magnetic yoke 252 which reduces the susceptibility of those portions of bimetal 254 to increased eddy current effect heating that could cause an annealing or pitting of that area during high (interrupt) current conditions.

Automatic trip assembly 250 also provides a magnetic tripping operation. As electrical current flows through magnetic yoke 252, a magnetic field is created having a strength that is proportional to the magnitude of the current. This magnetic field generates an attractive force that has a tendency to pull magnetic clapper 256 towards front faces 260A and 262A of yoke 252. The magnitude of this attractive force is enhanced because, as described above, the body of clapper 256 is wider than the body of yoke 252. When non-overcurrent conditions exist, the tension provided by springs 253 connected between holes 320 of clapper 256 and holes 302 of load terminal 28 prevent any substantial rotation of clapper 256. However, above a predetermined current level, a threshold level magnetic field is created that overcomes the spring tension, compressing springs 253 and enabling bottom portion 319 of clapper 256 to forcefully rotate counterclockwise towards front faces 260A and 262A of yoke 252. During this rotation, bottom portion 319 of clapper 256 makes contact with magnetic trip bar or member 196 which, as shown in FIG. 7, is partially positioned between clapper 256 and front faces 260A and 262A of yoke 252. This contact moves the end of trip bar 196 substantially between curved arms 260 and 262 of yoke 252, thereby forcing trip bar assembly 190 to rotate in the clockwise direction. This leads to the TRIPPED disposition as described in detail above in connection with FIG. 8. As with the thermal tripping operation, the predetermined current level that causes this magnetic tripping operation can be adjusted. Adjustment may be accomplished by implementation of different sized or tensioned springs 253 that are connected between bottom portion 319 of clapper 256 and load terminal 28.

In FIGS. 7, 18A, and 18B, it can be seen that portions 258 and 258A of magnetic yoke 252 substantially extend between bimetal 254 and load terminal 28. This positioning of metallic magnetic yoke 252 causes a general reshaping of the magnetic flux lines that are generated by the oppositely flowing currents in terminal 28 and bimetal 254 during the ON disposition of circuit breaker 10. By reshaping the flux lines, this configuration limits the interference between the flux lines, thereby reducing the outward blowoff force between terminal 28 and bimetal 254 that is generated during high (interrupt) current conditions. This reduction in blowoff force reduces the likelihood of the force causing terminal 28 and bimetal 254 to undesirably break apart during such high current conditions.

Figure 28A:
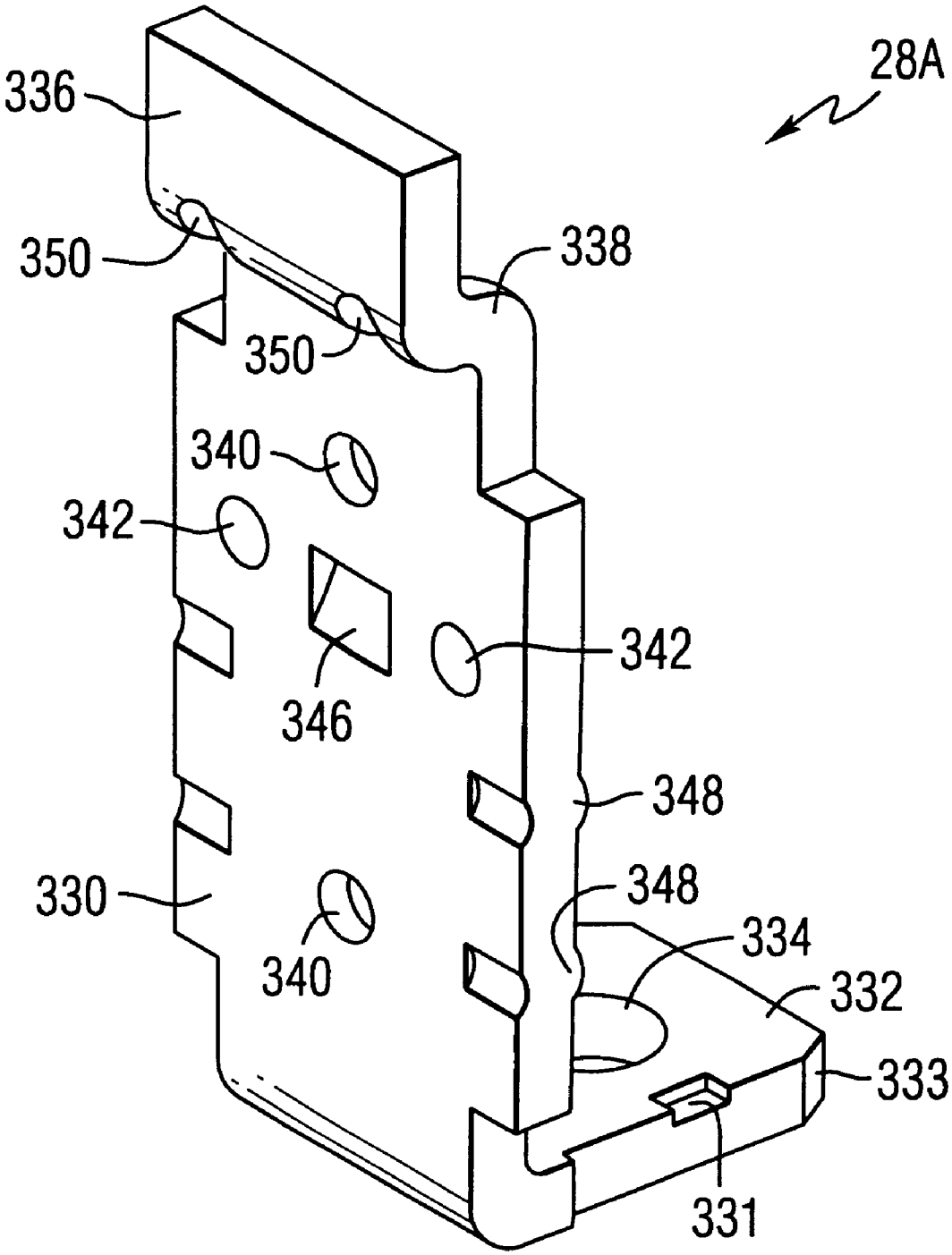
FIG. 28A is an orthogonal view of another embodiment of the load terminal that may be implemented in the automatic trip assembly of the trip mechanism of the circuit interrupter.
Figure 28B:
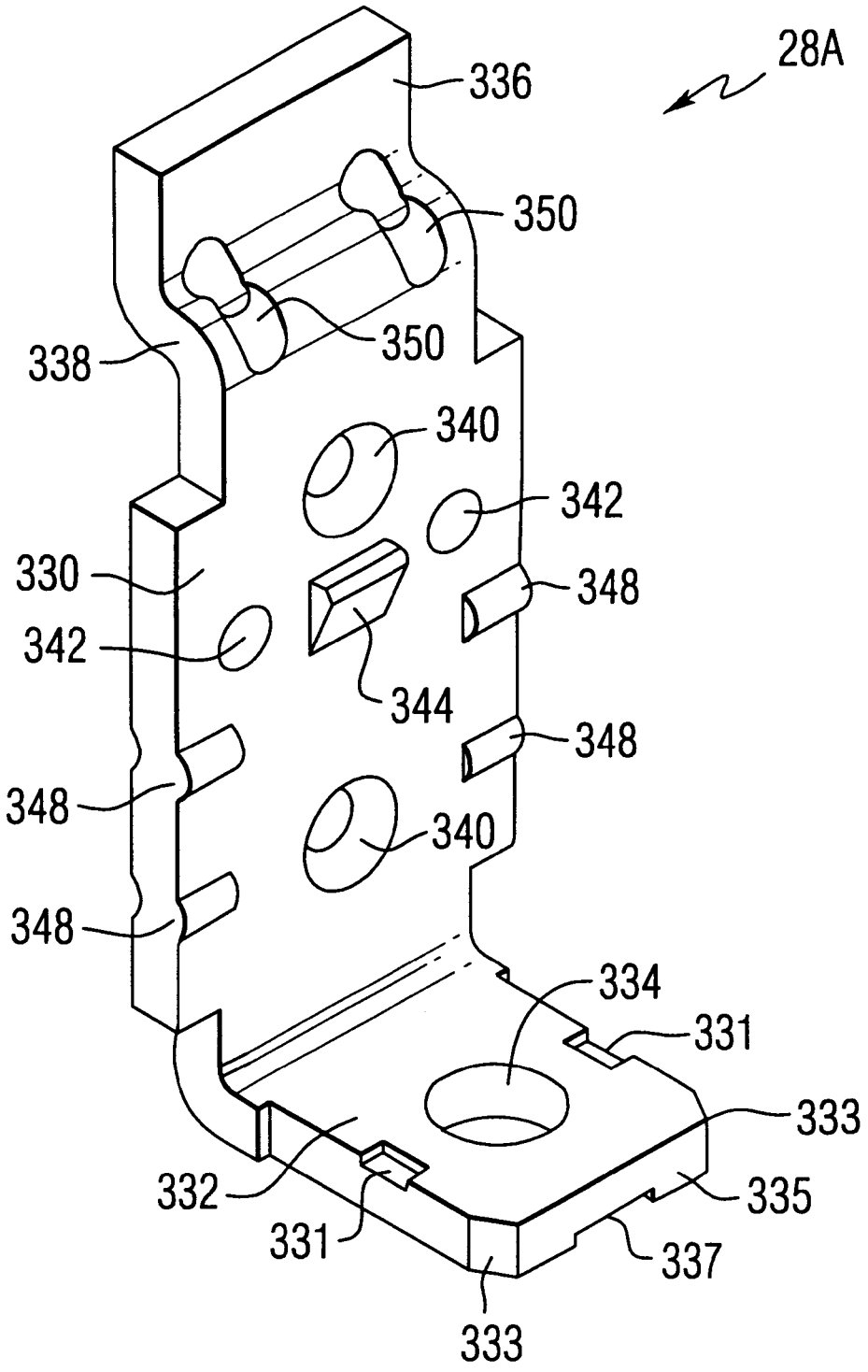
FIG. 28B is another orthogonal view of the alternative embodiment of the load terminal shown in FIG. 28A.
Figure 28C:
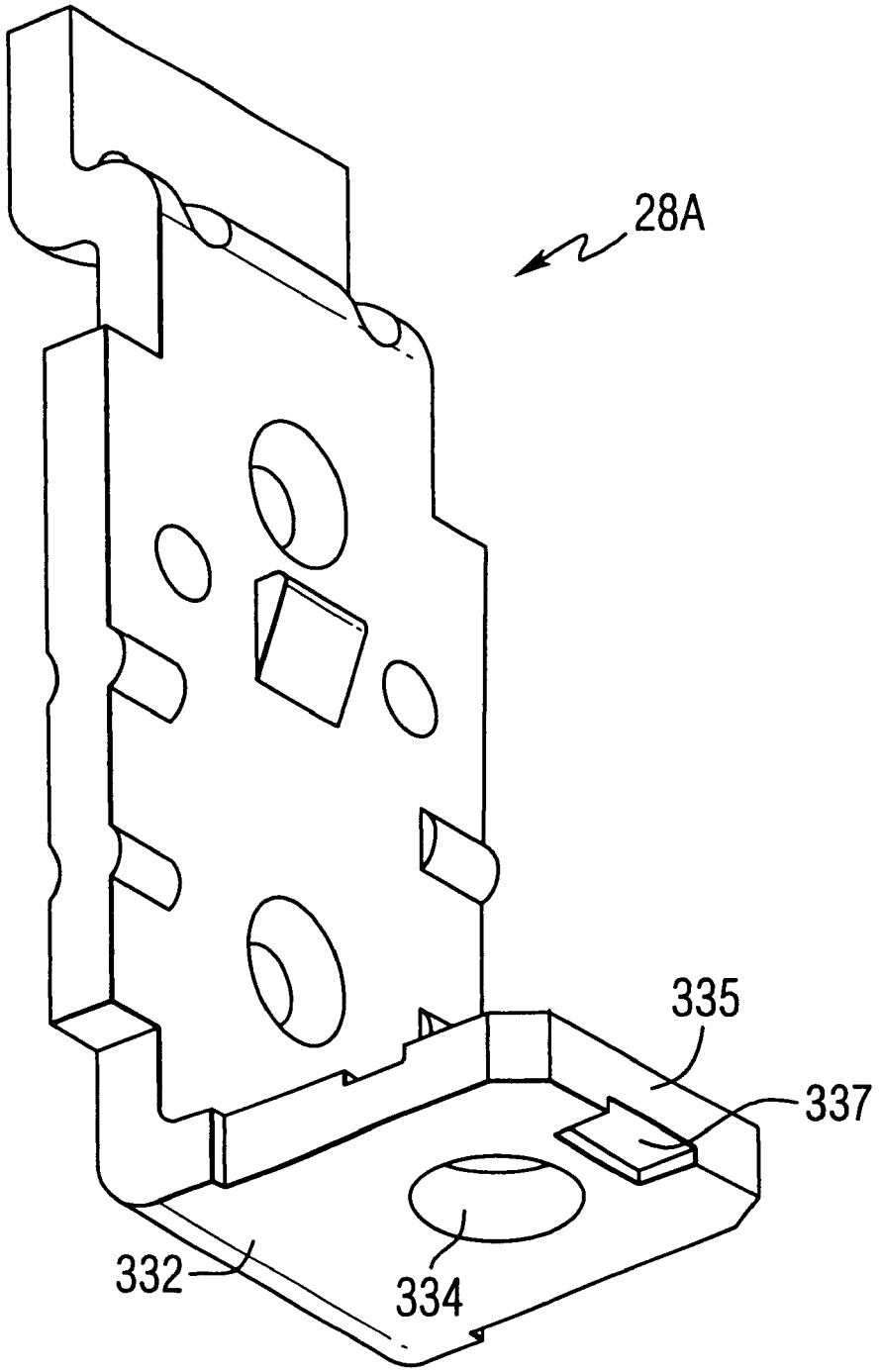
FIG. 28C is another orthogonal view of the alternative embodiment of the load terminal showing the underside of the connector portion.

FIGS. 22A and 22B depict an embodiment of load terminal 28 that may be used in circuit breaker 10. That embodiment, formed of stamped stainless steel having a thickness of approximately 0.047 inches, is most useful in applications where electrical current will normally be below approximately 30 amps. For higher current applications, another embodiment of a load terminal may advantageously be used, as shown in FIGS. 28A, 28B, and 23C. In order to better accommodate the higher currents, terminal 28A of this embodiment is formed of stamped copper or brass of an increased thickness of approximately 0.093 inches. Terminal 28A includes a substantially planar portion 330 (again tapered) from which protrudes, in approximately perpendicular fashion, a bottom connector portion 332 with a hole or opening 334 extending therethrough. Connector 332 also includes indents 331 on the top thereof, cutouts 333 that cause front face 335 to have a smaller width than the rest of connector 332, and a notch or cutout 337 extending from the bottom of front face 335 towards opening 334, as shown in FIG. 28C. Located at the other end of terminal 28A is a top substantially planar region 336 which is offset from portion 330 via a curved region 338. Formed through portion 330 are holes or openings 340 (for securement to magnetic yoke 252) and holes or openings 342 (for attachment of the two springs 253). A tab or protrusion 344 (having the same purpose as protrusion 306 of terminal 28) protrudes from one side of portion 330, with a corresponding cavity 346 on the other side. Ribbed portions 348 are also formed in portion 330 for the reasons described above with respect to ribbed portions 308 of terminal 28. Ribbed portions 348 are not as pronounced as ribbed portions 308 due to the general increased thickness of terminal 28A as compared to terminal 28, although they provide a similarly snug fit within channels 520 of base 12. Also shown are support ribs 350 for enhancing the strength of curved region 338. The operation of terminal 28A within circuit breaker 10 and, in particular, automatic trip assembly 250, is essentially the same as described above in connection with terminal 28.

Figure 29:
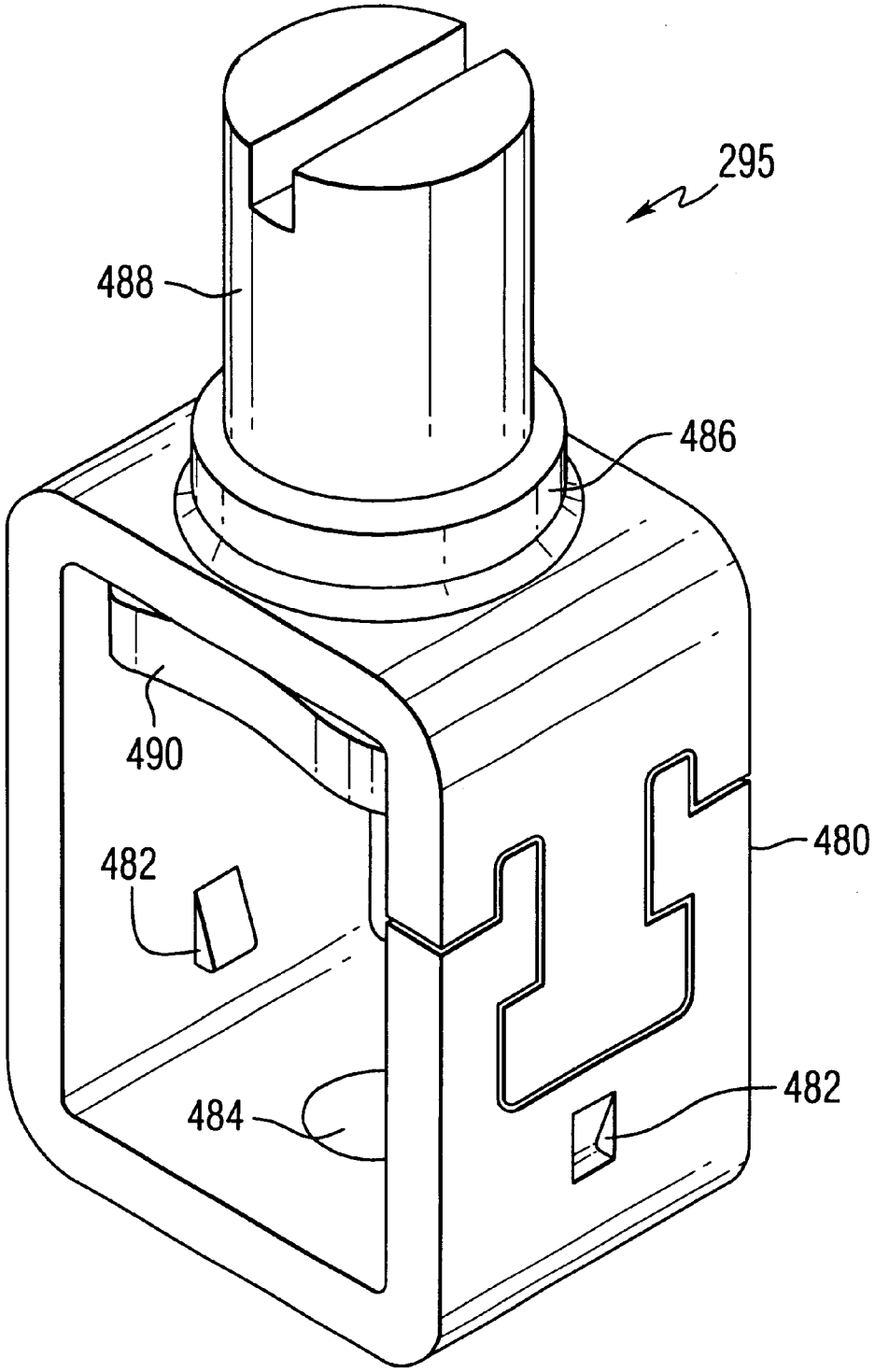
FIG. 29 is an orthogonal view of the self-retaining collar used in connection with the line and load terminals of the circuit interrupter of FIG. 1.

Referring now to FIG. 29, shown is an example self-retaining collar 295 that may be used with either load terminal 28 (or 28A) or line terminal 29 to connect external conductors thereto. Collar 295 includes a base portion 480 having a substantially open-ended square shape. Base 480 includes inwardly-facing detents or protrusions 482 formed in the two vertical sides thereof, and an upwardly-facing circular protrusion or raised surface 484 formed on the bottom. A neck 486 is formed on the top of base 480, defining an opening through which a top portion 488 is inserted. In the exemplary embodiment, top portion 488 is a screw having a clamp portion 490 rotatably connected to the bottom thereof.

In use, collar 295 is connected onto the end of one of the terminals of circuit breaker 10. Describing this connection with respect to load terminal 28 shown in FIGS. 22A and 22B, connector portion 292 of terminal 28 is inserted into base 480 such that raised surfaces 297 abut detents 482, and until opening 294 is engaged by circular protrusion 484. Cutouts 299 of terminal 28 facilitate this insertion because they enable front face 301, which has a width that is smaller than the inner width of base 480, to easily slide in and "channel" the remainder of connector 292 therein. Protrusion 484 of collar 295 provides an interference fit with opening 294 that resists lateral movement of the collar relative to terminal 28. Detents 482 of collar 295 prevent vertical movement of the collar relative to terminal 28, and the enhanced frictional engagement provided by raised surfaces 297 of connector 292 also resists lateral movement of the collar relative to terminal 28. Positioned as such (as shown in FIG. 4), collar 295 is in a self-retained disposition.

Describing the connection of collar 295 with respect to load terminal 28A shown in FIGS. 28A and 28B, connector portion 332 of terminal 28A is likewise inserted into base 480 such that its top surface abuts detents 482, and until opening 334 is engaged by circular protrusion 484. Like cutouts 299 of terminal 28, cutouts 333 of terminal 28A facilitate this insertion and provide a similar channeling effect for the remainder of connector 332. Notch or cutout 337 of connector 332 also facilitates the insertion because it is appropriately sized and configured to channel circular protrusion 484 of collar 295 under connector 332 which is beneficial since connector 332 is of increased thickness as compared to connector 292 of terminal 28. Protrusion 484 of collar 295 provides an interference fit with opening 334 that resists lateral movement of the collar relative to terminal 28A. Detents 482 of collar 295 snap into indents 331 of connector 332, providing an interference fit that also resists lateral movement of collar 295 relative to terminal 28A, with detents 482 also preventing vertical movement of collar 295 relative to terminal 28A. A self-retained disposition of collar 295 is thus realized.

After collar 295 is connected onto the end of one of the terminals of circuit breaker 10, the end of an external conductor can then be inserted between clamp 490 and the top surface of the terminal's connector portion. Clamp 490 can then be lowered by means of rotation of screw 488 until the clamp frictionally secures the external conductor to the terminal. External access to screw 488 is provided by way of one of holes 20 in cover 14 (FIG. 1) which enables a tool such as a screwdriver to be inserted and to appropriately manipulate screw 488.

Figure 30A:
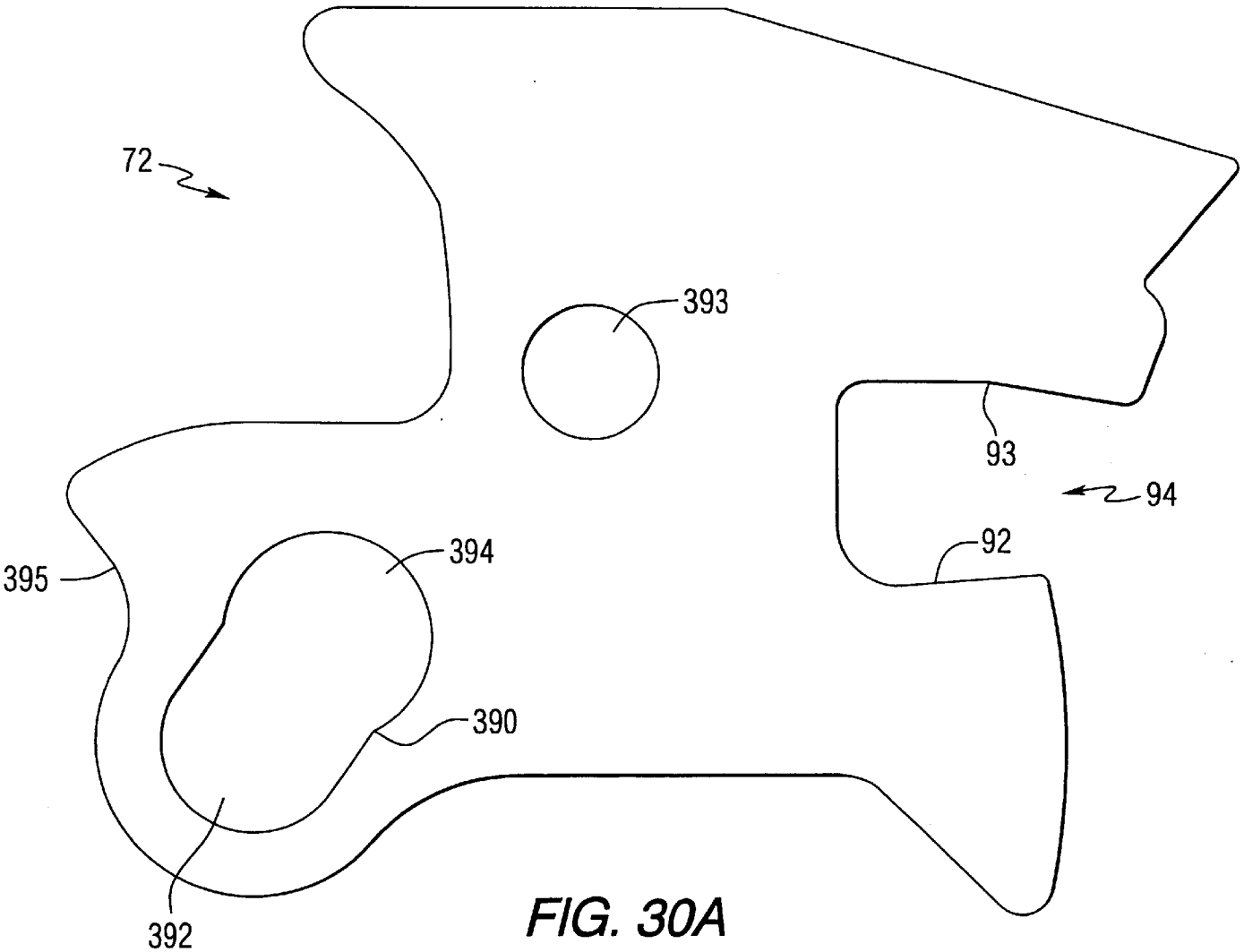
FIG. 30A is a side elevational view of the cradle of the operating mechanism of the circuit interrupter.
Figure 30B:
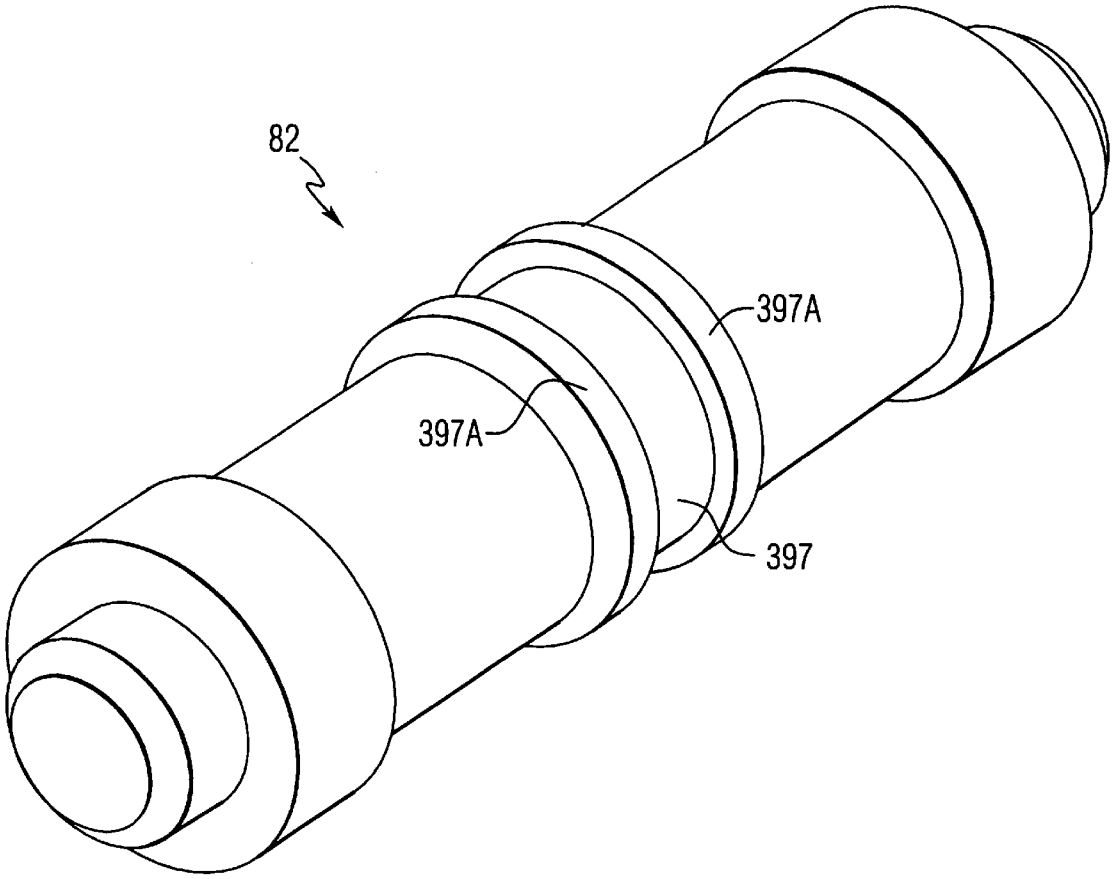
FIG. 30B is an orthogonal view of the cradle pivot pin of the operating mechanism of the circuit interrupter shown in FIG. 1.

Referring now to FIGS. 30A and 30B, shown are cradle 72 and cradle pivot pin 82 of the present invention. As shown in FIGS. 12 and 13, pin 82 is laterally and rotatably disposed between sideplates 84 of circuit breaker 10, and provides a point of rotation for cradle 72. As shown in FIG. 30A, cradle 72 has an opening 393 through which upper toggle link pivot pin 78 extends. Cradle 72 also includes an aperture 390 consisting of a smaller cutout or hole 392 interconnected with (blending into) a larger cutout or hole 394. Larger cutout 394 is sized so as to be larger than the thickest diameter portion of pin 82. Before pin 82 is positioned between holes 396 and 398 of sideplates 84 (see FIG. 13), pin 82 is easily inserted midway through larger cutout 394 of aperture 390. Because substantial pressure is not required in order to insert pin 82 through cutout 394, pin 82 may advantageously be heat-treated for strength so that it is more capable of withstanding the higher internal temperatures sometimes encountered in circuit breakers. As shown in FIG. 30B, pin 82 includes a stepped-inward portion 397 midway along its length. Pin 82 (presently inserted in larger cutout 394) is then shifted such that portion 397 becomes seated into smaller cutout 392, cutout 392 being sized to provide engagement therewith while at the same time, in the exemplary embodiment, enabling pin 82 to rotate therein. Because portions 397A of pin 82 around stepped-inward portion 397 are too thick to fit within smaller cutout 392, they provide shoulders which ensure that cradle 72 remains centered on pivot pin 82. When pin 82 is then rotatably positioned between holes 396 and 398 of sideplates 84, cradle 72 is able to rotate during the tripping and resetting operations of circuit breaker 10 described above. This rotation can occur in one of two manners: cradle 72 may rotate on (independently of) pin 82, or cradle 72 may rotate with pin 82 (within holes 396 and 398 of sideplates 84). These two methods of rotation are advantageous in that they provide increased flexibility to the operation of operating mechanism 38. In particular, proper rotation of cradle 72 can still occur even if pin 82 somehow locks up and cannot rotate within holes 396 and 398 of sideplates 84.

During the assembly process, stop bar 88 serves to help maintain the engagement of stepped-inward portion 397 of pivot pin 82 with smaller cutout 392 of cradle 72. As shown in FIGS. 6 and 8, stop bar 88 is positioned close to, and substantially to the left and below, an indent or cutout portion 395 of cradle 72 when the cradle is in an assembly-conducive position as depicted. Positioned as such, stop bar 88 has a tendency to abut indent 395 if cradle 72 moves downwardly and/or to the left, thus preventing substantial movement in those directions which could result in a loose seating of pivot pin 82 in larger cutout 394. In the totally assembled circuit breaker 10, the pair of side-by-side compression springs (not shown) acting upon cradle 72 provide a spring force which also serves to keep smaller cutout 392 engaged with stepped-inward portion 397 of pivot pin 82. Although stop bar 88 and the pair of side-by-side compression springs maintain the aforementioned engagement, they nonetheless enable a little "give" to exist in that engagement whereby cradle 72 may advantageously move a small distance about pivot pin 82 which provides increased flexibility to the operation of operating mechanism 38.

Referring again to FIGS. 12 and 13, stop bar 88 is shown laterally disposed between sideplates 84. Stop bar 88 includes ends 450 which are, in the exemplary embodiment, of a smaller diameter than the main portion of bar 88 and separated therefrom by shoulders 452. During assembly, ends 450 are inserted into holes 454 of sideplates 84 until shoulders 452 (which have a larger diameter than openings 454) contact inner surfaces 84B of sideplates 84. After this insertion, portions 450A of ends 450 protrude out of holes 454 along the outer surfaces 84A of sideplates 84. A machine, such as an orbital riveter, is then used to inwardly spin press portions 450A until outer shoulders 456 are formed (only one is shown) which, although of sufficient thickness to be structurally firm, are thin enough so that they are substantially flush with respect to outer surfaces 84A of sideplates 84. Because outer shoulders 456 have a larger diameter than openings 454, they cooperate with inner shoulders 452 to help maintain the spacing between sideplates 84. In particular, outer shoulders 456 will resist further outward separation of sideplates 84 potentially caused by, for example, forces generated during high current interruption. Inner shoulders 452 resist any inward movement of sideplates 84 (towards each other) that could potentially occur. This maintenance of the spacing between sideplates 84 serves to help ensure proper positioning and functioning of operating mechanism 38 components.

Also shown in FIGS. 12 and 13 is a support bar 460 laterally disposed between sideplates 84. Similar to stop bar 88, support bar 460 includes ends 462 which are, in the exemplary embodiment, of a smaller diameter than the main portion of bar 460 and separated therefrom by shoulders 464. During assembly, ends 462 are inserted into holes 466 of sideplates 84 until shoulders 464 (which have a larger diameter than openings 466) contact inner surfaces 84B of sideplates 84. After this insertion, portions 462A of ends 462 protrude out of holes 466 along the outer surfaces 84A of sideplates 84. A machine, such as an orbital riveter, is then used to inwardly spin press portions 462A until outer shoulders 468 are formed (only one is shown). Although outer shoulders 468 are of sufficient thickness to be structurally firm, they are thin enough to be substantially flush with respect to outer surfaces 84A of sideplates 84. Because outer shoulders 468 have a larger diameter than openings 466, they cooperate with inner shoulders 464, and with stop bar 88, to help maintain the spacing between sideplates 84, in the manner described above in connection with stop bar 88.

In a preferred embodiment, stop bar 88 and support bar 460 are formed of carbon steel metal. In addition, holes 466 for support bar 460 are preferably formed in areas of sideplates 84 that are substantially on the opposite side of where holes 454 are formed for stop bar 88. Such positioning of stop bar 88 and support bar 460 provides for proper spacing maintenance of sideplates 84 along their entire length. In the exemplary embodiment, support bar 88 is positioned between trip bar assembly 190 and crossbar assembly 60, the exact positioning and size thereof selected so that it does not interfere with rotation of those components. In other embodiments, additional support bars may, of course, be used in order to further ensure proper spacing between sideplates 84.

Figure 31:
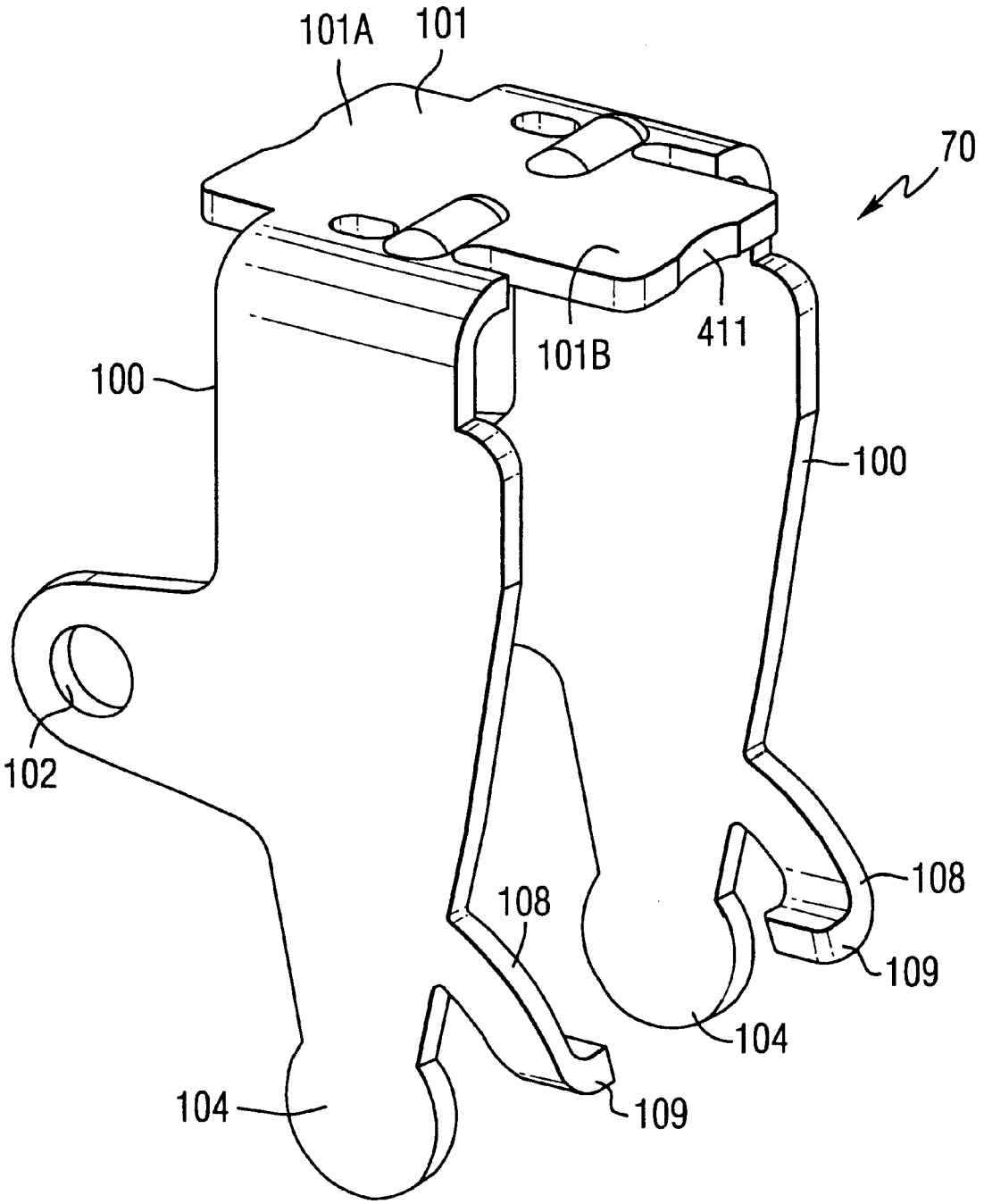
FIG. 31 is an orthogonal view of the handle assembly of the operating mechanism of the circuit interrupter shown in FIG. 1.

Referring now to FIG. 31 and again to FIGS. 12 and 13, shown are handle assembly 70 and associated parallel sideplates 84 of the sideplate or support member assembly of circuit breaker 10. Handle assembly 70 is formed of metal in the exemplary embodiment, and includes parallel and symmetrical handle assembly plates 100 that are connected together by a handle platform 101 that interconnects with handle 24 of circuit breaker 10 as described below. Each handle assembly plate 100 includes an opening 102 (only one of which is shown in FIG. 31) through which handle assembly roller 86 extends (FIG. 5), and each also includes a circular pivot region 104 that rotatably mates with a corresponding pivot surface cutout 106 (FIG. 12) in each sideplate 84. Also shown are handle assembly actuation tabs or protrusions 108 that protrude from the bottom of each handle assembly plate 100, each including an inwardly curved portion or contact member 109. Each sideplate 84 includes an actuation tab cutout region 110, including a bottom portion 111, that corresponds with each actuation tab 108 and provides for clearance thereof throughout a range of motion of handle assembly 70 during normal operation of circuit breaker 10, as described below. As shown in FIGS. 12 and 13, each sideplate 84 also includes an opening 105 into which is inserted the stem or shaft 107A of a stop or tab 107 having a head portion 107B. Stops 107 are configured so that they may be manufactured by a screw-machining process. The end of each stem 107A is spin pressed, for example by an orbital riveter, in order to secure stops 107 to sideplates 84, with head portions 107B positioned along the outer surfaces 84A of the sideplates and at least partially externally overlapping pivot surface cutouts 106. Secured as such, stops 107 prevent pivot regions 104 of handle assembly 70 from becoming outwardly disengaged from pivot surface cutouts 106 in sideplates 84 due to, for example, outward forces generated during high current interruption.

Figure 32:
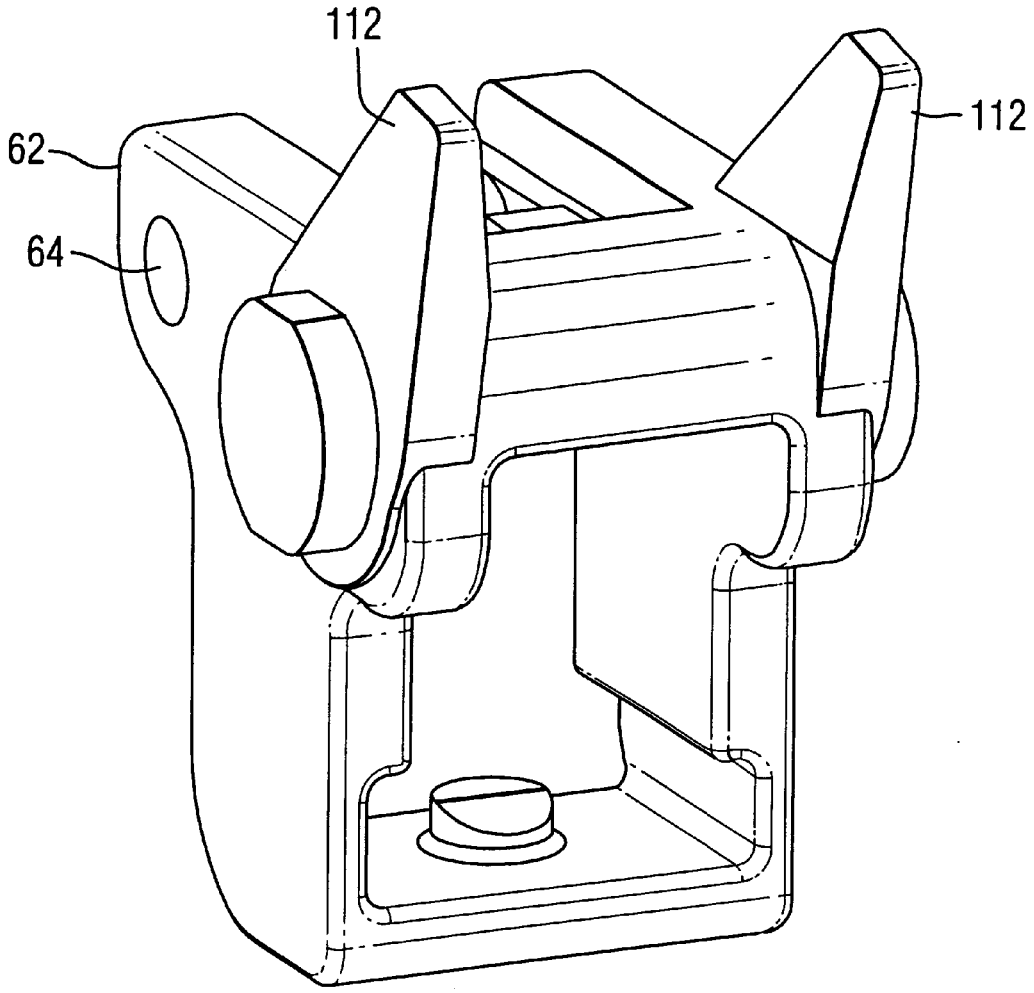
FIG. 32 is an orthogonal view of the cam housing of the crossbar assembly of the operating mechanism.
Figure 33:
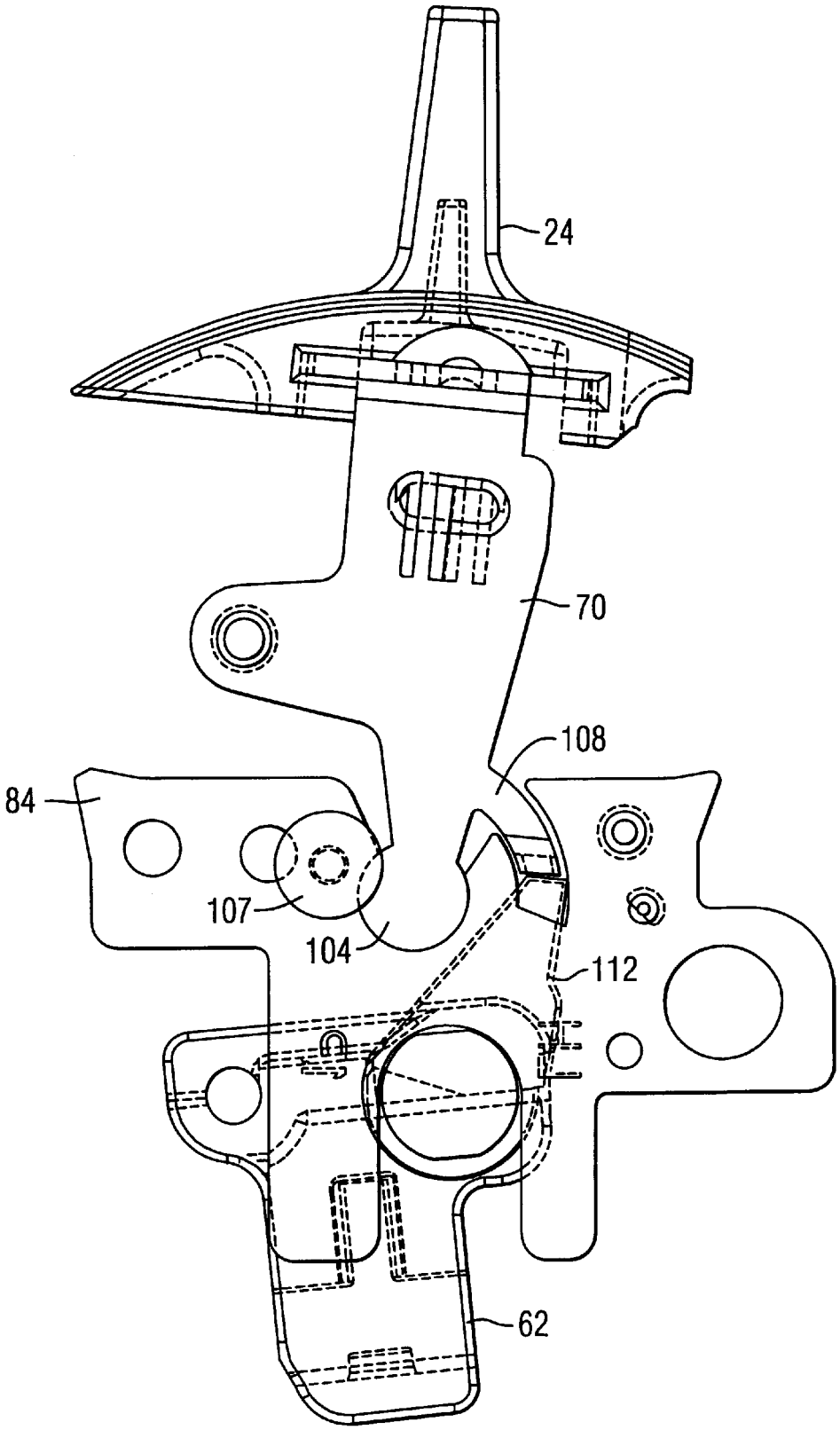
FIG. 33 is a side elevational, partially broken away view of an internal portion of the circuit interrupter showing the handle assembly, sideplate assembly, and crossbar assembly with associated stop members.

Referring now also to FIGS. 32 and 33, and again to FIGS. 6 and 7, shown in FIG. 32 is cam housing 62 of crossbar assembly 60 without a cam follower inserted therein. Disposed on and protruding generally from the top of cam housing 62 are stop members 112. FIG. 7 depicts the disposition of cam housing 62, sideplates 84, and handle assembly 70 when circuit breaker is in the ON disposition. Note that, in order to provide for a normal range of movement of handle assembly 70 towards an OFF position, actuation tabs or arms 108 are separated from the bottom portion 111 of cutout region 110. The tops of stop members 112 are internally positioned between sideplates 84 adjacent to actuation tab cutout regions 110 and not far below curved portions 109 of actuation tabs 108. As such, stop members 112 are positioned to abut against curved portions 109 when handle 24 is attempted to be moved clockwise towards an OFF position at a time when contacts 52 and 56 and crossbar assembly 60 nonetheless remain in the ON disposition (such as when contacts 52 and 56 are in a welded-closed disposition). This abutment (shown in FIG. 33), which occurs after a slight rotational movement of handle assembly 70, prevents further movement of assembly 70 in the clockwise direction (through the range of motion normally enabled by cutout regions 110), thereby preventing handle 24 from indicating that circuit breaker 10 in in the OFF disposition when in fact it is not. As such, a clear indication is provided that contacts 52 and 56 have not opened even though an opening operation has been attempted. However, in normal operation when contacts 52 and 56 can be opened, stop members 112 rotate clockwise with crossbar assembly 60 (and contact 52) when handle assembly 70 is moved clockwise towards the OFF position. As such, stop members 112 rotate away from actuation tab cutout regions 110, as shown in FIG. 6. This allows for full movement of actuation tabs 108 within regions 110 which, in turn, allows handle 24 to move to the OFF position.

Referring now also to FIGS. 34A, 34B, 34C, and 34D, shown is handle 24 of circuit breaker 10 which, in the preferred embodiment, is molded of an insulator material such as plastic. Handle 24 includes a top portion 403, and a base 404 having a top curvilinear surface 405 and a bottom cavity region 406. Cavity region 406 includes protrusions 408 that define two channels 407 into which sides 10A and 101B of handle platform 101 (FIG. 31) of handle assembly 70 are inserted (as shown in, for example, FIGS. 4, 5, and 6) to form an engagement connecting handle 24 to assembly 70. This connection enables manual movement of handle 24 to cause operating mechanism 38 to change disposition, as described above. Disposed approximately midway within one channel 407 (in the exemplary embodiment), between protrusions 408, is an integrally formed protrusion or nubb 409 (FIG. 34D) which, like the rest of handle 24, is preferably formed of an insulating material such as plastic which is at least partially compressible. Side 101B of platform 101 (FIG. 31) includes, approximately midway therein, an indent or cutout 411 of approximately the same size and shape as protrusion 409. When platform 101 of handle assembly 70 is inserted into channels 407, protrusion 409 will deform (compress) slightly as it travels over the flat portions of sides 101B. As shown in the exemplary embodiment, protrusion 409 is preferably rounded in shape so as to facilitate this travel. When platform 101 is fully inserted into channels 407, protrusion 409 will return to its normal shape and become seated within indent 411. As such, protrusion 409 and indent 411 serve to center the connection between handle 24 and handle platform 101. In addition, the frictional engagement of protrusion 409 with indent 411 serves to resist movement of platform 101 within channels 407, thereby providing a more secure connection between platform 101 and handle 24. In an alternative embodiment, a protrusion 409 may be disposed in each channel 407, with corresponding indents 411 formed in both of sides 101A and 101B of platform 101.

Figure 34A:
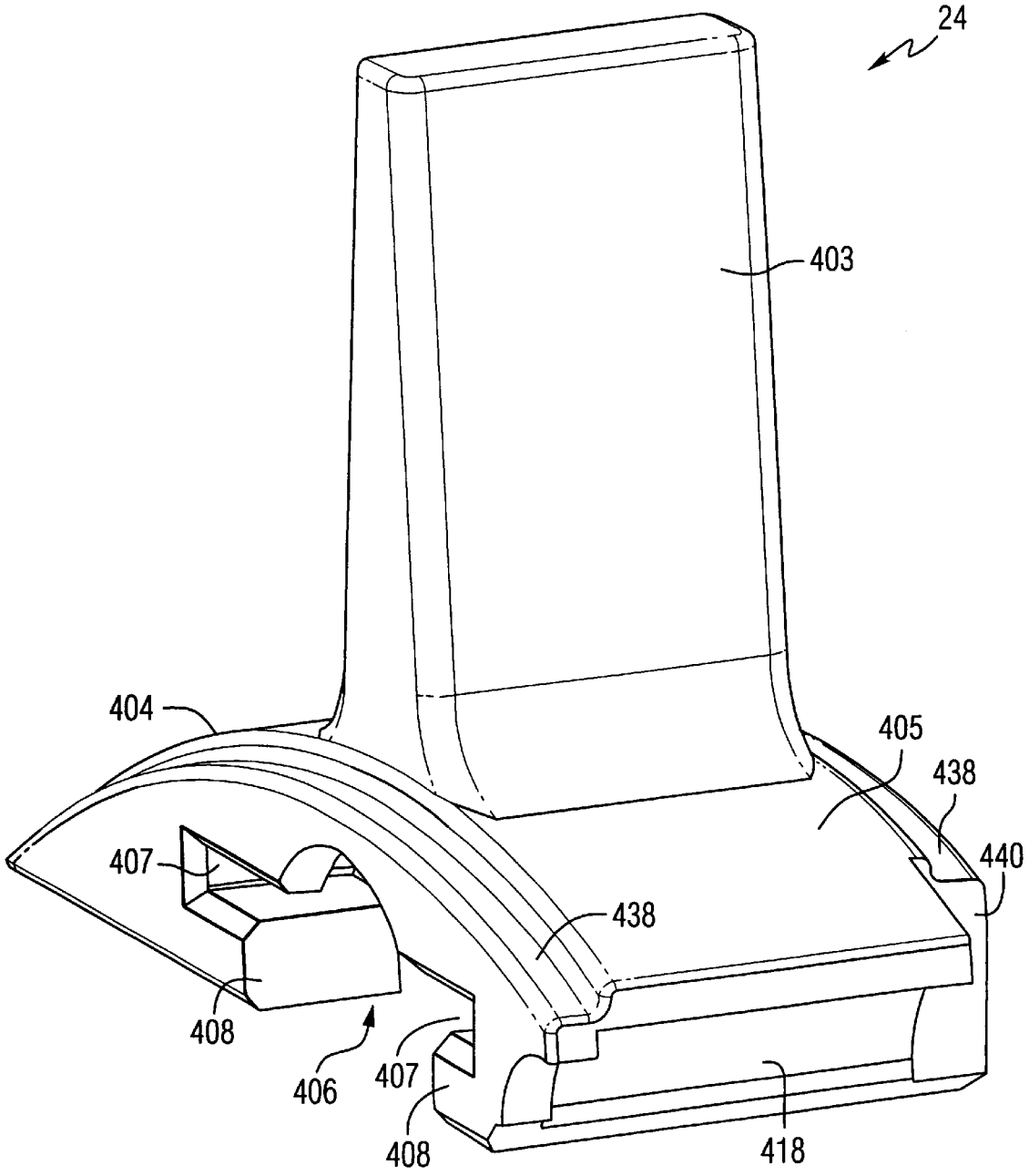
FIG. 34A is an orthogonal view of the handle of the operating mechanism of the circuit interrupter shown in FIG. 1.
Figure 34B:
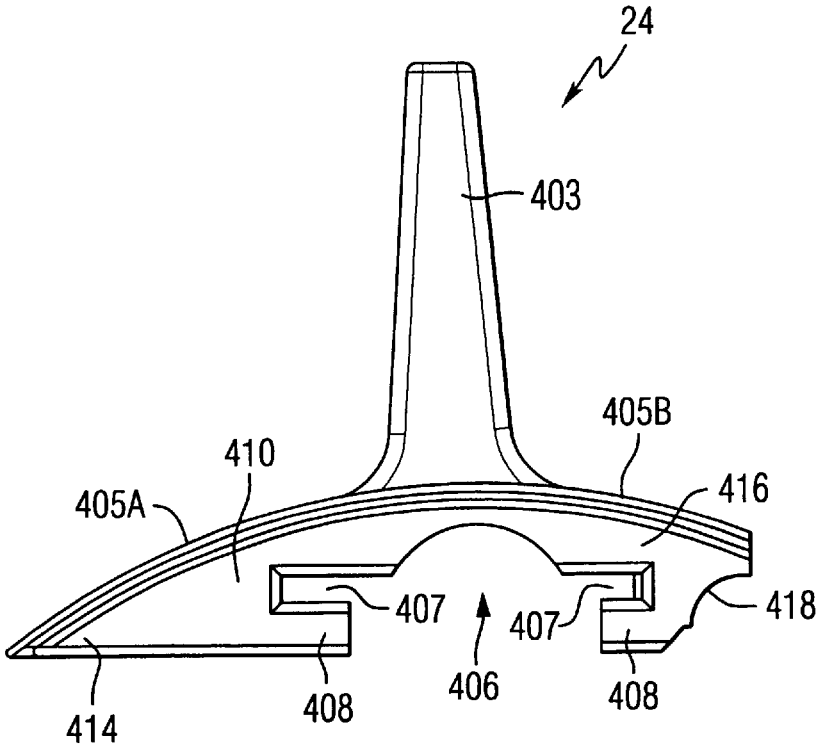
FIG. 34B is a side elevational view of the handle of FIG. 34A.
Figure 34C:
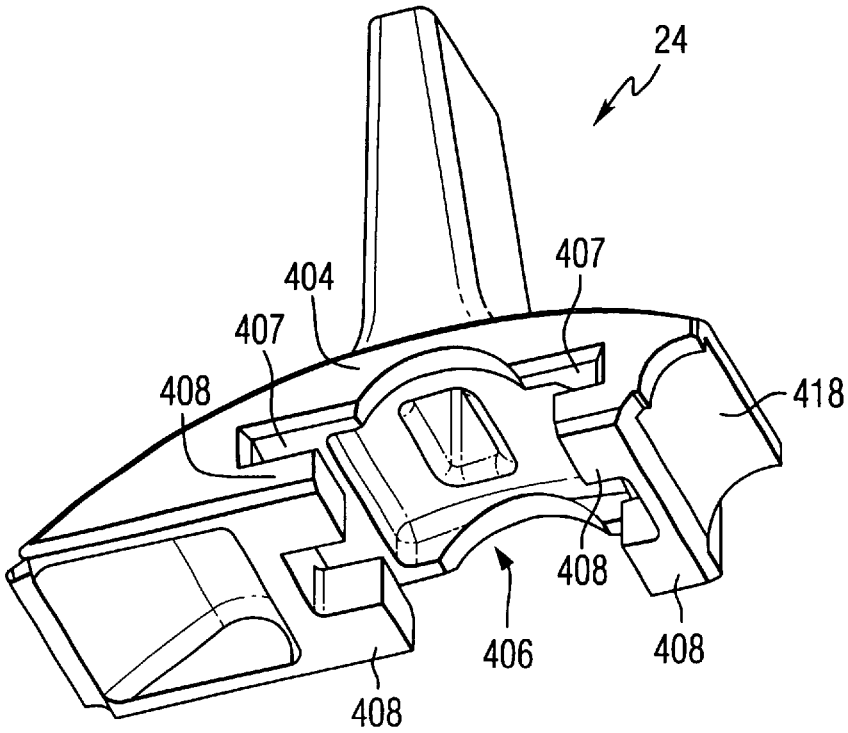
FIG. 34C is another orthogonal view of the handle of FIG. 34A.

As shown in FIG. 34B, base 404 of handle 24 includes a first side 410 with a curvilinear top surface section 405A and terminating with an end portion 414 which (in the exemplary embodiment) is substantially triangular in shape. A second side 416 is somewhat symmetrical to that of first side 410, except that it terminates with an end portion 418 that is truncated in comparison to end portion 414, providing a truncated curvilinear top surface section 405B. In the exemplary embodiment, end portion 418 is substantially concave in shape. Truncated end portion 418 clearly occupies less space than end portion 414, and is configured so as to not interfere (make contact) with other internal workings of circuit breaker 10 throughout the range of motion of handle 24. In particular, end portion 418 is configured so as to not interfere with automatic trip assembly 250 of trip mechanism 40 when circuit breaker 10 is in the OFF disposition or during a resetting operation, as shown in FIGS. 6 and 9, respectively.

Figure 35:
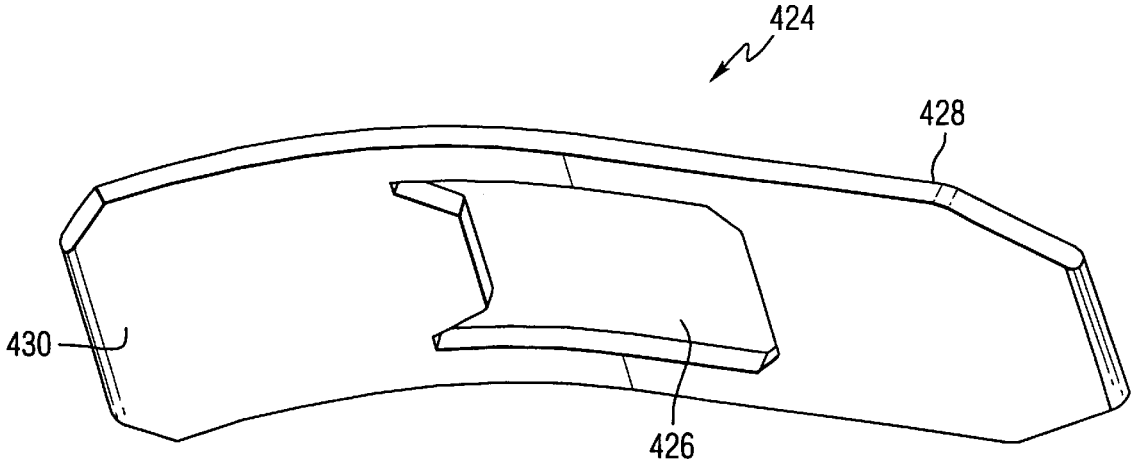
FIG. 35 is an orthogonal view of the handle slider of the operating mechanism of the circuit interrupter shown in FIG. 1.
Figure 36:
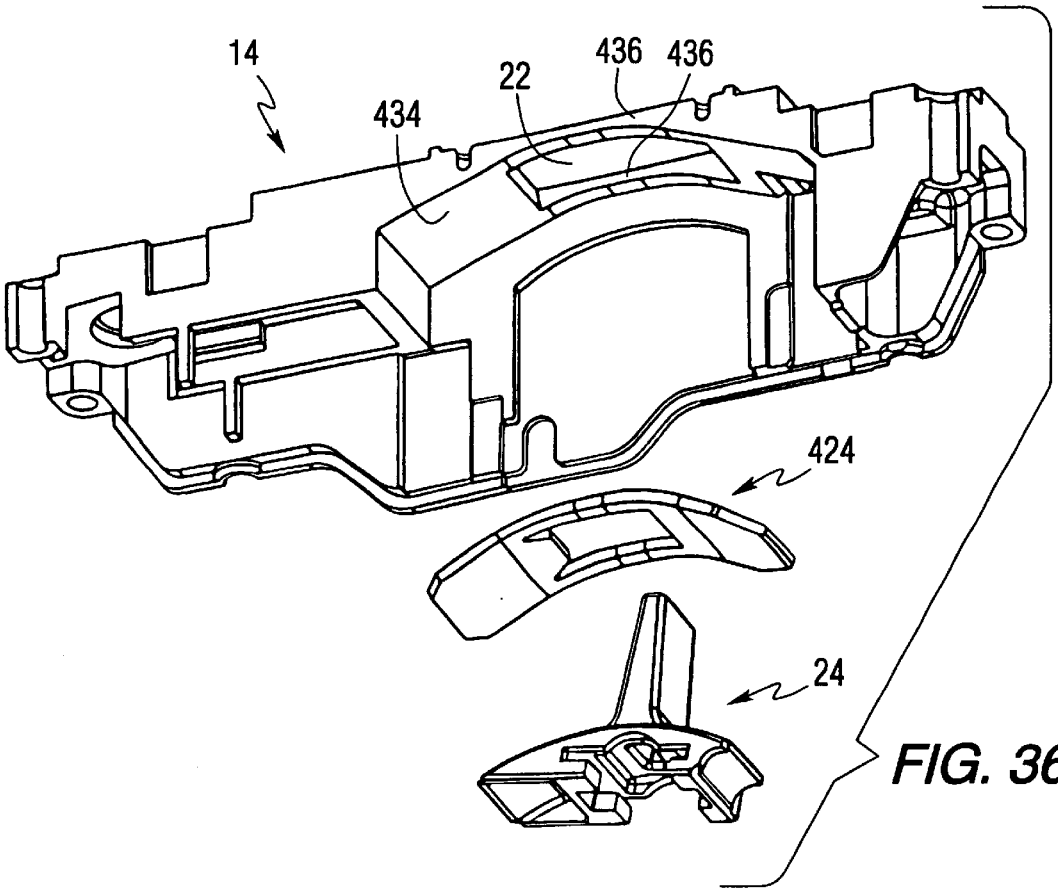
FIG. 36 is an exploded, partially broken away view of the cover, handle, and handle slider of the circuit interrupter of FIG. 1.
Figure 37:
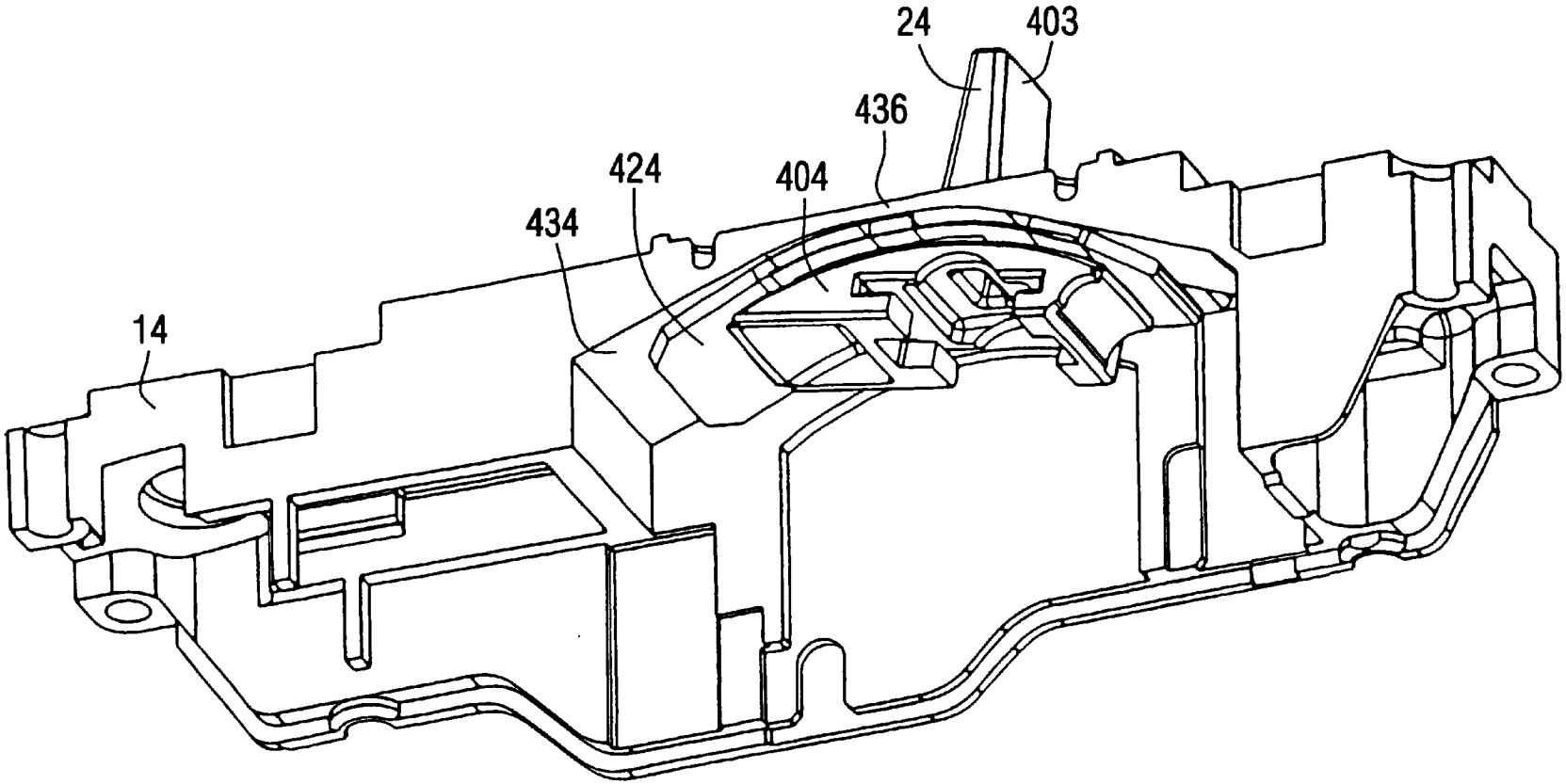
FIG. 37 is an orthogonal, partially broken away view similar to FIG. 36 showing the engagement of the handle with the handle slider and the cover.

Referring now also to FIGS. 35–38, shown in FIG. 35 is a curved handle slider 424 having an opening 426, a convex top surface 428, and a concave bottom surface 430. Within circuit breaker 10, slider 424 is positioned in a substantially overlapping relationship with handle 24 whereby bottom surface 430 is placed on top of and substantially overlaps top surface 405 of handle 24, and top portion 403 of handle 24 protrudes through opening 426. As shown in FIGS. 36 and 37, handle 24 and overlapping slider 424 are positioned in relation to cover 14 whereby top portion 403 of handle 24 also protrudes through opening 22 of the cover. In a conventional manner, slider 424 moves along a bottom surface 434 of cover 14 as handle 24 is rotated through its range of motion. The overlapping relationship of slider 424 with handle 24, along with the fact that (in the exemplary embodiment) opening 426 of slider 424 is smaller than opening 22 of cover 14, provides a barrier which helps to prevent foreign items entered into opening 22 from reaching the internal workings of circuit breaker 10. For this purpose, slider 424 preferably is thick enough such that it will not easily flex inward. In a preferred embodiment, slider 424 is approximately 0.055 inches thick of celcon thermoplastic material. Although thick enough to resist significant inward flex, slider 424 is relatively thin compared to base 404 of handle 24, and is thin enough to arc or ride over automatic trip assembly 250 of trip mechanism 40 without interference (as can be seen in FIG. 3).

Figure 38:
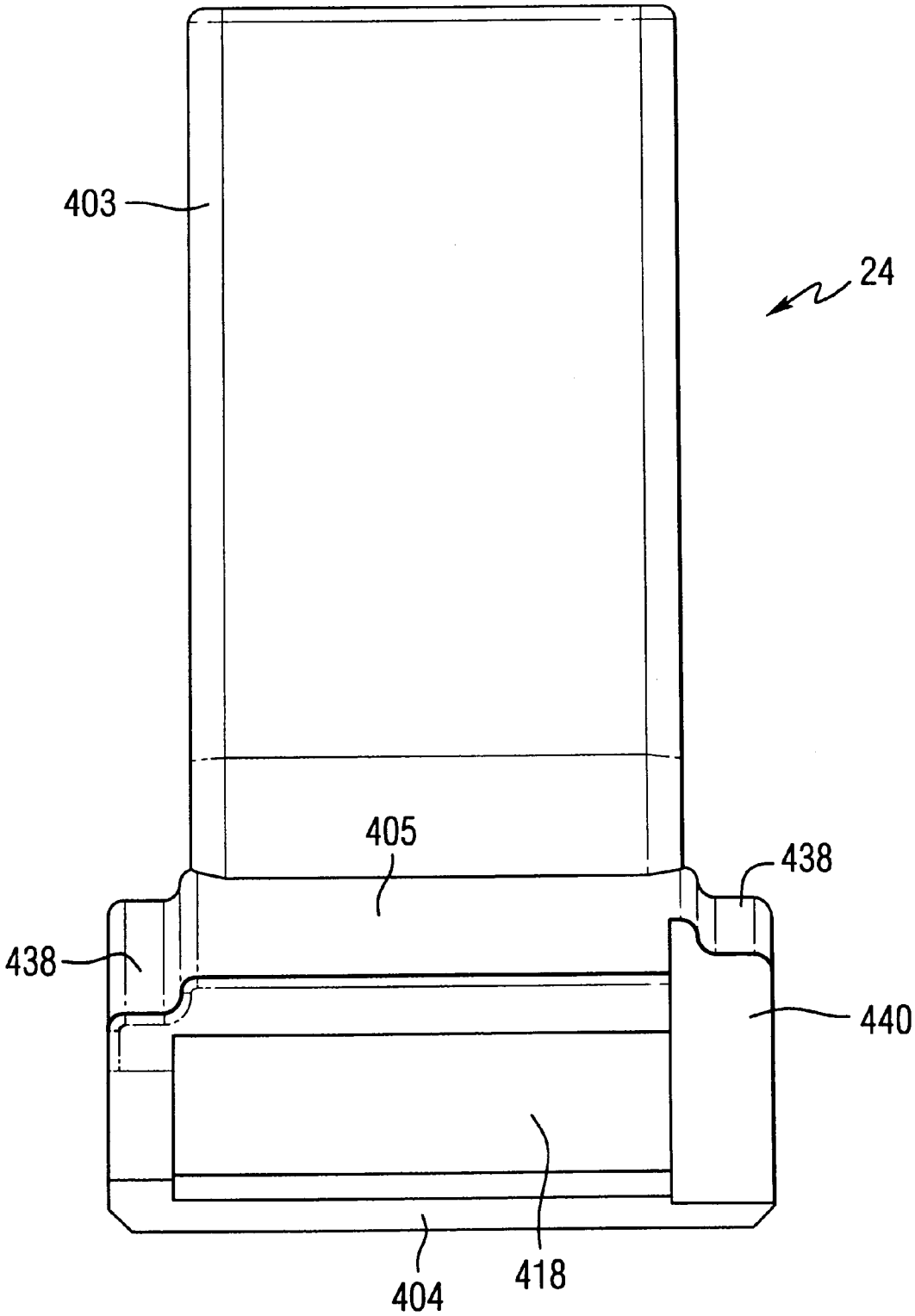
FIG. 38 is another orthogonal view of the handle of FIG. 34A showing the grooves for the handle slider.

As handle 24 is rotated through its range of motion, top surface 428 of slider 424 makes contact with bottom surface 434 of cover 14 along arches 436 thereof. This contact reduces the chances of separation that could compromise the barrier protection described above. As best shown in FIG. 38, base 404 includes grooves 438 that extend along the side edges of top surface 405 from end portion 414 to end portion 418. As top surface 428 of slider 424 makes contact with arches 436 of cover 14 throughout the range of motion of handle 24, this contact causes a slight deflection of the side edges of slider 424 into grooves 438. This deflection reduces the friction between slider 424 and bottom surface 434 of cover 14, enabling handle 24 to smoothly rotate through its range of motion. As such, grooves 438 enable a thicker slider 424 to be implemented than otherwise would be possible within the tight space constraints of circuit breaker 10, making the slider more resistant to inward flex and thus providing enhanced barrier protection. In the exemplary embodiment, grooves 438 are approximately 0.030 inches deep.

Figure 34D:
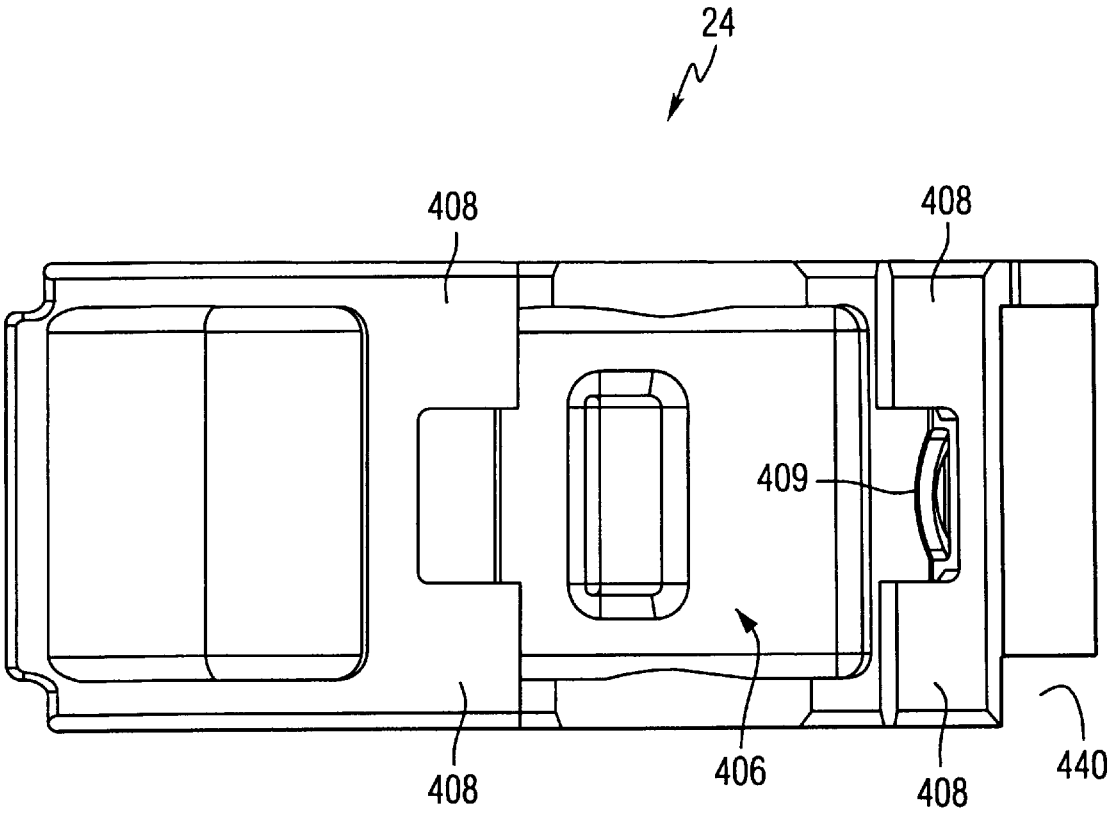
FIG. 34D is an underneath view of the handle of FIG. 34A.

In addition to having a truncated end portion 418, base 404 of handle 24 includes a cut-away section 440 near one corner of end portion 418, as best shown in FIGS. 34A and 34D. As shown in FIG. 15, cut-away section 440 provides clearance for button 25 of push-to-trip actuator 230, particularly when circuit breaker 10 is in the OFF disposition or during a resetting operation. As also shown in FIG. 15, working in conjunction with cut-away section 440 is cutout 238 of button 25 which is positioned to provide clearance for slider 424 (not shown) throughout the range of motion of handle 24. Cutout 238 is sufficiently large so that top portion 25A of button 25 can be depressed notwithstanding the presence of slider 424 within cutout 238. As such, cutout 238 of button 25 and cut-away section 440 of handle 24 cooperate in order to prevent interference between push-to-trip actuator 230 and the combination of handle 24 and slider 424.

Figure 39:
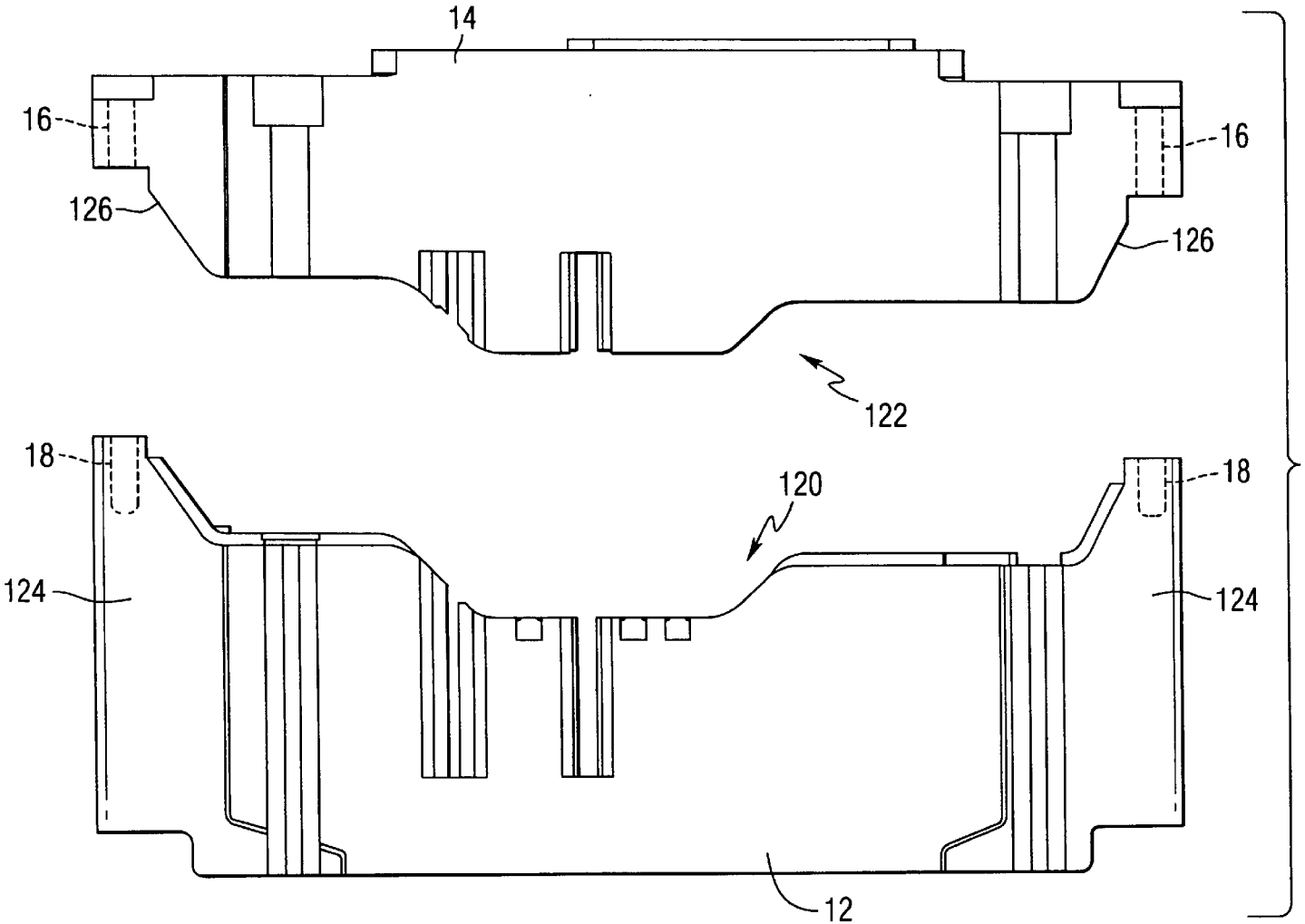
FIG. 39 is an exploded, profile view of the base and the cover of the circuit interrupter of FIG. 1.

Referring now to FIGS. 39 and 40, and again to FIG. 2, particular attention is directed to the profile between base 12 and cover 14 of circuit breaker 10. Base 12 is shown having a top region generally designated 120, and cover 14 is shown having a bottom region generally designated 122. Top region 120 of base 12 includes raised portions 124 that mate with corresponding cut-away or recessed portions 126 in bottom region 122 of cover 14. As shown in the side cross-sectional view of FIG. 40 taken along the line 40—40 of FIG. 1, when cover 14 is connected to base 12, appropriate attaching devices 128 (comprising mounting screws in the exemplary embodiment) are inserted into holes or openings 16 (FIG. 2) in cover 14 above recessed portions 126 and enter corresponding holes or openings 18 in raised portions 124 of base 12. Attaching devices 128 are selected so that, upon full insertion, the bottoms thereof do not substantially, if at all, penetrate base 12 below its raised portions 124. As such, this mounting arrangement conserves space within the main body of base 12 whereby attaching devices 128 do not interfere with the internal workings therein. The dimensions of raised portions 124 and recessed portions 126 are selected so that attaching devices 128 can nonetheless penetrate a sufficient depth into base 12 so as to provide a sufficiently strong connection between base 12 and cover 14. In one exemplary embodiment, attaching devices 128 are approximately 1 inch in length and penetrate approximately ½ inch into raised portions 124 of base 12.

Figure 40:
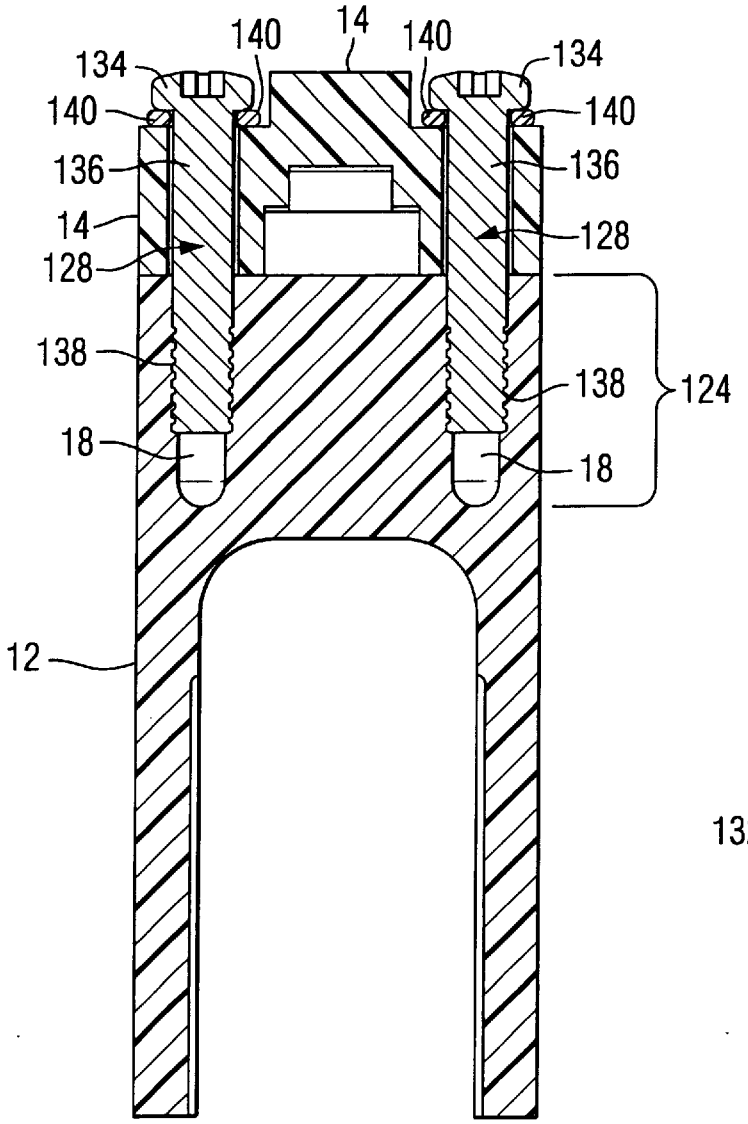
FIG. 40 is a cross-sectional view of the cover secured to the base, taken along the line 40—40 of FIG. 1.
Figure 41:
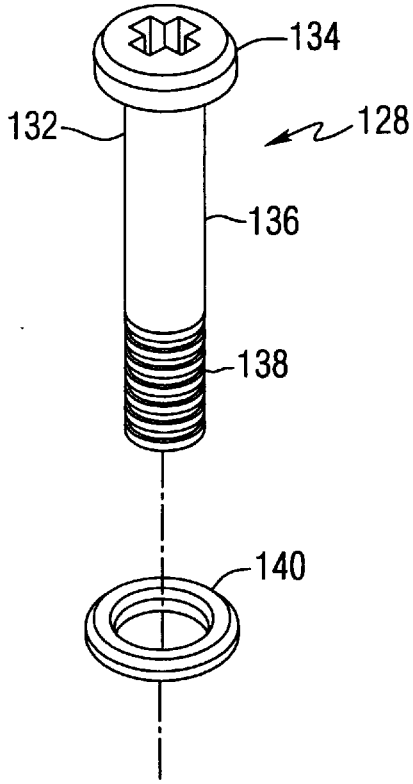
FIG. 41 is an orthogonal view of the attaching device used to secure the cover to the base.
Figure 42:
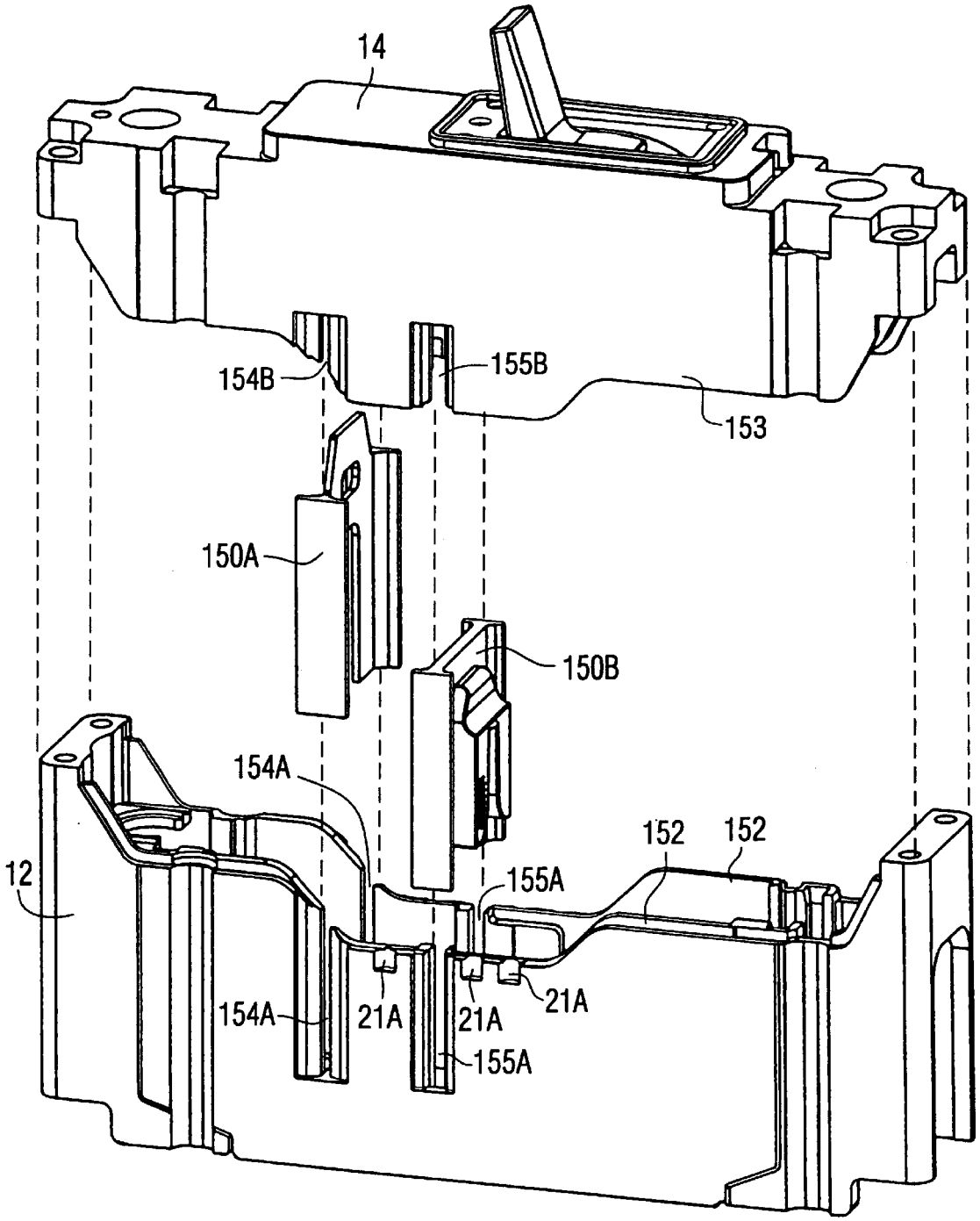
FIG. 42 is an exploded view of the cover and the base of the circuit interrupter of FIG. 1 and the support members thereof.

As shown in FIG. 40 and described above, attaching devices 128 provide a mounting arrangement between base 12 and cover 14. Referring now also to FIG. 41, attaching device 128 of the exemplary embodiment is shown including a main member 132 comprising a mounting screw with a head 134 and a body separated into a non-gripping (non-threaded) portion 136 and a gripping (threaded) portion 138. Attaching device 128 also includes a compressible member 140 that (when fully assembled) is adjacent to head 134 and engaged by non-threaded portion 136 of mounting screw 132. Compressible member 140 may be an elastomeric washer (as in the exemplary embodiment), or it may be another compressible device such as a spring. In the cross-sectional view of FIG. 40, attaching device 128 is shown assembled and inserted into opening 16 (FIG. 2) in cover 14 and corresponding opening 18 in base 12. FIG. 40 shows gripping portion 138 extending into and attaching with base 12, non-gripping portion 136 extending through cover 14, and head 134 providing a stop for limiting the possible separation between base 12 and cover 14. Compressible member 140 is shown in a position between head 134 and a top surface of cover 14. In this mounting arrangement, the compressibility of member 140 permits base 12 and cover 14 to temporarily and substantially instantaneously separate a small distance when pressure develops within circuit breaker 10 such as due to the generation of gases during high current interruption (opening of contacts 52 and 56). This separation along the interface between base 12 and cover 14 allows the generated gases to be vented, providing a pressure release that protects the structural integrity of circuit breaker 10.

Figure 43:
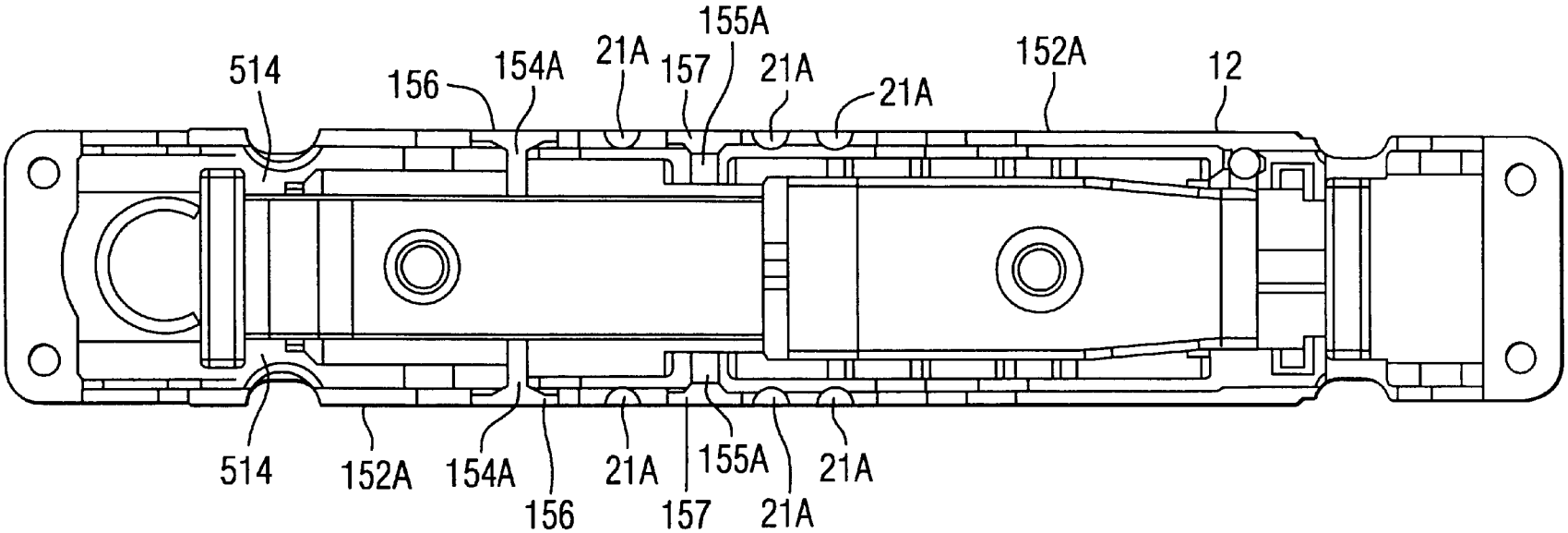
FIG. 43 is an overhead view of the base showing the slots and grooves therein associated with the support members shown in FIG. 42.

Referring now to FIGS. 42, 43, 44A, 44B, 45A, 45B, 45C, and 46, shown are support members 150A and 150B of circuit breaker 10 in connection with base 12 and cover 14. Base 12 includes sidewalls 152 within which are formed slots 154A and 155A. As shown in FIG. 43 which depicts a top view of base 12 without components therein, sidewalls 152 also include grooves or channels 156 adjacent to slots 154A, and grooves or channels 157 adjacent to slots 155A, both formed on the outer surfaces 152A of sidewalls 152. Base 12 also includes small recesses 21A formed in the top of sidewalls 152. Cover 14 includes sidewalls 153 (only one of which is viewable in FIG. 42) within which are formed slots 154B and 155B which align with slots 154A and 155A, respectively, of base 12 when cover 14 is positioned on top of base 12. Sidewalls 153 also include grooves or channels that are similar to channels 156 and 157 of base 12.

Figure 44A:
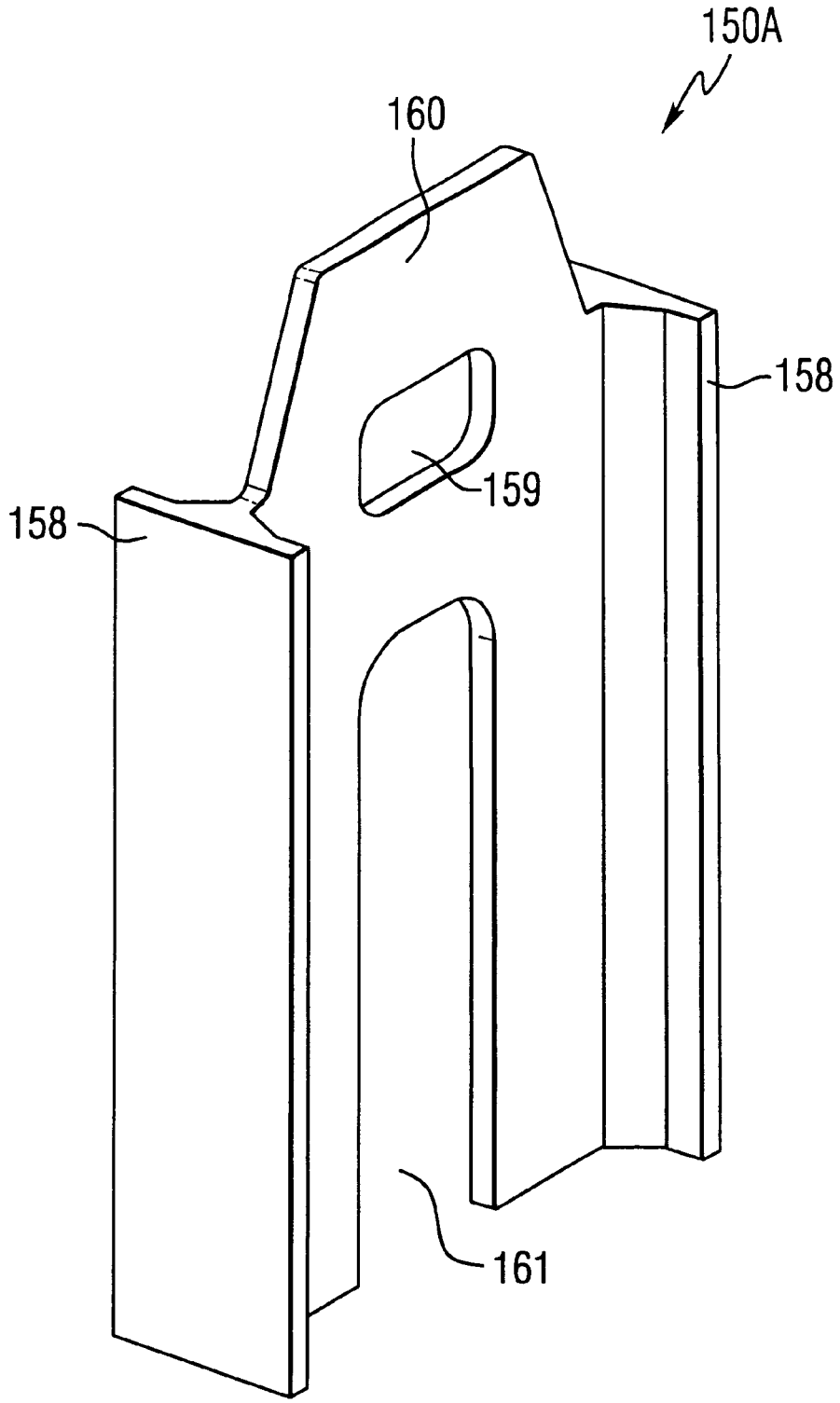
FIG. 44A is an orthogonal view of one of the support members shown in FIG. 42.
Figure 44B:
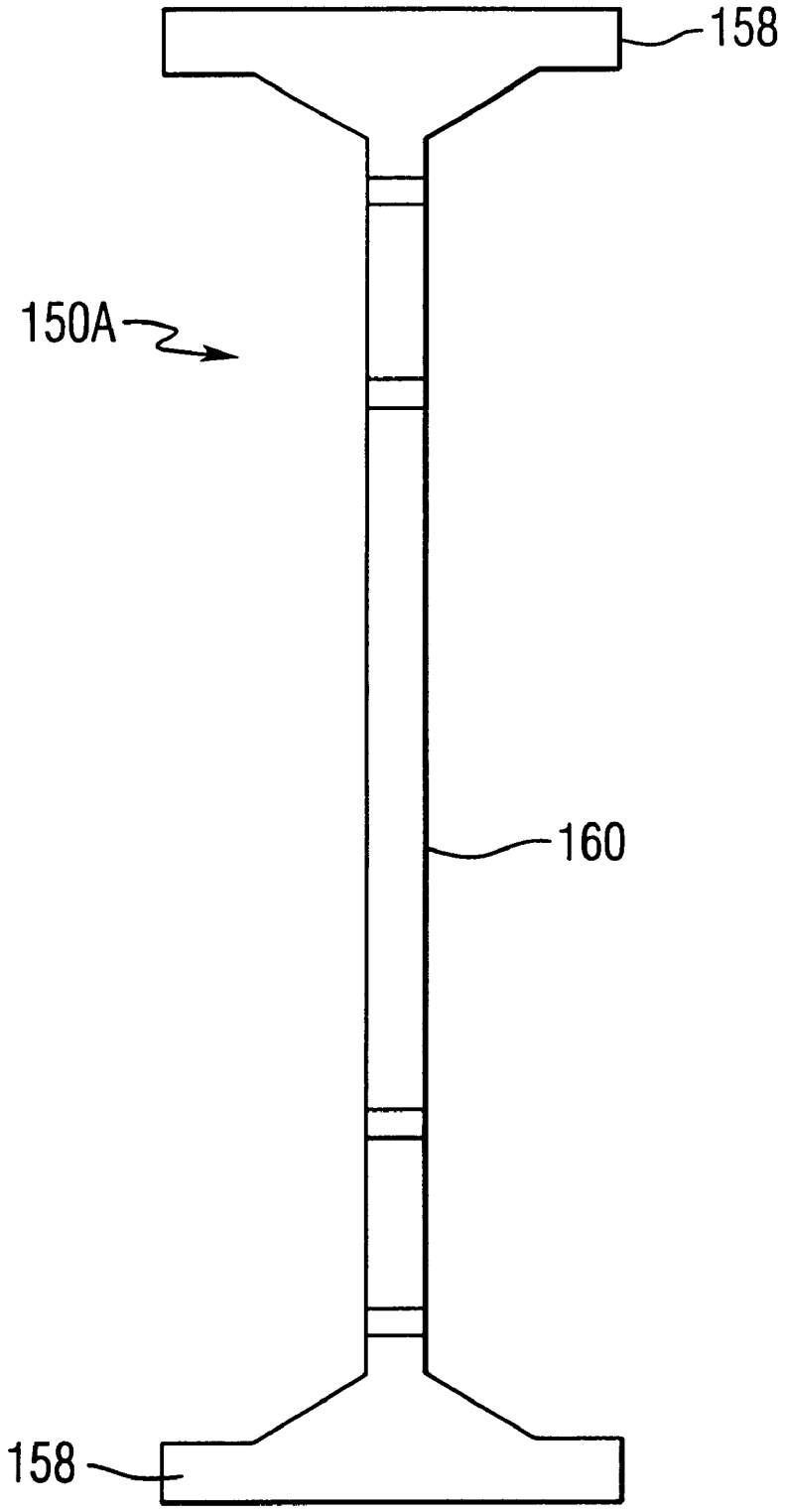
FIG. 44B is an overhead view of the support member shown in FIG. 44A.
Figure 45A:
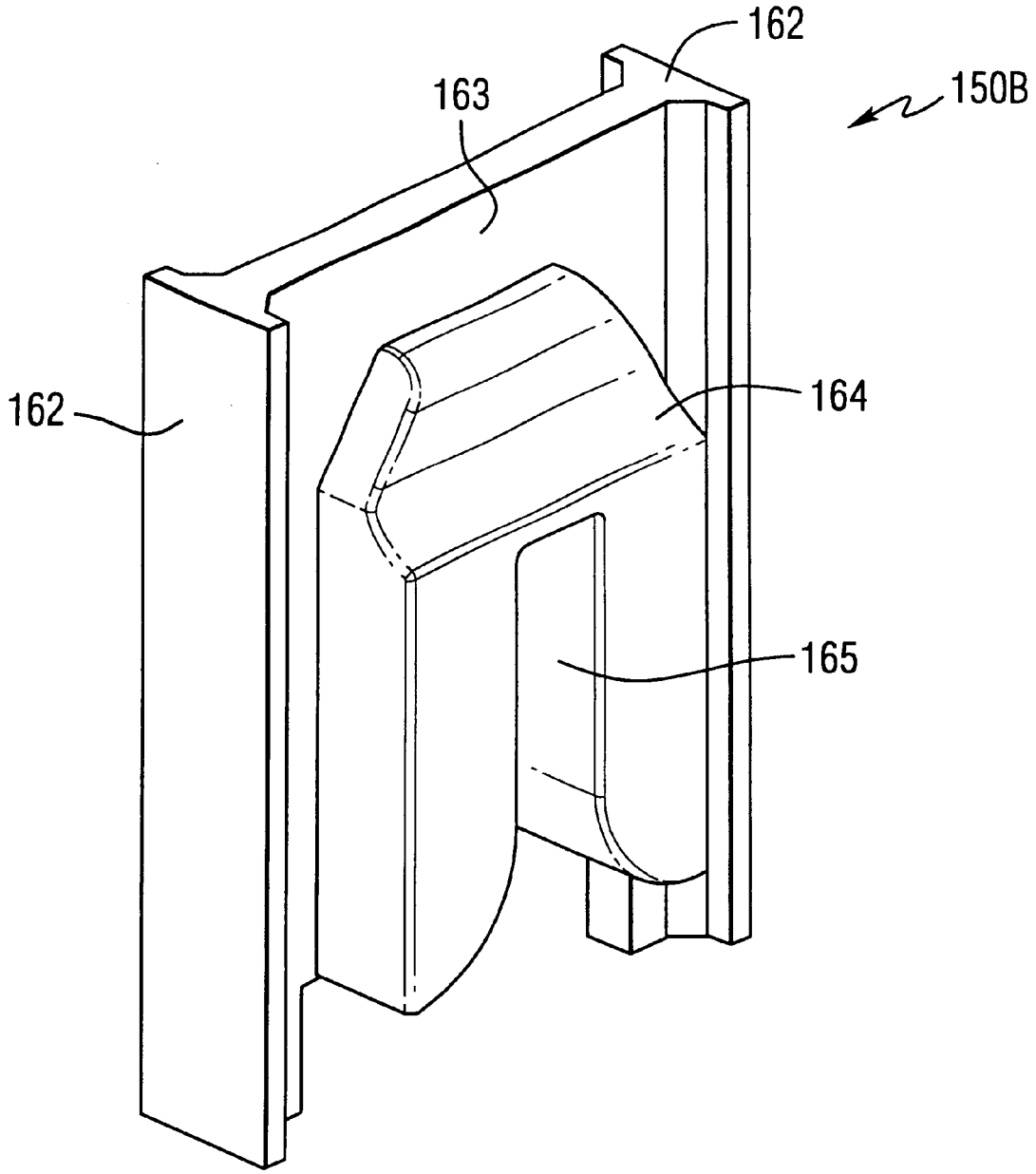
FIG. 45A is an orthogonal view of the other support member shown in FIG. 42.
Figure 45B:
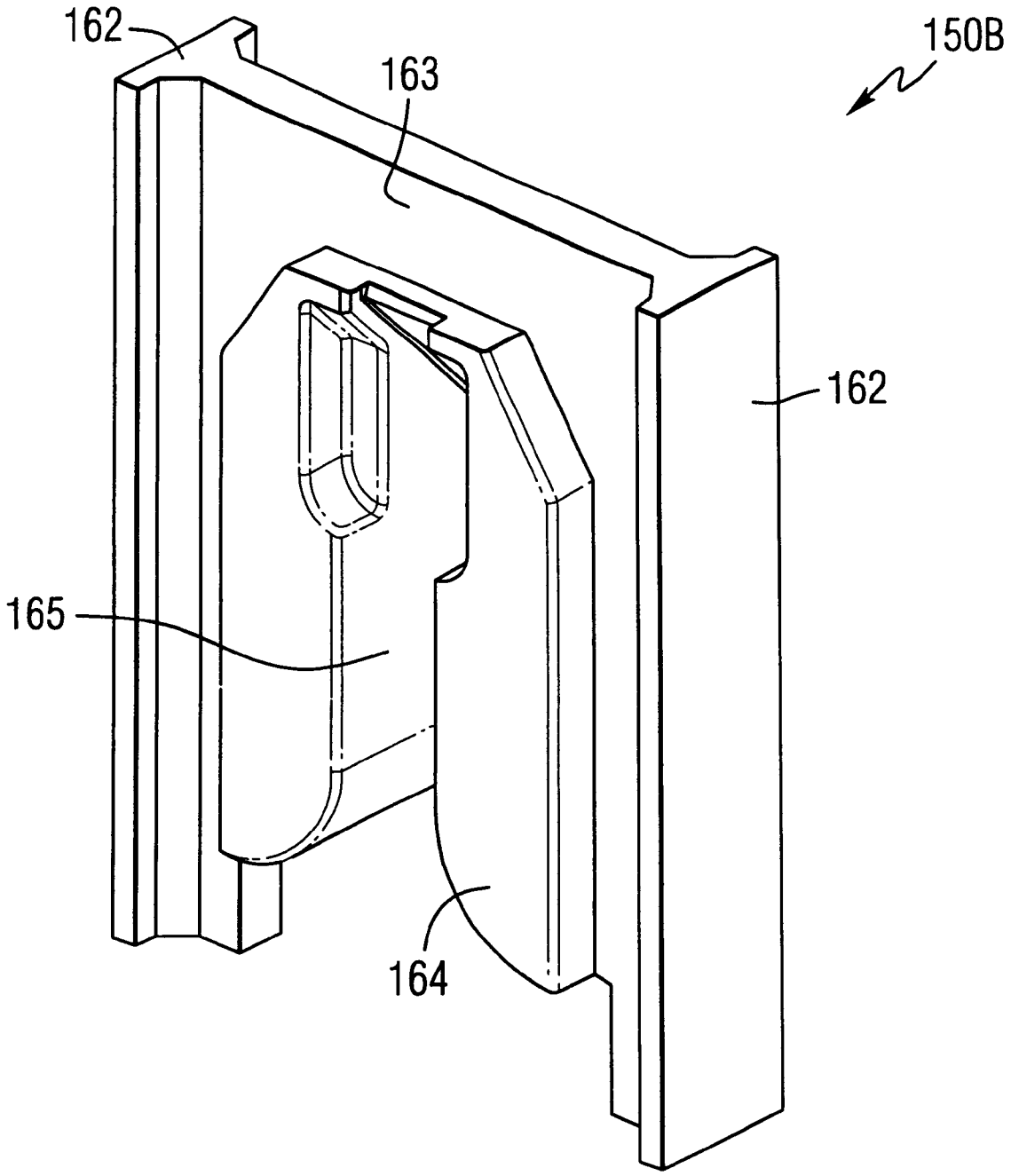
FIG. 45B is another orthogonal view of the support member shown in FIG. 45A.
Figure 45C:
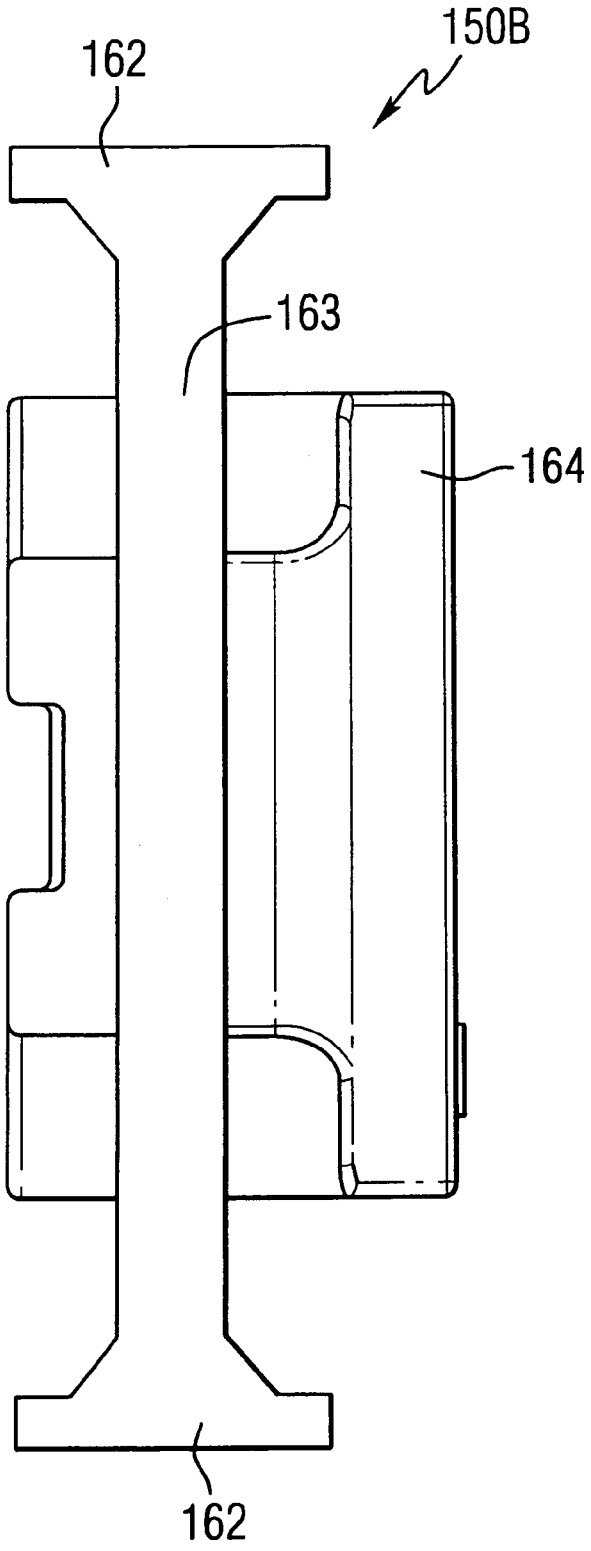
FIG. 45C is an overhead view of the support member shown in FIG. 45A.

Support member 150A includes a pair of shoulders or support wings 158 and a connection wall 160 therebetween, forming essentially an I-beam as shown in FIGS. 44A and 44B. Support member 150A of the exemplary embodiment also includes an opening 159 and a cutout region 161 that substantially extends upwardly into wall 160. Support member 150B includes a pair of shoulders or support wings 162 and a connection wall 163 therebetween, also forming essentially an I-beam as shown in FIGS. 45A, 45B, and 45C. In the exemplary embodiment, wall 163 includes an elongated integral housing 164 having an upwardly extending cutout region 165.

Figure 46:
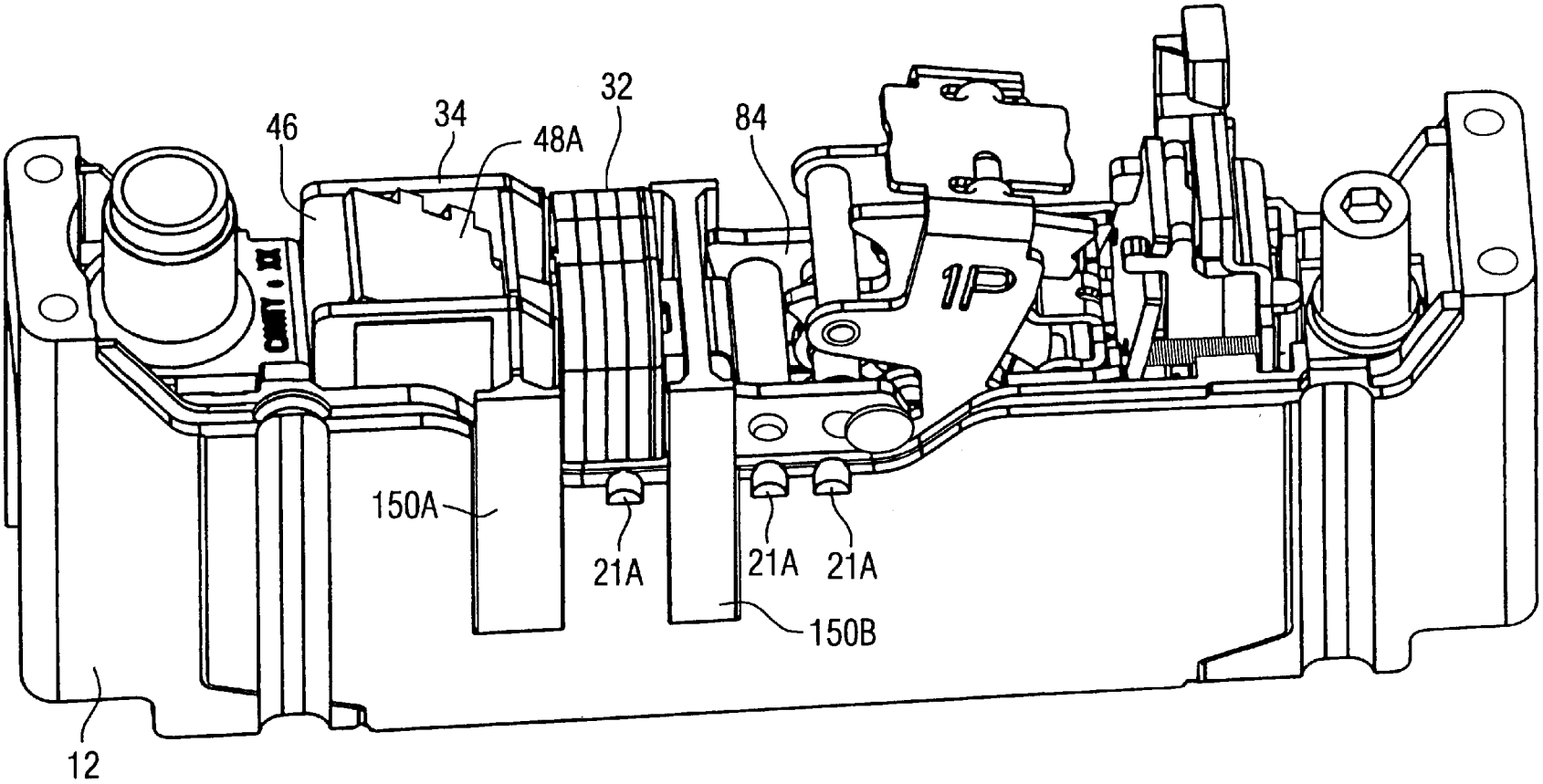
FIG. 46 is an orthogonal view of the base and internal portions of the circuit interrupter of FIG. 1 showing the positioning of the support members.

In use, as shown in FIG. 46, support member 150A is inserted into slots 154A of base 12 whereby shoulders 158 engage grooves 156. In this position, connection wall 160 is disposed internally within the body of base 12 and generally perpendicular to sidewalls 152. In relation to the other internal components of circuit breaker 10, support member 150A is disposed between arc extinguisher assembly 34 and slot motor assembly 32 in the exemplary embodiment. In that position, the clearance provided by cutout region 161 facilitates the transfer of arcs (created by contact separation) to arc chute 46 of arc extinguisher assembly 34 in order to be dissipated, while wall 160 serves as a barrier for protecting the internal workings of circuit breaker 10 (those components to the left of support member 150A as viewed in FIG. 46) from arcing and/or hot gases. Cutout region 161 also ensures that movable contact arm 50 has sufficient room to move throughout its required range of motion. Opening 159 provides clearance for upper arc runner 48A (FIG. 3) of arc chute 46 which is inserted therethrough.

As also shown in FIG. 46, support member 150B is inserted into slots 155A of base 12 whereby shoulders 162 engage grooves 157. As such, connection wall 163 is disposed internally within the body of base 12 and generally perpendicular to sidewalls 152. In relation to the other internal components of circuit breaker 10, support member 150B is disposed between slot motor assembly 32 and sideplates 84 in the exemplary embodiment. In that position, cutout region 165 provides clearance for movable contact arm 50 to move throughout its required range of motion. Elongated housing 164 serves to fill vacant space between slot motor assembly 32 and sideplates 84, and works with the rest of wall 163 to act as a barrier for protecting the internal workings of circuit breaker 10 (those components to the right of support member 150B as viewed in FIG. 46) from arcing and/or hot gases potentially created by contact separation.

Cover 14 is then placed on top of base 12, whereby the tops of support members 150A and 150B are inserted into slots 154B and 155B, respectively, and shoulders 158 and 162 engage their respective grooves, as shown in FIG. 1. Disposed as such, the I-beam nature of each of support members 150A and 150B prevents or limits further separation of sidewalls 152 and 153 due to circumstances such as the buildup of pressure within circuit breaker 10 resulting from the generation of gases during high current interruption (opening of contacts 52 and 56). In addition, shoulders 158 and 162 are appropriately dimensioned and manufactured of suitable material so as to enable support members 150A and 150B to also allow venting of circuit breaker 10 whereby pressure can be released. Upon a particular threshold pressure within circuit breaker 10, the outer edges of shoulders 158 and 162 "wing" slightly outward (away from the grooves) to provide this outward venting through slots 154A, 154B, 155A, and 155B, while at the same time maintaining sidewalls 152 and 153 at or near a constant separation distance. The width of connection walls 160 and 163 near shoulders 158 and 162, respectively, are selected so as to permit such venting through the slots notwithstanding the presence of those portions in the slots. Additional venting is provided by openings 21 (FIG. 1) which are formed at the interface between recesses 21A of base 12 and the bottom of sidewalls 153 of cover 14. Openings 21 are small enough and appropriately configured so that insertion of foreign items therein is substantially prevented.

Although two support members 150A and 150B are implemented in the exemplary embodiment, other numbers of such support mechanisms may, of course, be employed. Furthermore, the exact placement of one or more such support members is preferably experimentally established via the analysis of stress conditions in the base and cover of a particular circuit breaker. In one embodiment, support members 150A and 150B are formed of molded material comprising quantum 8800 (60% glass reinforced).

Figure 47A:
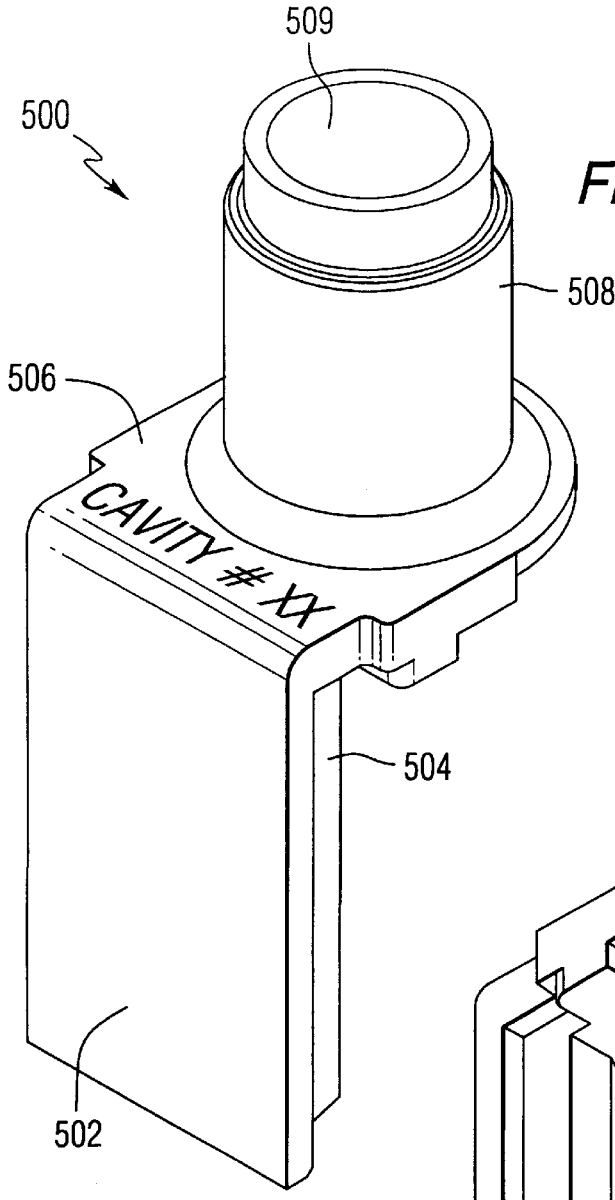
FIG. 47A is an orthogonal view of the deflector used in connection with the self-retaining collar of the line terminal of the circuit interrupter of FIG. 1.
Figure 47B:
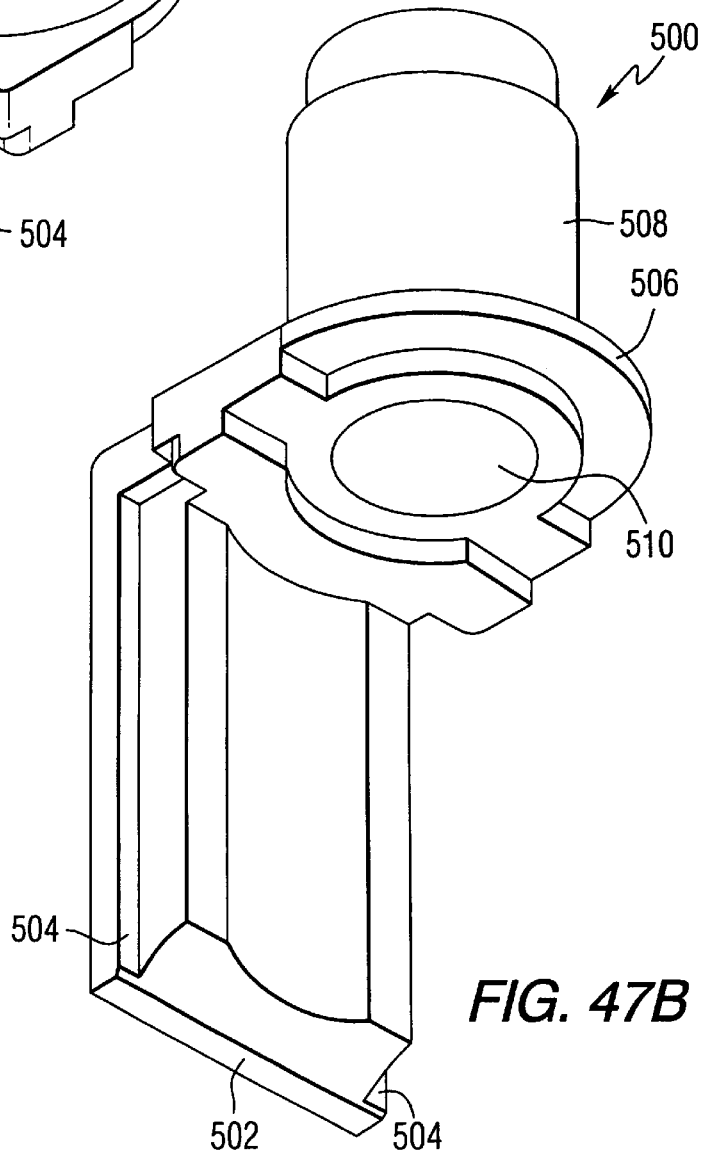
FIG. 47B is another orthogonal view of the deflector shown in FIG. 47A.

Now referring to FIGS. 47A and 47B, shown is an insulation barrier or deflector 500 of the present invention. Deflector or shield 500 includes a vertical wall 502 having sides with channels or grooves 504. Integrally connected to wall 502 is a shoulder 506 on which is formed a rounded cap 508. An opening 509 is formed in the top of cap 508, and an opening 510 is formed in the underside of shoulder 506, forming a cylindrical cavity therebetween. In one embodiment, deflector 500 is integrally molded of a thermoset plastic material.

Figure 48:
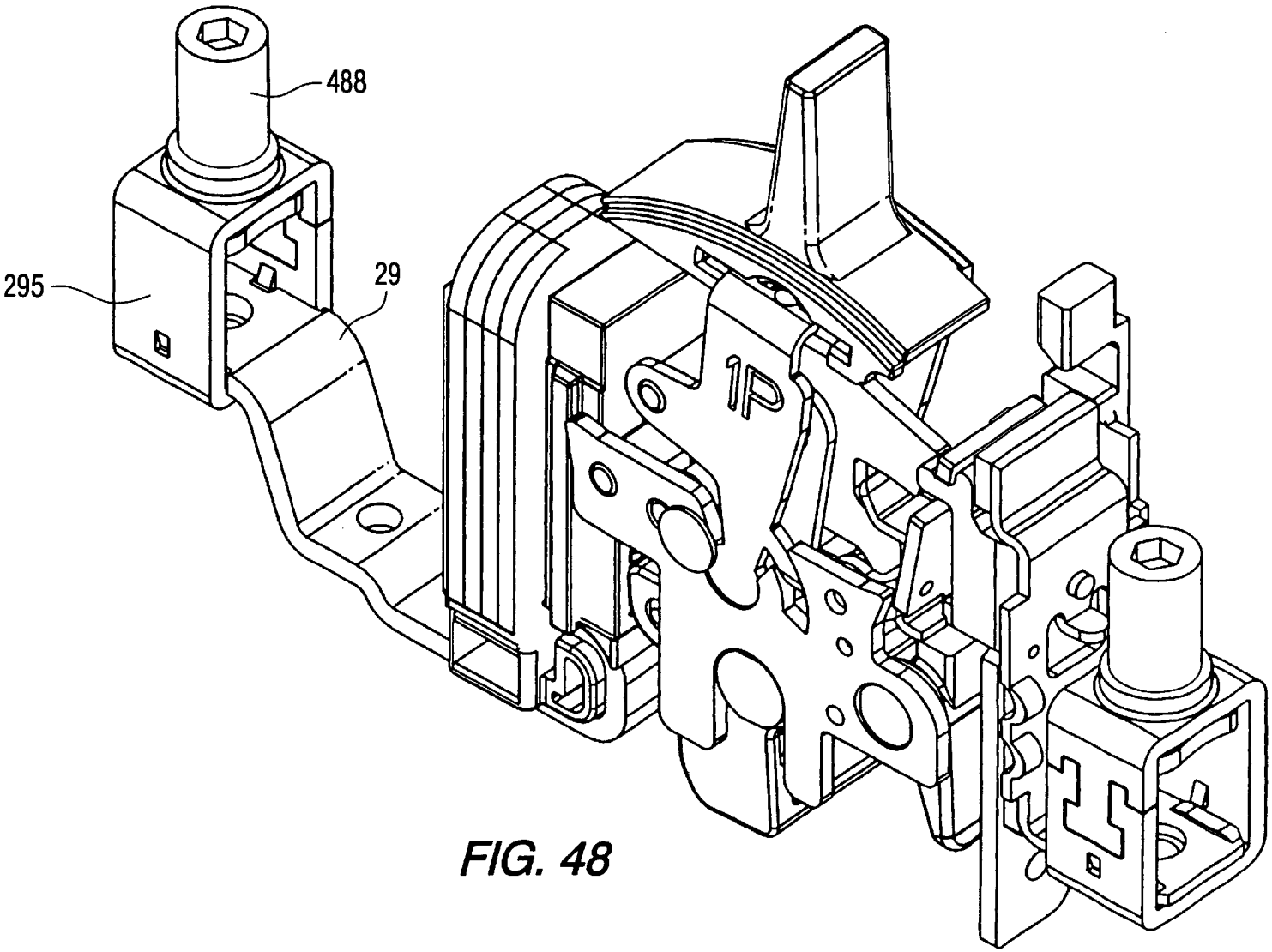
FIG. 48 is an orthogonal view of the internal portions of the circuit interrupter of FIG. 1 without the arc extinguisher assembly.
Figure 49:
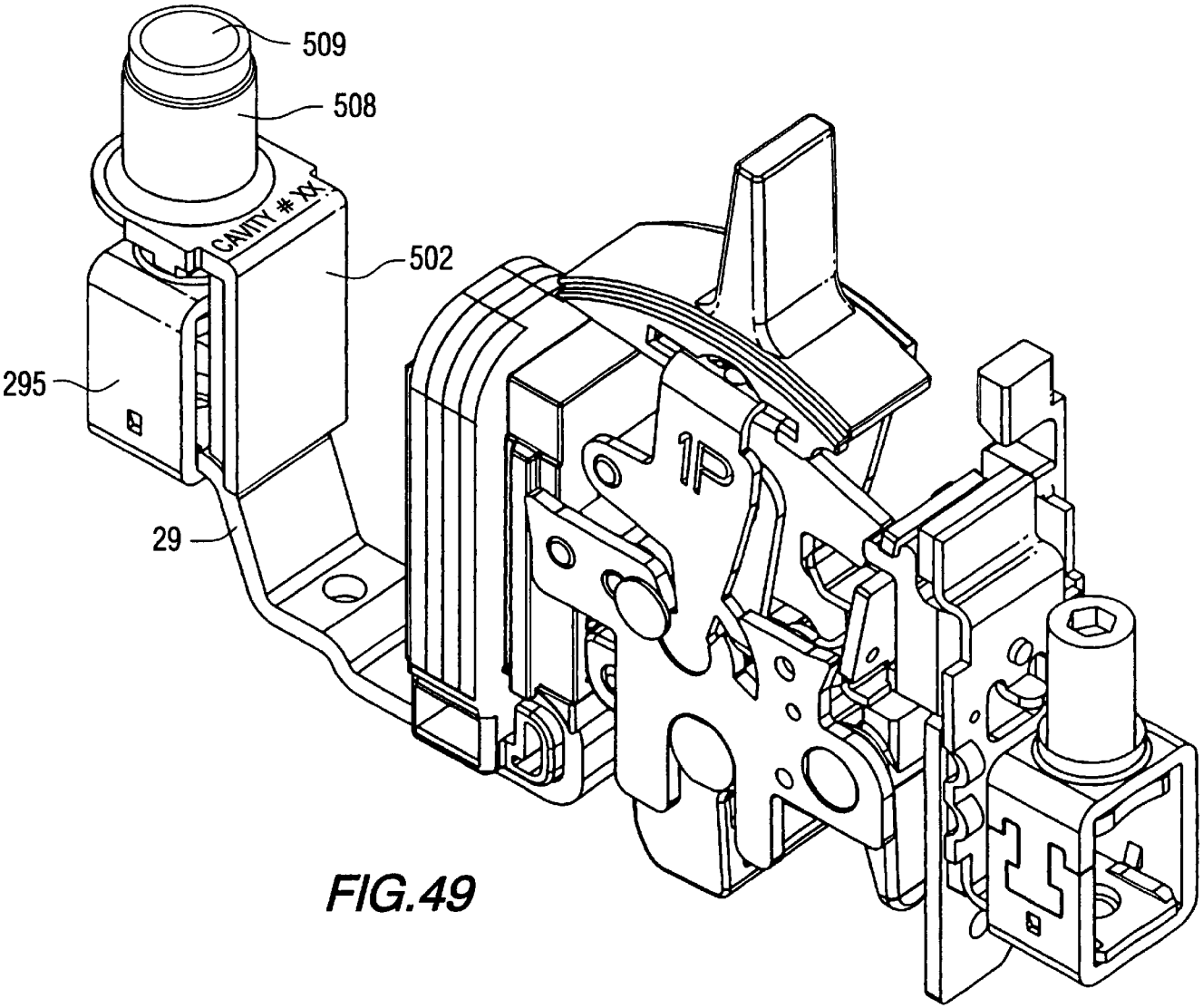
FIG. 49 is another orthogonal view similar to FIG. 48 but also showing the positioning of the deflector.

Now referring also to FIGS. 48 and 49, shown in FIG. 48 is a side elevational view of the internal components of circuit breaker 10 without arc extinguisher assembly 34. Line terminal 29 is shown connected to a self-retaining collar 295. In FIG. 49, deflector 500 is shown positioned above collar 295, with cap 508 on top of and covering screw 488 such that screw 488 may at least be partially inserted within opening 510. Vertical wall 502 of deflector 500 is positioned along the side of collar 295 that normally faces arc extinguisher assembly 34.

Figure 50:
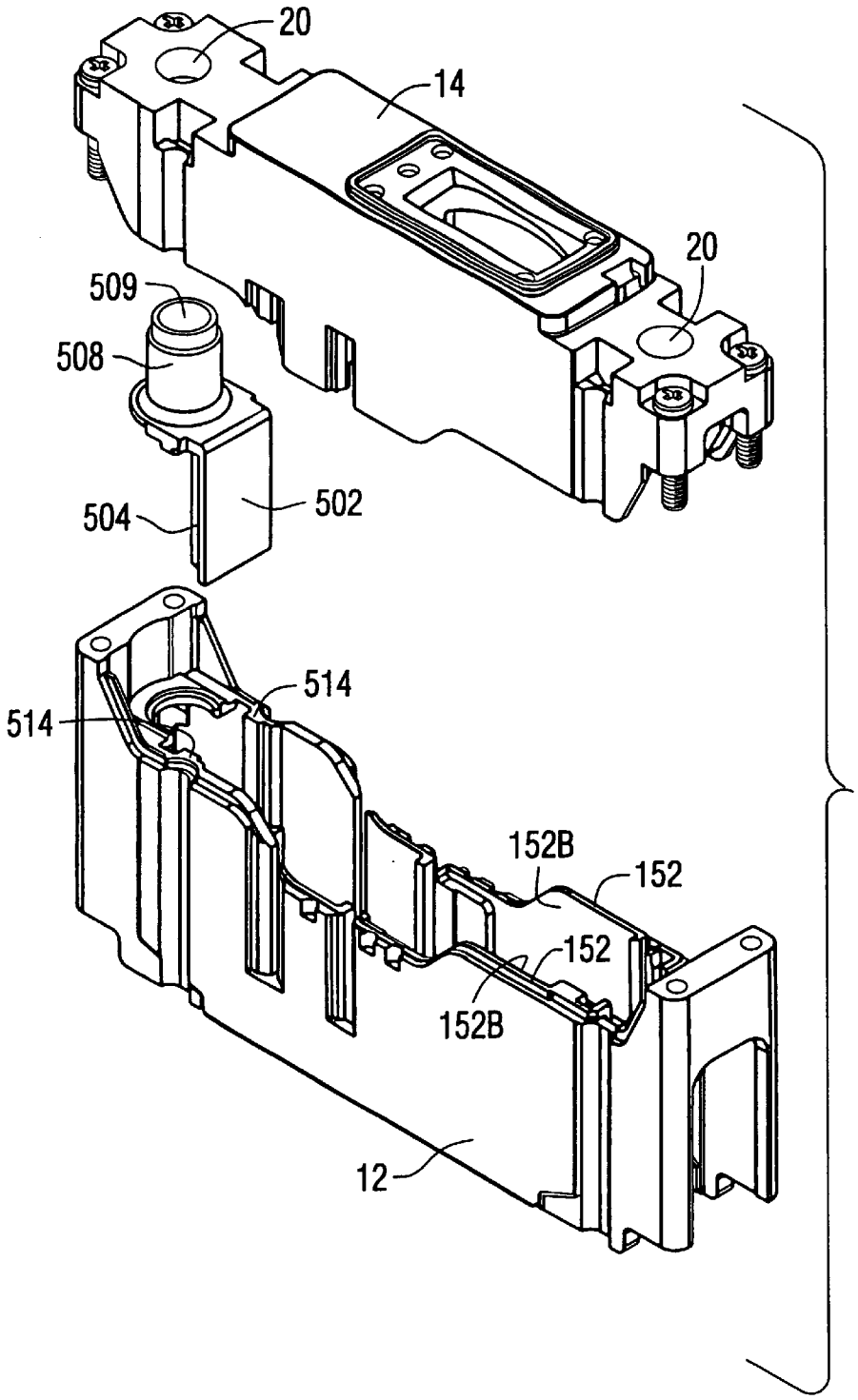
FIG. 50 is an exploded view of the base and cover of the circuit interrupter of FIG. 1 again showing the positioning of the deflector.
Figure 51:
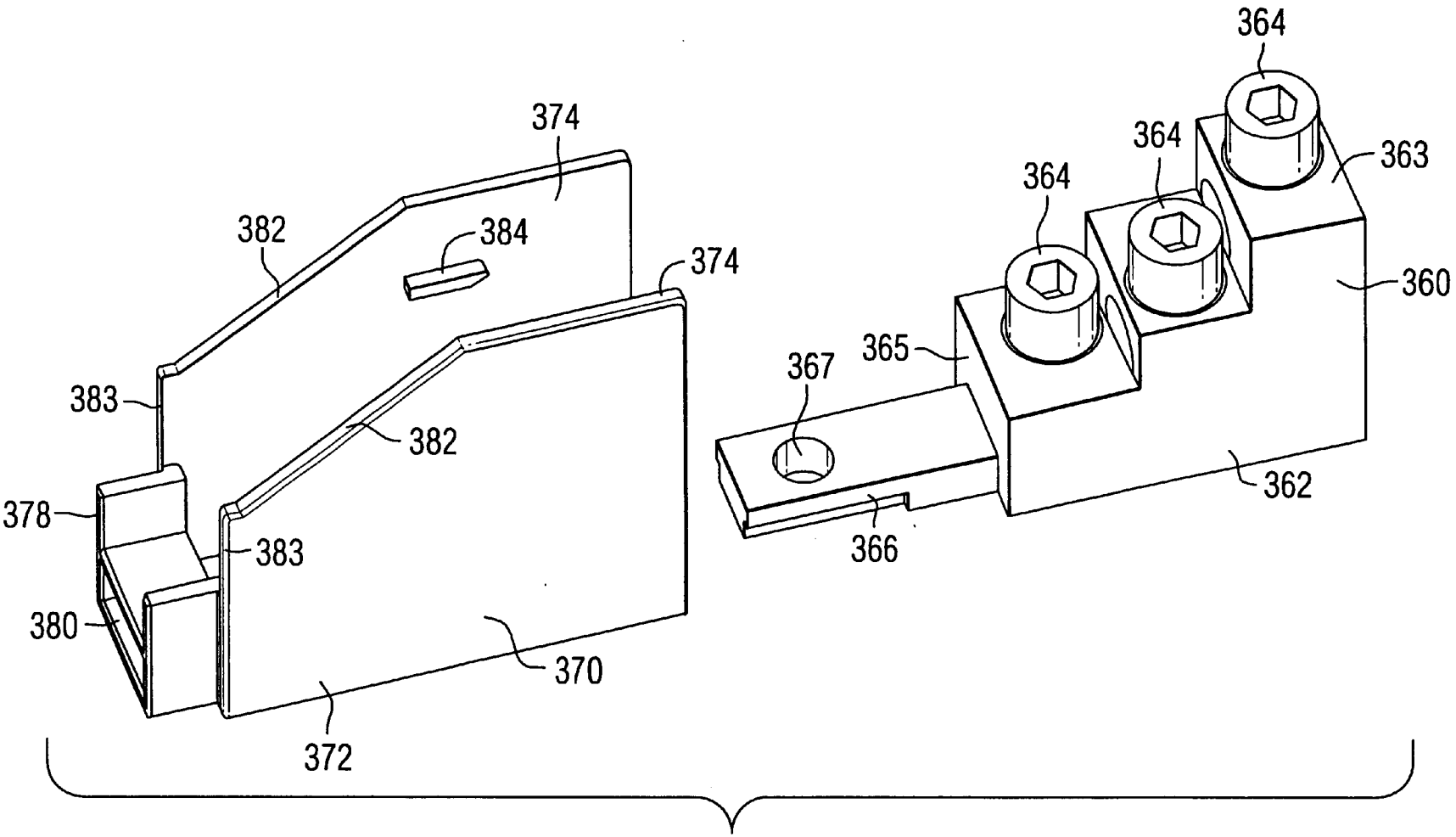
FIG. 51 is an orthogonal view of a lug assembly that may be implemented with the circuit interrupter of FIG. 1 and the lug insulator associated therewith.
Figure 52:
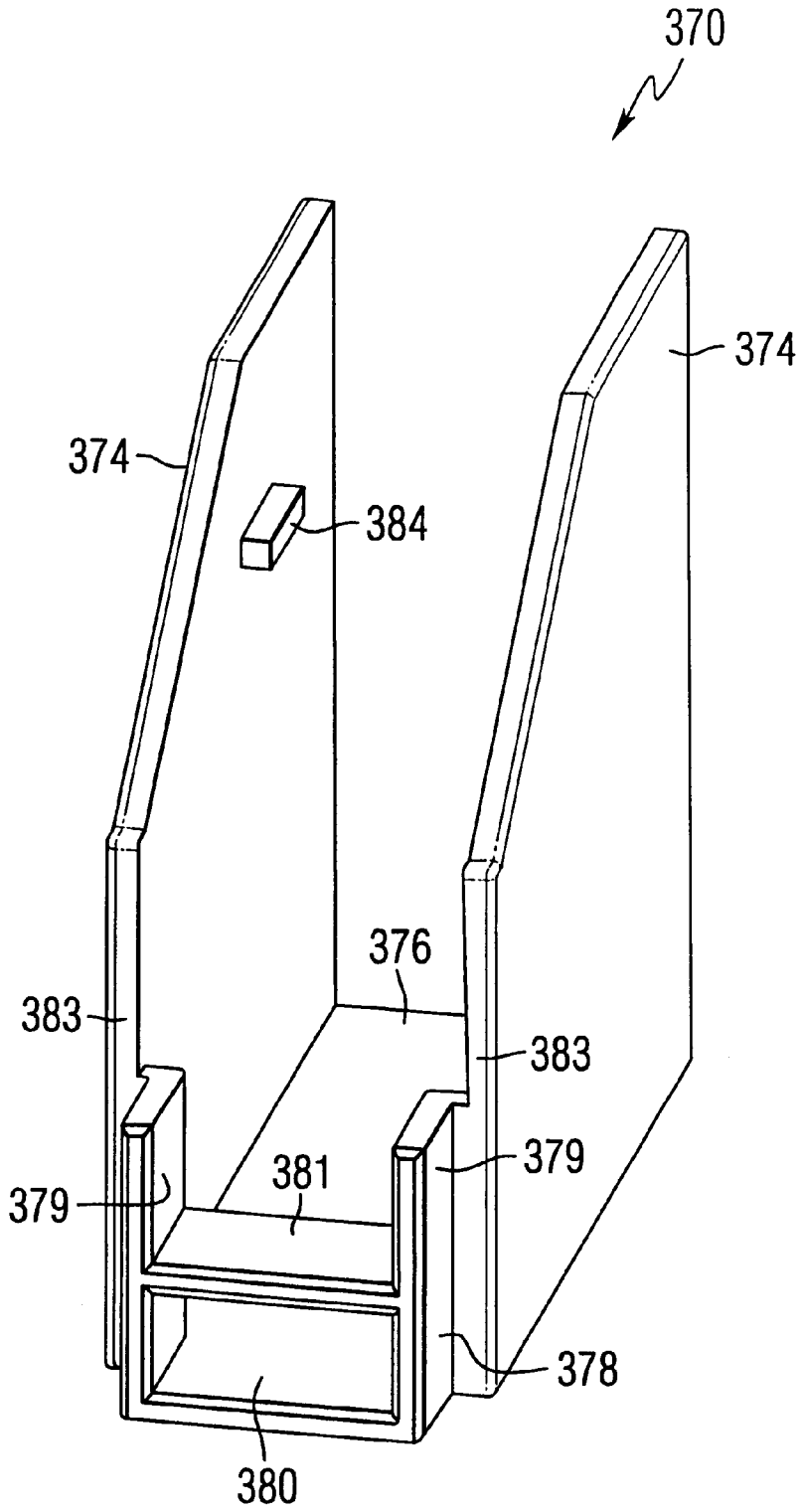
FIG. 52 is an orthogonal view of the lug insulator shown in FIG. 51.

Referring also now to FIG. 50, shown is deflector 500 in relation to base 12 and cover 14 (the other circuit breaker components, including collar 295, not shown for the sake of clarity). When deflector 500 is implemented within circuit breaker 10, it is vertically slid into base 12 such that grooves 504 engage vertically-extending protrusions 514 which are formed on the inner surfaces 152B of sidewalls 152 (see also FIG. 43). This engagement substantially prevents any lateral movement of deflector 500 relative to base 12, and enables vertical wall 502 to extend substantially perpendicularly between sidewalls 152 of base 12 without any gaps near its edges. Protrusions or rails 514 are, of course, appropriately positioned in base 12 so that a fully inserted deflector 500 is properly aligned with respect to the collar 295 that is connected to line terminal 29. When cover 14 is secured to base 12, portions of cover 14 are positioned close to and above the top of cap 508 whereby vertical movement of deflector 500 relative to base 12 is also substantially prevented. In addition, one of holes 20 of cover 14 aligns with opening 509 of deflector 500, thereby enabling a tool such as a screwdriver to be externally inserted into the cavity of cap 508 and to appropriately manipulate screw 488 (FIG. 29) of collar 295 in order to tighten or loosen the connection of line terminal 29 to an external conductor.

Positioned as described above within circuit breaker 10, deflector 500 provides an insulation barrier for effectively protecting collar 295 from arcing and/or hot gases that may be generated within circuit breaker 10, particularly during interruption of high currents.

Referring now to FIGS. 51–54, shown is an example of a conventional multi-wire lug assembly 360 that may be used as an accessory for circuit breaker 10 to enable more than one conductor line to be routed therethrough. Assembly 360 includes a body 362 with a plurality of lugs 364 arranged in step-like fashion thereon. Assembly 360 also includes a front wall 365 from which protrudes an appropriately configured connector portion 366 that is insertable into load conductor opening 26 in base 12 (see FIG. 1) and securable to load terminal 28 of circuit breaker 10 via a securement device such as self-retaining collar 295. Also shown is a lug insulator 370 of the present invention. Insulator 370 includes a main body 372 formed of two substantially parallel plates 374 with a wall 376 (FIG. 52) therebetween. Near its front, insulator 370 also includes an integral locking strap or locking structure 378 with two vertical side bars 379 and a horizontal bar 381 therebetween forming an opening 380 that is appropriately sized and configured for insertion of connector 366 of lug assembly 360 therein. Each plate 374 includes a tapered portion 382, a front portion 383, and, in the exemplary embodiment, an internally disposed protrusion 384 (only one is shown). In a preferred embodiment, insulator 370 is comprised of thermoplastic material.

Figure 53:
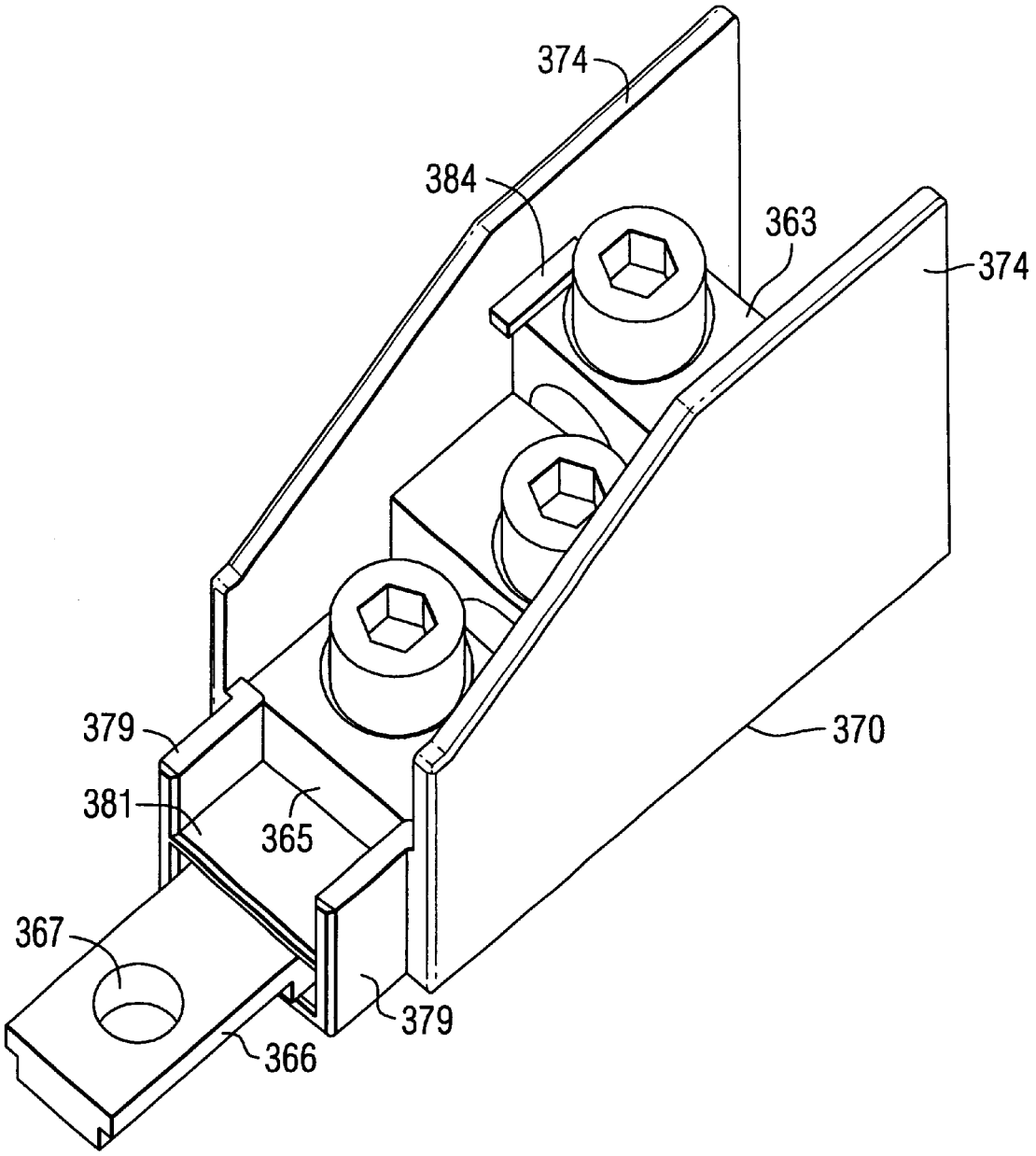
FIG. 53 is an orthogonal view of the lug assembly and lug insulator of FIG. 51 in an assembled state.
Figure 54:
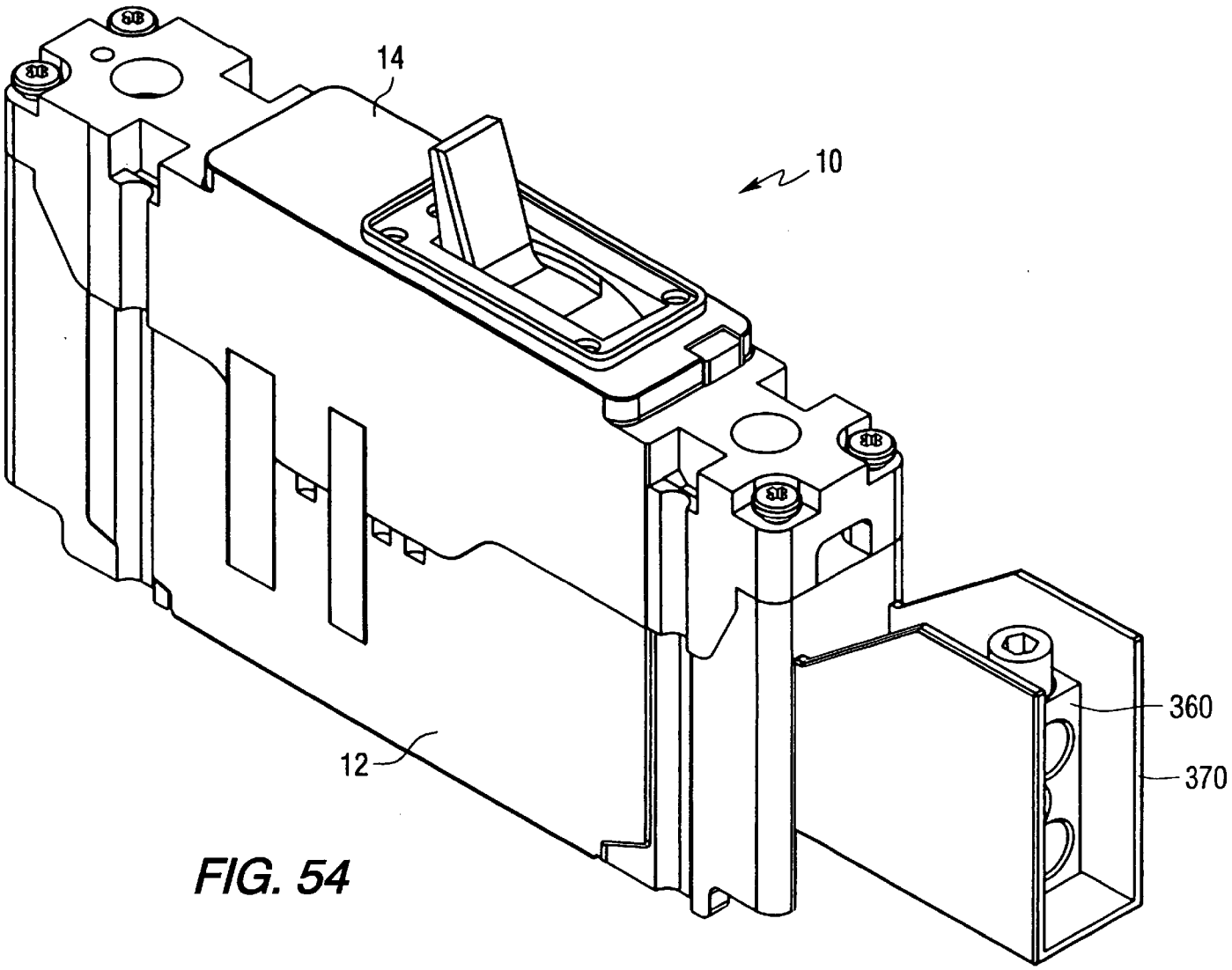
FIG. 54 is an orthogonal view of the circuit interrupter of FIG. 1 with the lug assembly and lug insulator attached.

As shown in FIG. 53, before connection to a circuit breaker, lug assembly 360 may advantageously be assembled to lug insulator 370, with body 362 placed between plates 374 and connector 366 inserted through opening 380 of locking strap 378 until front wall 365 contacts bars 379 and bar 381 of locking strap 378. Positioned as such, a top surface 363 of lug assembly 360 abuts against the bottoms of protrusions 384 of plates 374. This abutment, along with wall 376 (FIG. 52) of insulator 370 and horizontal bar 381 of locking strap 378, serves to help secure lug assembly 360 to lug insulator 370 and prevent vertical separation therebetween. After the aforementioned assembly, connector 366 of lug assembly 360 may then be inserted, in normal fashion, into load conductor opening 26 in base 12 of circuit breaker 10 (as shown in FIG. 54) and secured to load terminal 28 via a securement device such as collar 295 (not visible). Note that front portions 383 of plates 374 abut against external surfaces of base 12, providing enhanced stability to the connection. Once connector 366 is secured to load terminal 28, insulator 370 is locked in place and cannot be separately removed (pulled away) due to the contact between locking strap 378 thereof and front wall 365 of lug assembly 360.

Lug insulator 370 provides electrical insulation for multi-wire lug assembly 360. While providing this protective insulation, lug insulator 370 nonetheless provides easy access to lugs 364 of lug assembly 360. In particular, tapered portions 382 of plates 374 follow the step-like configuration of lugs 364 so that convenient access is provided for all lugs.

Although the preferred embodiment of the present invention has been described with a certain degree of particularity, various changes to form and detail may be made without departing from the spirit and scope of the invention as hereinafter claimed.

What is claimed is:

1. A circuit interrupter comprising:

a housing;

separable main contacts within said housing;

an operating mechanism within said housing and interconnected with said separable main contacts; and a trip mechanism within said housing and including a rotatable trip bar assembly that, when rotated, generates a tripping operation causing said operating mechanism to open said contacts, said trip mechanism further including an automatic trip assembly for rotating said trip bar assembly upon a predetermined current threshold, said automatic trip assembly including a magnetic yoke having two arms with a pivot support on the top of each, one of said pivot supports including a downwardly facing stop, said automatic trip assembly further including an armature having a bottom and having pivot portions positioned on said pivot supports providing for rotation of said armature between a first position where said bottom is away from said magnetic yoke and a second position where said bottom is closer to said magnetic yoke, said downwardly facing stop positioned to abut said armature when said bottom is rotated away from said magnetic yoke, said stop thereby defining said first position, a magnetic field being generated upon said predetermined current threshold causing said armature to rotate from said first position to said second position and to rotate said trip bar assembly and generate said tripping operation.

2. The circuit interrupter as defined in claim 1 wherein said automatic trip assembly includes a spring for biasing said armature in said first position.

3. The circuit interrupter as defined in claim 1 wherein said armature includes cutout regions forming two shoulder portions, a neck portion, and a head portion, said pivot portions formed in said head portion, and wherein said stop abuts said armature near one of said shoulder portions.

4. A circuit interrupter comprising:

a housing;

separable main contacts within said housing;

an operating mechanism within said housing and interconnected with said separable main contacts; and a trip mechanism within said housing and including a rotatable trip bar means that, when rotated, generates a tripping operation causing said operating mechanism to open said contacts, said trip mechanism further including an automatic trip means for rotating said trip bar means upon a predetermined current threshold, said automatic trip means including a magnetic means having two pivot supports, one of said pivot supports including an abutment means, said automatic trip means further including an armature having a bottom and having pivot portions positioned on said pivot supports providing for rotation of said armature between a first position where said bottom is away from said magnetic means and a second position where said bottom is closer to said magnetic means, said abutment means positioned to abut said armature when said bottom is rotated away from said magnetic means, said abutment means thereby defining said first position, a magnetic field being generated upon said predetermined current threshold causing said armature to rotate from said first position to said second position and to rotate said trip bar means and generate said tripping operation.

* * * * *